US005899303A

United States Patent [19]

Allen

[11] Patent Number: 5,899,303

[45] Date of Patent: May 4, 1999

[54] HOISTWAY DOOR SEAL STRUCTURE

[76] Inventor: Thomas H. Allen, 2004 North 10th St., Boise, Id. 83702

[21] Appl. No.: 08/975,415

[22] Filed: Oct. 22, 1997

Related U.S. Application Data

[63] Continuation of application No. 08/423,958, Apr. 18, 1995, abandoned.

[51] Int. Cl.[6] ..... B66B 13/08

[52] U.S. Cl. ..... 187/333; 49/208; 49/209; 160/118

[58] Field of Search ..... 187/333, 325, 187/334, 336; 52/243.1; 49/208, 209, 404; 160/201, 214, 118

[56] References Cited

U.S. PATENT DOCUMENTS

| | | | |
|---|---|---|---|
| 1,406,951 | 2/1922 | Fehr . | |
| 2,517,713 | 8/1950 | Rissler | 187/31 |
| 3,065,826 | 11/1962 | Tucker, Jr. | 187/52 |
| 3,074,124 | 1/1963 | Bergstedt | 20/19 |
| 3,425,162 | 2/1969 | Halpern | 49/425 |
| 3,734,238 | 5/1973 | Secresty et al. | 187/1 |
| 3,805,450 | 4/1974 | Forcina | 49/231 |
| 3,807,480 | 4/1974 | Smart | 160/1 |
| 3,817,161 | 6/1974 | Koplon | 98/39 |
| 3,912,049 | 10/1975 | Holland et al. | 187/61 |
| 4,058,191 | 11/1977 | Balbo | 187/1 R |
| 4,115,953 | 9/1978 | Brosenius | 49/125 |
| 4,404,770 | 9/1983 | Markus | 49/235 |
| 4,592,270 | 6/1986 | Vener | 98/39 |
| 4,637,176 | 1/1987 | Acock, Jr. | 52/30 |
| 4,651,469 | 3/1987 | Ngian et al. | 49/223 |
| 4,735,293 | 4/1988 | Everhart et al. | 187/56 |
| 4,987,638 | 1/1991 | Ribaudo | 16/89 |
| 5,083,639 | 1/1992 | Kappeler | 187/51 |
| 5,165,142 | 11/1992 | Pilsbury | 16/90 |
| 5,195,594 | 3/1993 | Allen et al. | 169/48 |
| 5,305,855 | 4/1994 | Rivera et al. | 187/56 |
| 5,383,510 | 1/1995 | Allen | 160/310 |
| 5,427,205 | 6/1995 | Saillio et al. | 187/334 |

FOREIGN PATENT DOCUMENTS

| | | | |
|---|---|---|---|
| 0 478 938 A1 | 8/1991 | European Pat. Off. | B66B 13/30 |
| 2315-598 | 6/1975 | France | E05D 15/06 |
| 2582-343 | 5/1985 | France | E05D 15/06 |
| 5-118180 | 5/1993 | Japan | E05F 1/02 |
| 6-72681 | 3/1994 | Japan | B66B 13/30 |
| 6032572 | 8/1994 | Japan | B66B 13/30 |
| 2 219 618 | 12/1989 | United Kingdom | E06B 3/46 |

*Primary Examiner*—William E. Terrell
*Assistant Examiner*—Khoi H. Tran
*Attorney, Agent, or Firm*—Seed and Berry LLP

[57] ABSTRACT

A hoistway door seal structure for limiting the flow of air through a hoistway opening when the door is closed. The hoistway door seal structure includes a hoistway door that covers a hoistway entrance defined by an opening in a hoistway wall structure. An elongated door support member is connected to the wall structure and is positioned in a generally horizontal orientation above the hoistway entrance. A seal structure is supported between the hoistway door and the wall structure. A door support is connected to the hoistway door and is movably connected to the elongated support member to support the door while permitting movement of the door in a lateral direction between an open position permitting access to the hoistway and a closed position wherein the door substantially covers the hoistway entrance with a space between the hoistway door and the wall structure. The elongated support member includes a guide portion that guides the hoistway door, as the hoistway door is moved to the closed position, in a second direction toward the seal structure. The second direction being different than the lateral direction such that the hoistway door sealably engages the seal structure to seal the space between the door and the wall structure when the door is closed.

19 Claims, 32 Drawing Sheets

HOISTWAY DOOR SEAL STRUCTURE

This application is a continuation of Ser. No. 08/423,958 filed Apr. 18, 1995, abandoned.

TECHNICAL FIELD

The present invention relates to elevator systems and, more particularly, to a hoistway support assembly and a sealing structure mounted between the hoistway door and hoistway entrance.

BACKGROUND OF THE INVENTION

The U.S. Fire Administration and the National Fire Protection Association (NFPA) estimate that 75% of all deaths, injuries and property damage during a building fire is a direct result of smoke. A natural ventilation cycle occurs in the elevator shaft called "stack effect" drawing smoke into the elevator shaft and exhausting it onto upper floor levels. The taller the vertical shaft and the greater the differential between the inside and outside air temperatures, the greater the draft up the shaft. Historically, elevator systems have dealt primarily with providing a safe means of vertical transportation in multi-story buildings and have not addressed the issue of vertical smoke migration via the hoistway shaft.

The World Trade Center building experienced an explosion and fire within a subterranean parking level. The smoke from the fire migrated through the elevator shafts and within minutes following the explosion caused the evacuation of the entire 110 story building complex. The official report of the NFPA noted the inability of the closed hoistway doors to prevent the migration of the smoke as one of the primary sources of the substantial smoke damage experienced throughout the building.

The basic configuration and operation of an elevator system is well known. A multiple level building contains a vertical shaft defined by a top, bottom and vertical structural walls through which an elevator cab travels between levels. Adjacent to each floor level an opening in the structural wall forms a hoistway entrance through which building occupants can safely pass when the elevator cab is adjacent to the hoistway entrance and registered with the lobby floor. An interlock mechanism connects the elevator car door to the hoistway door when the elevator car is positioned adjacent to a floor such that the elevator car door and the hoistway door are moved together to an open or closed position.

The hoistway entrance comprises a hoistway door head frame attached to a headwall and a pair of hoistway door lateral jambs attached to the jambwall. A sill is displaced below the hoistway door at the floor adjacent to the hoistway entrance opening. A head panel extends from the headwall toward the inner hoistway door to fill the space between the headwall and the hoistway door. The head panel provides an aesthetic shield that blocks the workings of the hoistway door from the view of persons entering or exiting the elevator cab.

Conventional hoistway doors include one or more door panels that are movably supported on a horizontal support rail that is connected to the headwall above the hoistway entrance in a generally horizontal orientation. The doors substantially cover the hoistway entrance opening when they are in the closed position. A clearance gap between the hoistway door and the door frame and between the door panels is necessary to allow the door to open and close without excessive resistance due to contact with the door frame. Movement of the hoistway door panels is restricted to a lateral direction parallel to the hoistway door opening such that the clearance gap is maintained as the hoistway door moves between the open and closed position.

Even though the clearance gap between the elevator hoistway door and the hoistway entrance is limited to 0.375 of an inch by recognized industry standards, large quantities of air freely flow through the clearance gap into and out of the elevator shaft. During a building fire, the stack effect can cause the elevator hoistway to become a smoke stack which quickly distributes smoke and toxic gases throughout the building, thereby jeopardizing human life and property far from the source of the fire.

SUMMARY OF THE INVENTION

The present invention provides a hoistway door seal structure that limits the flow of air through a hoistway opening when the door is in a closed position so as to restrict the passage of smoke in the event of a fire. In a preferred embodiment of the invention, a wall structure has an opening therein defining a hoistway entrance, and a single or multiple of hoistway doors cover the hoistway entrance. Seal structures are positioned between the hoistway doors and the wall structure. The single or multiple hoistway doors are movably supported by an elongated door support member positioned on the wall structure above each of the doors. The door support member is adapted to change the direction of travel of the hoistway door panel relative to the opening and the wall structure as the hoistway door moves between an open position and a closed position.

The door support member further directs the movement of the hoistway door into engagement with the seal structures as the hoistway door is moved to the closed position to cover the hoistway entrance. Accordingly, a barrier is formed as the hoistway door is moved to the closed position, and the barrier blocks smoke and gas migration between the door and the hoistway opening. An interlock catching mechanism, connected to the hoistway door is sized to engage the interlock mechanism connected to an elevator cab door when the hoistway door panel is in the closed position and the elevator cab door is moved from closed to open.

In the preferred embodiment of the invention, each hoistway door is connected to door support members having support trucks and pulley wheels, and the pulley wheels movably engage the door support member. The door support member has lowered portions sized and located to receive the pulley wheels when the door is moved laterally to the closed position, thereby directing the hoistway door in a second direction, such as downwardly toward the sill, upon closing.

In an alternate embodiment, the door support member slopes vertically downward toward the center of the hoistway entrance, with the door support member directing the hoistway door downwardly into engagement with the seal structure as the door panel moves toward the closed position. Thus, the door support member causes the door panel to move laterally and vertically relative to the hoistway opening along the path of travel of each pulley wheel thereby directing the hoistway door panel toward the sill upon closing.

In another alternate embodiment, the door support member has portions that curve inwardly toward the center of the hoistway entrance along the path of travel of each pulley wheel thereby directing the hoistway door panel toward the hoistway entrance upon closing and into sealable engagement with the seal structures.

Accordingly, the instant invention provides an effective barrier to the passage of gas and smoke between the hoistway door and the hoistway entrance, thereby providing an economical solution to the gas/smoke infiltration problem experienced by the elevator industry. Further, the instant invention maintains a high level of safety for passengers traveling in the elevator system by providing a barrier that prevents gas and smoke from entering a hoistway from a floor lobby.

BRIEF DESCRIPTION OF THE DRAWINGS

This invention, along with its many attendant advantages and benefits, will become better understood by reading the detailed description of the preferred embodiment with reference to the following drawings, wherein.

DETAILED DESCRIPTION OF THE INVENTION

Figure 1:
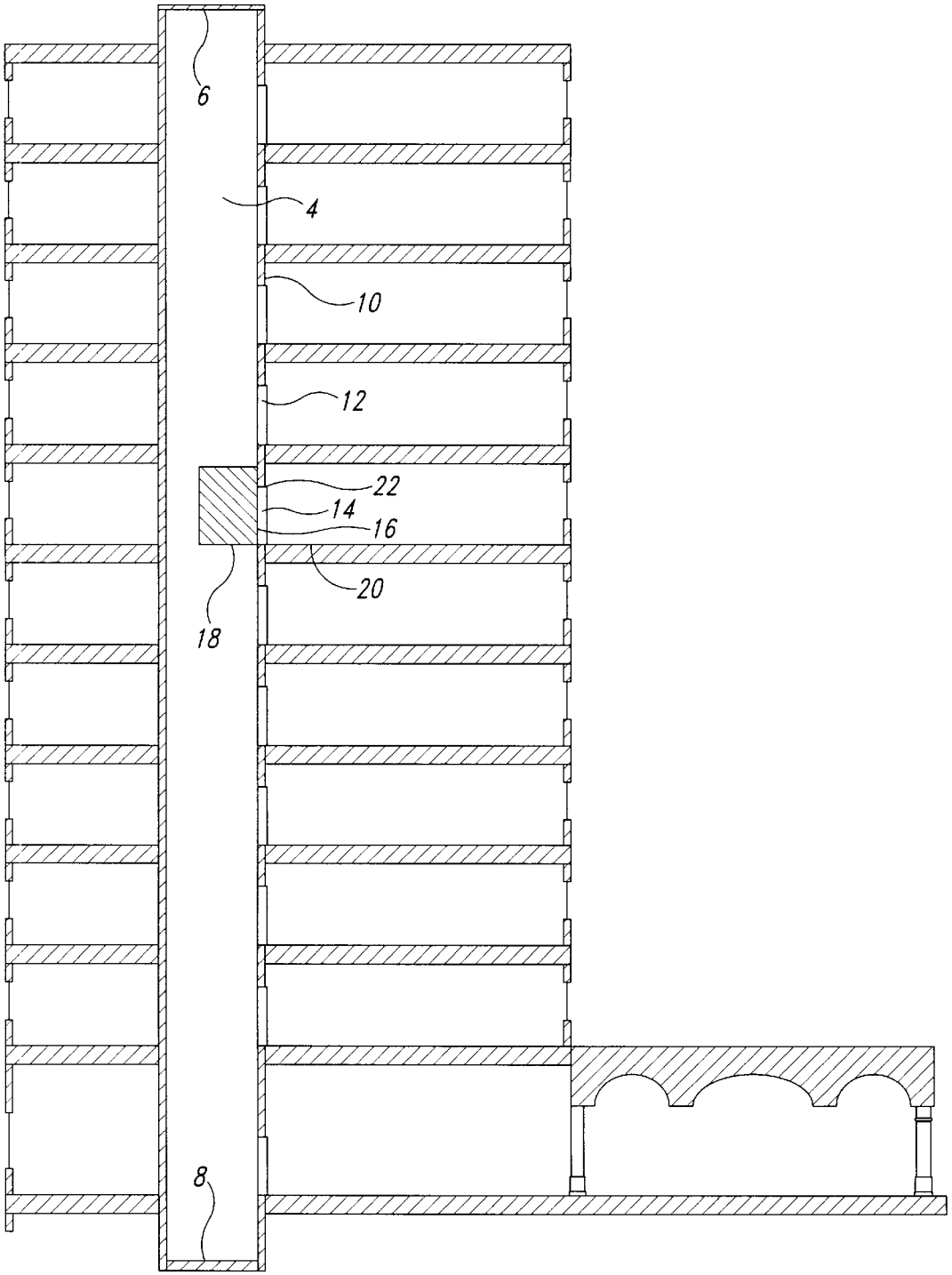
FIG. 1 is a sectional view of a multiple level building, showing an elevator system with an embodiment of the elevator hoistway door seal structure in accordance with the present invention, a hoistway door seal structure being shown with a hoistway entrance on each level adjacent to an elevator lobby.

Referring now to the drawings wherein like reference characters designate identical or corresponding parts, and more particularly to FIG. 1 thereof, there is shown a multiple level building with an elevator hoistway 4 having an upper limit 6 and a lower limit 8, with a wall structure 10 extending therebetween. A hoistway opening 12 in the wall structure 10 occurs at each level, defining a hoistway entrance 14 which is closable by a movable hoistway door assembly 16. When an elevator cab 18 is adjacent to an elevator lobby floor 20 and directly adjacent to the hoistway entrance 14, the hoistway door assembly 16 is moved by a conventional interlock system to an open position to allow passengers to pass through the hoistway entrance, and when the elevator cab is not adjacent to the elevator lobby floor, the hoistway door assembly remains in a closed position.

The hoistway door assembly 16 is movably supported by a hoistway door seal structure 22 in accordance with the present invention. The hoistway door seal structure 22 of the preferred embodiment is adjacent to each hoistway entrance 14 and is positioned to provide seals between the hoistway door assembly 16 and the wall structure 10 around the hoistway opening 12.

The hoistway door seal structure 22 engageably seals the gap between the hoistway door assembly 16 and the wall structure 10 when the hoistway door is moved from an open position toward a closed position to limit the flow of air through the hoistway opening 12. Accordingly, the hoistway door seal structure 22 restricts the passage of gas and smoke between the hoistway door assembly 16 and the wall structure 10 in the event of a fire. The hoistway door seal structure 22 includes seals, discussed in greater detail below, that are constructed of shaped, temperature resistive material or other material such as light gauge metal, silicone, metallic brushes etc. that can be slightly compressed when the hoistway door assembly 12 is moved into engagement therewith to create an effective seal between the hoistway door assembly and the wall structure 10. Although the embodiments described herein are described in terms of the seals around the hoistway door assembly 12 blocking the flow of smoke and as in the event of a fire, the seals are also effective in blocking the flow of air or the like between the hoistway door assembly and the wall structure 12 during operation of the hoistway, during maintenance thereof, or the like.

Figure 2:
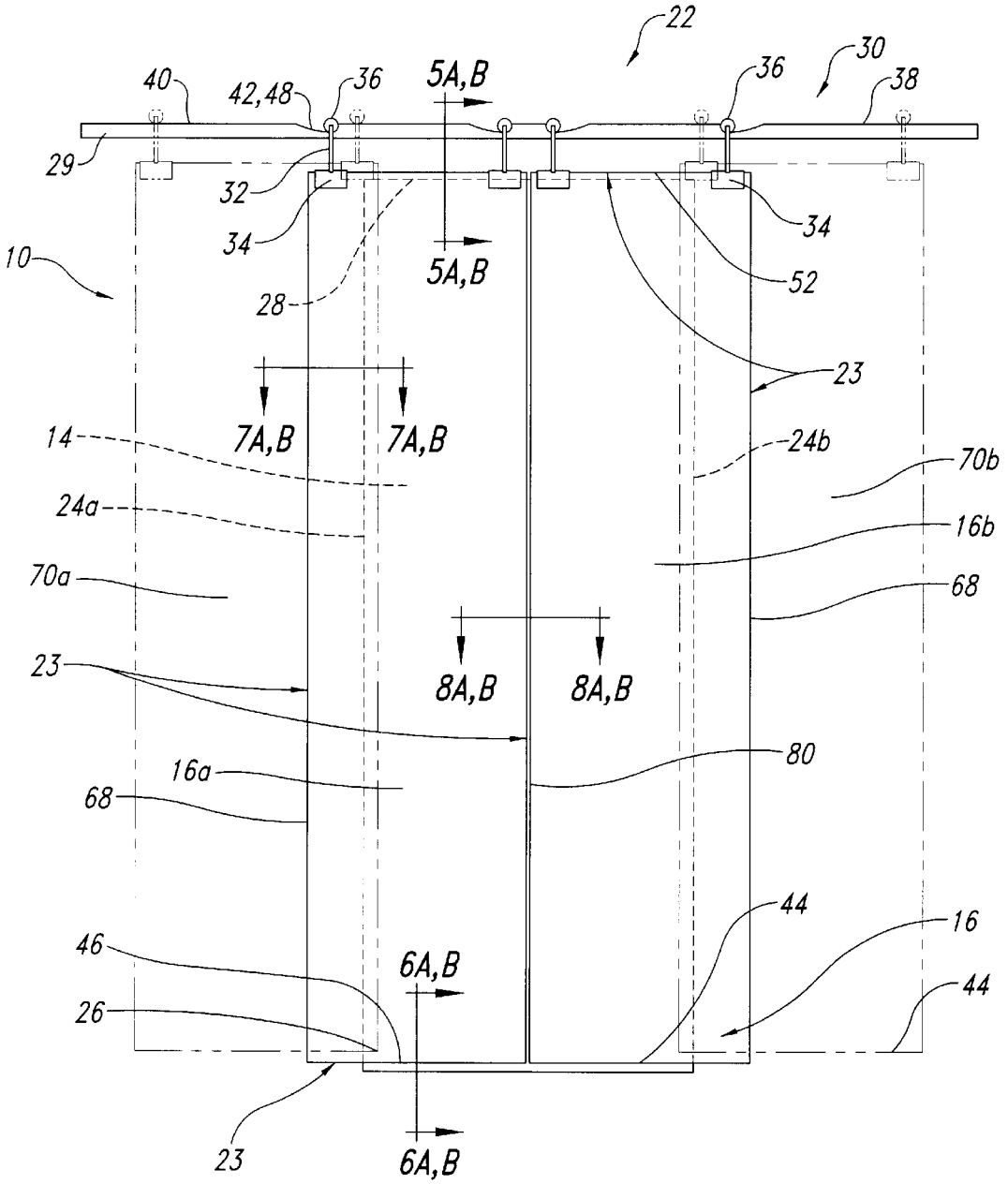
FIG. 2 is an enlarged side elevation view of the elevator hoistway door seal structure of FIG. 1 with an opposing hoistway door arrangement shown supported from a support member with lowered portions, the hoistway doors being shown in phantom lines in a position prior to closing and shown in solid lines in a closed position.

As best seen in FIG. 2, the hoistway entrance 14 in the wall structure 10 is a rectangular opening defined by a left lateral jamb 24*a*, a right lateral jamb 24*b*, a bottom sill 26, and a head 28 opposite the sill. The hoistway door seal structure 22 adjacent to the hoistway entrance 14 includes the hoistway door assembly 16 that moves laterally relative to the hoistway entrance 14 between an open position, shown in phantom lines, permitting access to the elevator hoistway, and a closed position, shown in solid lines. In the closed position, the hoistway door assembly 16 substantially covers the hoistway entrance 14.

In the illustrated embodiment, the hoistway door assembly 16 includes a pair of opposing doors 16*a* and 16*b* that are laterally movable relative to the hoistway entrance 14. The pair of opposing doors 16*a* and 16*b* are interconnected in a conventional manner, such that the lateral movement of each of the hoistway doors between the open and closed positions is synchronized. Although the illustrated embodiment includes a pair of opposing doors 16*a* and 16*b*, the door assembly 16 can have other configurations, such as a single door configuration, or a configuration having a multiple pair of opposing doors, as discussed below.

The pair of hoistway doors 16*a* and 16*b* are movably supported outwardly adjacent to the hoistway entrance 14 by an elongated door support member 29 that is secured to a headwall 30 above the head 28. The door support member 29 is securely mounted in a generally horizontal position above the hoistway entrance 14. Each of the hoistway doors 16*a* and 16*b* is movably attached to the door support member 29 by a pair of door supports 32 that move laterally along the door support member when the hoistway doors move between the open and closed positions. Each door support 32 includes a door support truck 34 secured to the top of the respective hoistway door 16*a* and 16*b*, and a support roller 36 rotatably attached to the top portion of the door support truck 34. The support roller 36 movably engages a roller support surface 38 on the top of the door support member 29 so as to permit the lateral movement of the hoistway doors 16*a* and 16*b* between an open and closed position.

The hoistway door seal structure 22 also includes a plurality of seals 23 positioned between the hoistway doors 16*a* and 16*b* and the wall structure 10 around the hoistway entrance 14. The seals 23 fill and seal spaces between the hoistway doors and the wall structure when the hoistway doors are in the closed position. Accordingly, the seals 23 restrict the passage of gas and smoke through the spaces in the event of a fire. The formation of these seals 23 is facilitated by the door support member 29, which is constructed to move the hoistway doors 16*a* and 16*b* laterally from the open position shown in phantom lines toward the closed positions shown in solid lines, and as the hoistway doors approach the closed position, the door support member simultaneously moves the hoistway doors in a second direction, such as vertically downward into sealable engagement with the seals. A conventional interlock mechanism is coupled to the hoistway doors so as to engage a conventional elevator cab door of the elevator cab 18, FIG. 1, thereby simultaneously moving the hoistway doors and the elevator cab door to the open or closed positions to allow ingress or egress from the elevator cab.

Figure 3:
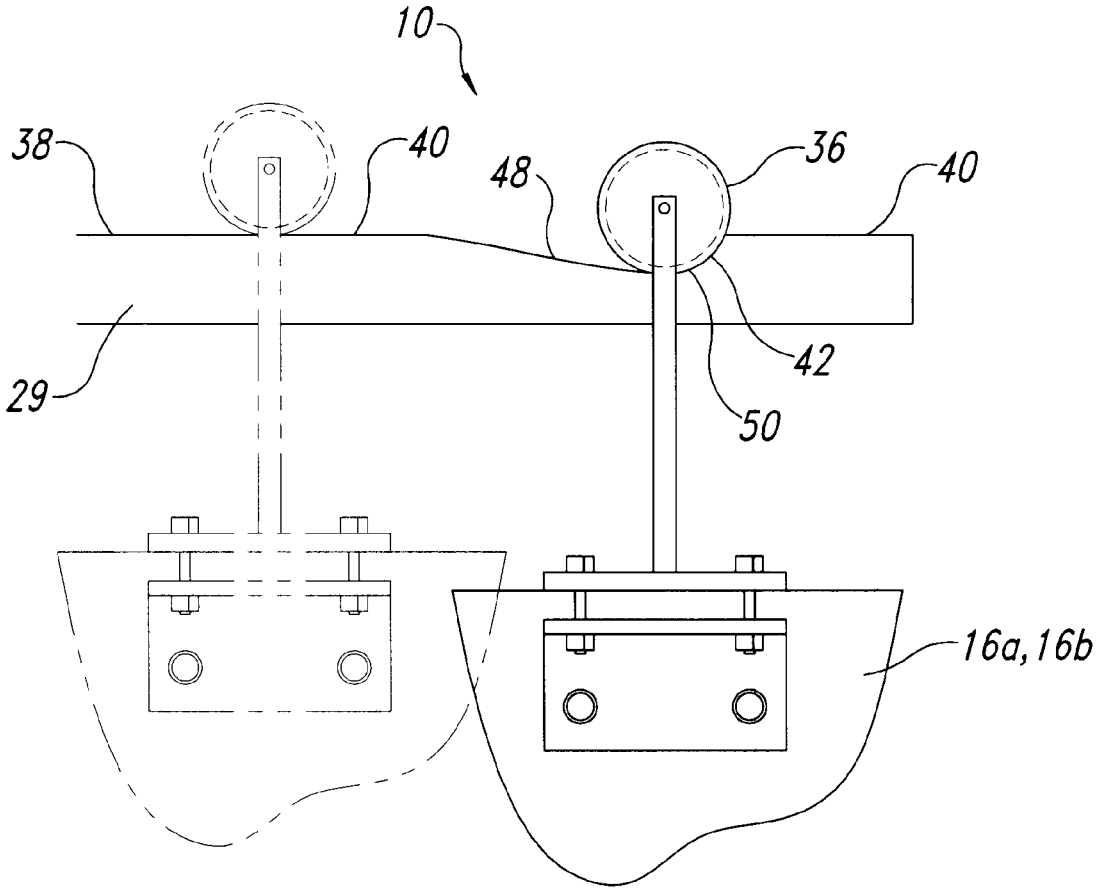
FIG. 3 is an enlarged fragmentary elevation view of a door support truck and support roller of the hoistway door of FIG. 2 with the door support truck and support roller shown in phantom lines in a raised position with the hoistway door in a position prior to closing and shown in solid lines in a lowered position with the hoistway door in a closed position.

As best seen in FIG. 3, the door support member 29 is a substantially horizontal rail with the uppermost edge of the rail forming the roller support surface 38. The door support member 29 includes a plurality of horizontal upper portions 40 and a plurality of lowered portions 42 adjacent to at least one of the upper portions. Each of the lower portions 42 is positioned with the lowered portion providing a recessed area within the support member 29 that is shaped to receive one of the support rollers 36 when the hoistway doors 16*a* and 16*b* move to the closed position, as shown in solid lines in FIG. 2. Accordingly, the support rollers 36 travel along the horizontal upper portions 40 of the door support member 29 when the hoistway doors are moving to or from the closed position such that the hoistway doors 16*a* and 16*b* are in a raised position, as shown in phantom lines in FIG. 2. In the raised position as best seen in FIG. 2, a bottom edge 44 of each hoistway door 16*a* and 16*b* is positioned above the sill 26 with a sill space 46 therebetween.

As the hoistway doors 16*a* and 16*b* move laterally from the open and raised positions to the closed and lowered positions, the support rollers 36 move from the horizontal upper portions 40 downwardly into their respective lowered portions 42, thereby causing the hoistway doors to simultaneously move downwardly to a lowered position. In the lowered position the bottom edge 44 of each hoistway door 16*a* and 16*b* is immediately adjacent to the sill 26. As discussed in greater detail below, when the door panels 16*a* and 16*b* move to the closed and lowered position, seals are formed around the hoistway entrance 14 so as to block the flow of smoke and gas between the doors 16*a* and 16*b* and the wall structure 10.

As best seen in FIG. 3, the lowered portion 42 in the door support 29 has a sloped portion 48 that slopes downwardly from the adjacent horizontal upper portion 40, and the sloped portion connects to a curved seat portion 50. Each seat portion 50 has a radius that is slightly greater than the radius of the support roller 36, such that the respective support roller will travel downwardly along the sloped portion 48 and sit within the seat portion when the respective hoistway door is in the closed position. Accordingly, the seat portions 50 facilitate in retaining the hoistway doors 16*a* and 16*b* in the closed position. The sloped portions 48 provides a gradual transition for the support rollers 36 as the hoistway doors 16*a* and 16*b* move between the closed and lowered position and the open and raised position.

Accordingly, the support rollers 36 travel along the horizontal upper portions 40 of the door support member 29 as the left and right hoistway doors 16*a* and 16*b*, FIG. 2, are moved laterally from the open position toward the closed position. When the hoistway doors 16*a* and 16*b* approach the closed position, each of the support rollers 36 move downwardly into a respective one of the lowered portions 42 and the hoistway doors are moved vertically downward toward the sill 26. When the left and right hoistway doors 16*a* and 16*b* move away from the closed position, the support rollers 36 move from the lowered portions 42 upwardly along the sloped portions 48 toward the horizontal upper section 40. Accordingly, the hoistway doors 16*a* and 16*b* are lifted from the lowered position to the raised position. Thereafter, the hoistway doors 16*a* and 16*b* move horizontally to the fully open position, and the necessary force exerted on the hoistway doors is required to overcome only the minimal amount of frictional resistance between the support rollers 36 and the roller support surface 38.

Figure 4:
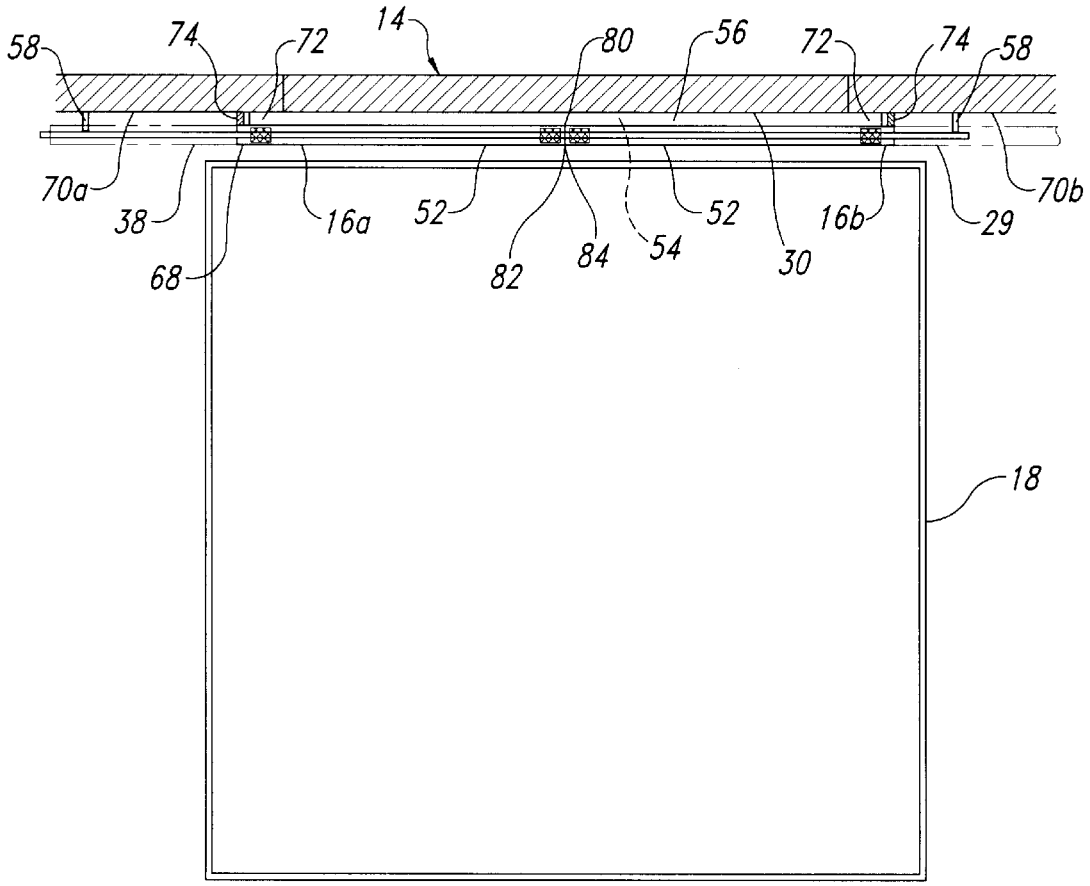
FIG. 4 is an enlarged plan view of the elevator hoistway entrance of FIG. 1 substantially covered with opposing hoistway doors that are movably supported by a support member, the hoistway doors being shown in phantom lines in a position prior to closing and shown in solid lines in a closed position and movably supported by a support member.

The hoistway doors 16*a* and 16*b* move together in a synchronized manner between an open and raised position, shown in phantom lines in FIG. 4 that permits access to the elevator cab 18, and a closed and lowered position, shown in solid lines, where the hoistway doors substantially cover the hoistway entrance 14.

As best seen in FIG. 4, the door support member 29 is connected to the headwall 30 with brackets 58, and the roller support surface 38 is positioned outwardly away from the headwall. Each of the hoistway doors 16*a* and 16*b* has a transverse edge portion 52 along the top of the door that is outwardly adjacent to the headwall 30, thereby providing a transverse space 54 between the transverse edge portion and the headwall. An elongated transverse seal structure 56 is positioned between the transverse edge portion 52 and the headwall 30 above the hoistway entrance 14. When the hoistway doors 16*a* and 16*b* are in the closed and lowered position, as shown in solid lines, the transverse seal structure 56 substantially fills the transverse space 54, for example, to block the passage of gas or smoke therethrough in the event of a fire or the like.

Figure 5A:
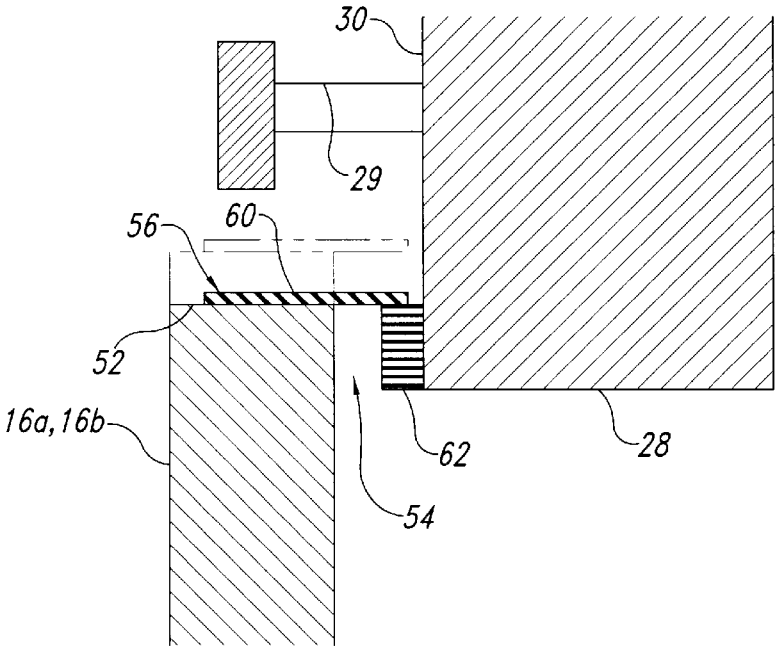
FIG. 5*a* is an enlarged cross-sectional view taken substantially along line 5*a,b*—5*a,b* of FIG. 2 with the door supports not being shown for clarity, and with a transverse seal structure shown in phantom lines in a raised, unsealed position prior to closing and shown in solid lines in a lowered, sealed position.

As best seen in FIG. 5*a*, the transverse seal structure 56 has an elongated transverse extension 60 and an elongated transverse seal 62, wherein the elongated transverse extension is securely fastened to the transverse edge 52 of each hoistway door 16*a* and 16*b* such that the transverse extension 60 extends along the transverse edge portion of the door. The transverse seal 62 is secured to the headwall 30 near the head 28 below the transverse extension 60 such that the transverse seal 62 extends along the length of the hoistway doors 16*a* and 16*b* when in the closed and lowered position. The transverse extension 60 extends away from its respective hoistway door 16*a* or 16*b* into the transverse space 54 toward the headwall 30, and provides a horizontal blade-like structure along the top edge of the hoistway doors. The transverse seal 62 projects outwardly away from the headwall 30 toward the hoistway doors 16*a* and 16*b* in such a position wherein the transverse extension 60 is in an overlapping relationship with the transverse seal.

The transverse extension 60 is above and out of engagement with the transverse seal 62 when the respective hoistway doors 16*a* and 16*b* are in the open and raised position, shown in phantom lines, thereby avoiding frictional resistance between the transverse extension and the transverse seal as the door is moving between the open and closed positions. When the hoistway doors 16*a* and 16*b* are moved to the closed and lowered position, shown in solid lines, the transverse extension 60 moves downwardly into sealable engagement with the transverse seal 62 so as to seal the transverse space 54, thereby blocking the flow of gas or smoke through the transverse space in the event a building fire or the like.

In the preferred embodiment, the transverse extension 60 is a substantially rigid, blade-like member. The elongated transverse seal 62 is a shaped, resilient temperature resistive structure that is slightly compressed by the transverse extension 60 when the hoistway doors 16*a* and 16*b* are moved to the closed and lowered position. The shaped, resilient temperature resistive structure is adapted to maintain its structural integrity in elevated temperatures, such as the temperature experienced in a building fire. Accordingly, a seal is maintained between the hoistway doors 16*a* and 16*b* and the headwall 30 during a fire or the like.

Figure 5B:
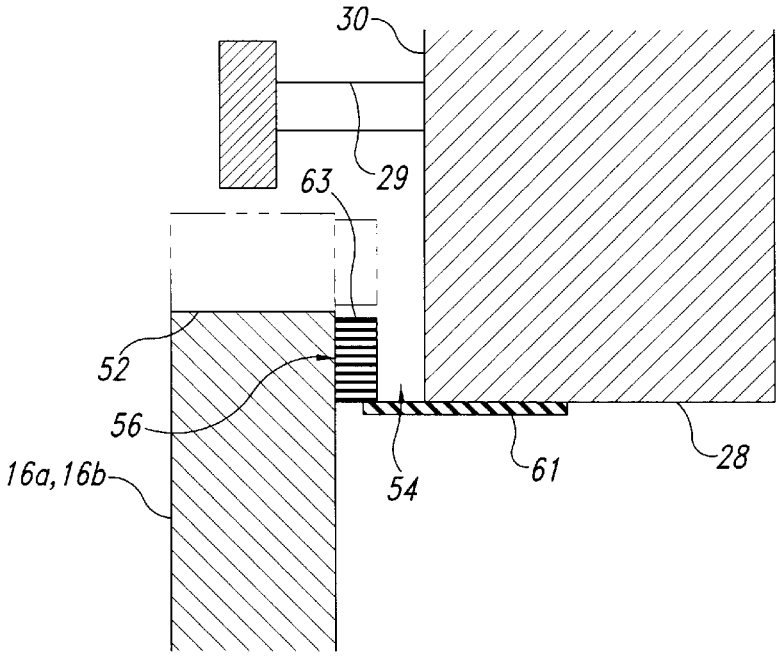
FIG. 5*b* is an enlarged cross-sectional view taken substantially along line 5*a,b*—5*a,b* of FIG. 2 with the door supports not being shown for clarity, and with an alternate embodiment of a transverse seal structure shown in phantom lines in a raised, unsealed position prior to closing and shown in solid lines in a lowered, sealed position.

As best seen in FIG. 5*b*, an alternate embodiment of the transverse seal structure 56 has an elongated transverse extension 61 securely mounted to the head 28 along the head's length. The transverse extension 61 extends away from the headwall 30 toward the hoistway doors 16*a* and 16*b* and into the transverse space 54. An elongated transverse seal 63 is securely attached along the length of the top of each of the hoistway doors 16*a* and 16*b* adjacent to the transverse edge portion 52, and the transverse seal extends away from the hoistway door toward the headwall 30. The transverse seals 63 are positioned above the transverse extension 61 in an overlapping relationship. Accordingly, when the hoistway doors 16*a* and 16*b* are moved from the open and raised position, shown in phantom lines, to the closed and lowered position, shown in solid lines, the transverse seal 63 moves downwardly into sealable engagement with the transverse extension 61 and seals the transverse space 54.

Figure 6A:
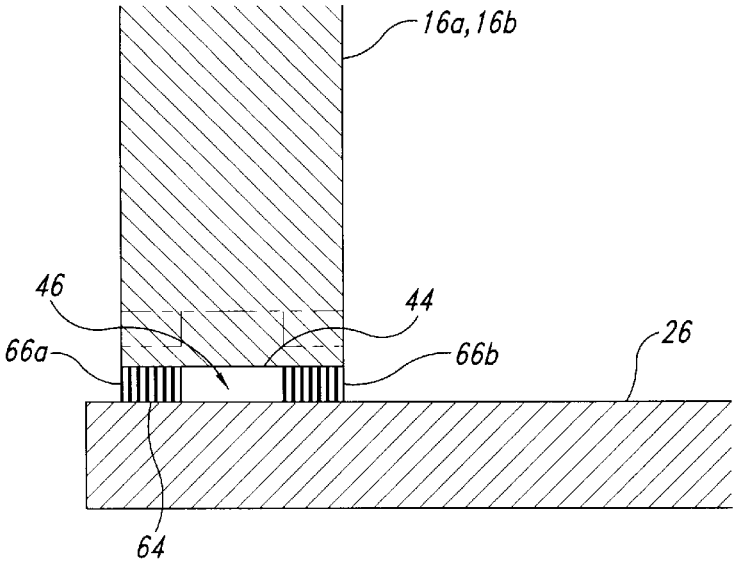
FIG. 6*a* is an enlarged cross-sectional view taken substantially along line 6*a,b*—6*a,b* of FIG. 2 with a sill seal structure shown in phantom lines in a raised, unsealed position prior to closing and shown in solid lines in a lowered, sealed position.

Referring to FIG. 2, the bottom edge 44 of each hoistway door 16*a* and 16*b* is positioned above the sill 26 at a selected distance that defines a sill space 46 between the hoistway doors and the sill. As best seen in FIG. 6*a*, a bottom door seal structure 64 of the seals 23 is securely attached to the bottom edge 44 of each hoistway door 16*a* and 16*b*. The bottom door seal structure 64 includes elongated inner and outer bottom door seals 66*a* and 66*b* spaced apart on the bottom edge 44 of each hoistway door 16*a* and 16*b* such that the bottom door seals extend the length of the respective door.

The bottom door seals 66*a* and 66*b* extend downwardly toward the sill 26. When the hoistway doors 16*a* and 16*b* are in the open and raised position, shown in phantom lines, the bottom door seals 66*a* and 66*b* are above and out of engagement with the sill 26 so as to minimize frictional resistance to lateral motion of the hoistway doors. When the hoistway doors 16*a* and 16*b* are moved to the closed and lowered position, as discussed above, the bottom door seals 66*a* and 66*b* are lowered into sealable engagement with the sill 26 and seal the sill space 46. In the preferred embodiment, the bottom door seals 66*a* and 66*b* are a shaped, resilient temperature resistive material that are slightly compressed against the sill 26 when the hoistway doors 16*a* and 16*b* are moved to the closed and lowered position.

Figure 6B:
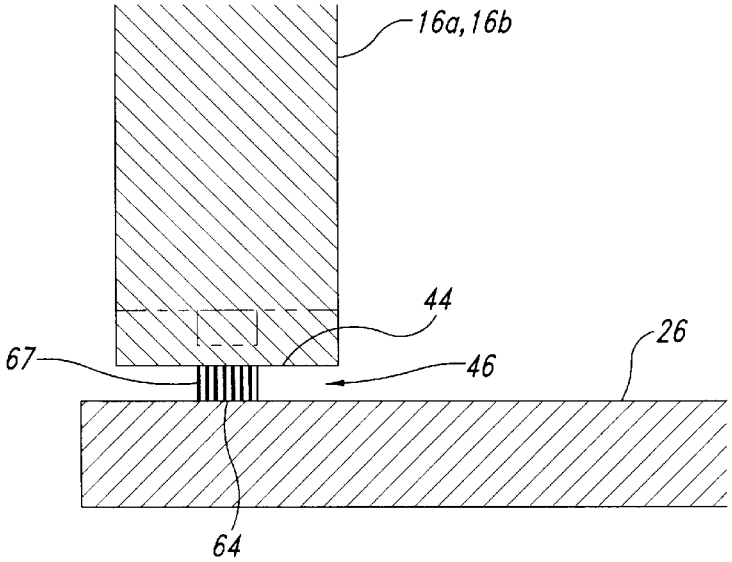
FIG. 6*b* is an enlarged cross-sectional view taken substantially along the line 6*a,b*—6*a,b* of FIG. 2 showing in phantom lines an alternate embodiment of the sill seal structure in a raised, unsealed position prior to closing and shown in solid lines in a lowered, sealed position.

An alternate embodiment of the bottom door seal structure 64 is illustrated in FIG. 6*b* wherein a single bottom door seal 67 is securely attached to the bottom edge 44 of each of the hoistway doors 16*a* and 16*b*. The single bottom door seal 67 extends along the bottom edge 44 of the respective hoistway door and extends downwardly from the bottom edge 44 of the respective door. The bottom door seal 67 sealably engages the sill 26 when the hoistway doors 16*a* and 16*b* are moved to the closed and lowered position, shown in solid lines, thereby sealing the sill space 46.

As best seen in FIGS. 2 and 4, each of the hoistway doors 16*a* and 16*b* has a trailing edge portion 68 that is positioned outwardly adjacent to a respective left and right jambwall 70*a* and 70*b*. As best seen in FIG. 4, each of the hoistway doors 16*a* and 16*b* is positioned such that a trailing edge lateral space 72 is located between the trailing edge portion 68 of the respective hoistway door 16*a* and 16*b* and the respective left and right jambwall 70*a* and 70*b*. A trailing edge seal structure 74 of the seals 23 is positioned between the trailing edge portion 68 of each hoistway door 16*a* and 16*b* and the jambwalls 70*a* and 70*b* to seal the trailing edge lateral spaces 72 when the hoistway doors are in the closed position.

Figure 7A:
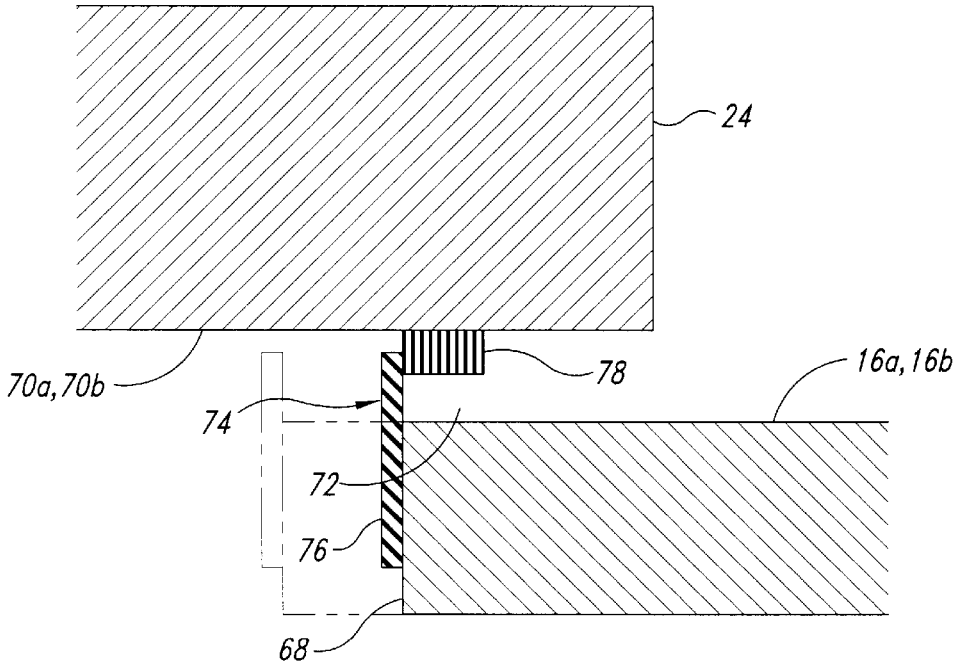
FIG. 7*a* is an enlarged cross-sectional view taken substantially along the line 7*a,b*—7*a,b* of FIG. 2 with a trailing edge seal structure shown in phantom lines in an unsealed position prior to closing and shown in solid lines in a sealed position.

As best seen in FIG. 7*a*, the trailing edge seal structure 74 includes an elongated lateral extension 76 secured to the trailing edge portion 68 of each of the hoistway doors 16*a* and 16*b*. The lateral extension 76 extends along the trailing edge portion 68 of the respective door 16*a* and 16*b*. The lateral extension 76 also extends toward the respective jambwall 70*a* and 70*b* and into the trailing edge lateral spaces 72. An elongated trailing edge lateral seal 78 is connected to each of the left and right jambwalls 70*a* and 70*b* near the lateral jamb 24. The trailing edge lateral seal 78 extends into the trailing edge space 72 in an overlapping relationship with the associated lateral extension 76.

When the hoistway doors 16*a* and 16*b* are moved to and from the open position, the lateral extension 76 does not engage the respective jambwalls 70*a* and 70*b*, thereby minimizing frictional resistance to lateral movement of the hoistway doors. When the hoistway doors 16*a* and 16*b* are moved to the closed position, each of the lateral extensions 76 is pressed against and sealably engages the trailing edge lateral seal 78 to seal the trailing edge space 72 along the height of the hoistway doors. In the preferred embodiment, each of the elongated lateral extensions 76 is a substantially rigid, blade-like member, and each of the trailing edge lateral seals 78 is a shaped, resilient temperature resistive material that is slightly compressed by the lateral extension when the hoistway doors 16*a* and 16*b* are moved to the closed position.

Figure 7B:
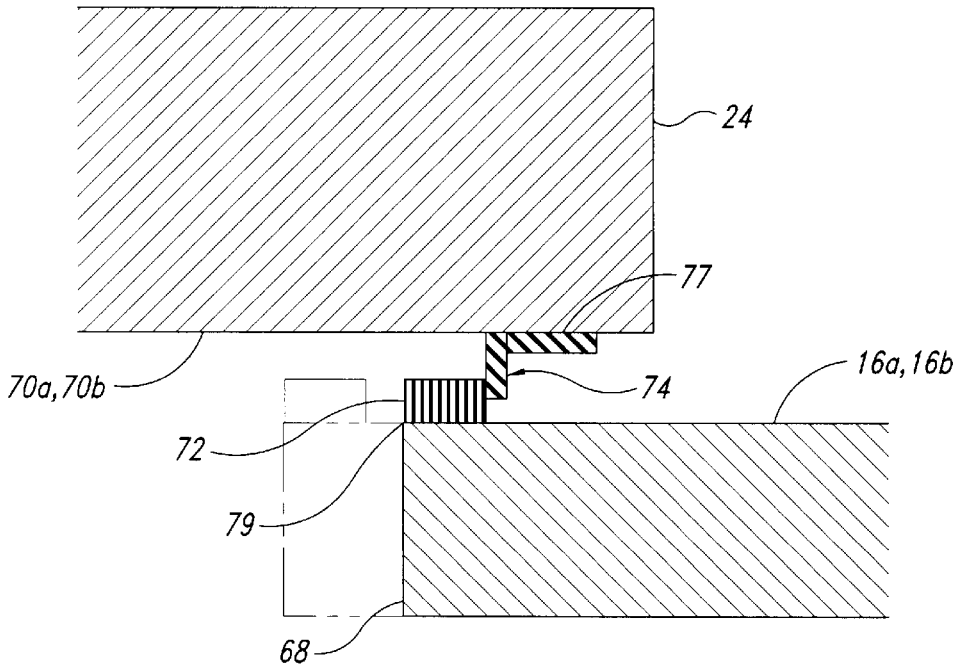
FIG. 7*b* is an enlarged cross-sectional view taken substantially along the line 7*a,b*—7*a,b* of FIG. 2 showing in phantom lines an alternate embodiment of the trailing edge seal structure in an unsealed position prior to closing and shown in solid lines in a sealed position.

In an alternate embodiment, illustrated in FIG. 7*b*, the trailing edge seal structure 74 includes an elongated lateral extension 77 that is secured to each of the left and right jambwalls 70*a* and 70*b* near the jamb 24. The lateral extensions 77 project outwardly from the jambs toward the respective hoistway doors 16*a* and 16*b*. Each of the lateral extensions 77 is an L-shaped bracket with one leg parallel to the respective jambwall 70*a* and 70*b*, and a second leg perpendicular to the jambwall and extending into the trailing edge space 72. An elongated trailing edge lateral seal 79 is securely attached to the hoistway doors 16*a* and 16*b* adjacent to the trailing edge portion 68. The trailing edge lateral seal extends into the trailing edge space 72 toward the jambwalls 70*a* and 70*b*. The trailing edge lateral seal 79 is positioned in an overlapping relationship with the second leg of the associated lateral extension 77.

When the hoistway doors 16*a* and 16*b* are moved to and from the open position, the trailing edge lateral seal 79 is not in engagement with the lateral extension 77 so as to minimize resistance to lateral movement of the hoistway doors. When the hoistway doors 16*a* and 16*b* are moved to the closed position, the trailing edge lateral seal 79 presses against the second leg of the lateral extension 77 and seals the trailing edge space 72, for example, to limit smoke and gas flow therethrough in the event of a fire or the like. Although the lateral extension 77 of the alternate embodiment is illustrated as an L-shaped member, the lateral extension could be a blade structure or other structure against which the trailing edge lateral seal 79 can sealably press to seal the trailing edge space 72.

As best seen in FIG. 2, each of the hoistway doors 16*a* and 16*b* has a meeting edge 80 that extends between the transverse edge 52 and the bottom edge 44 of the respective hoistway door. As best seen in FIG. 4, the hoistway doors 16*a* and 16*b* are configured such that a meeting edge space 82 is provided between the meeting edges 80 of the doors when the hoistway doors 16*a* and 16*b* are in the closed position. A meeting edge seal structure 84 is provided between the meeting edges 80 of the hoistway doors 16*a* and 16*b* to seal the meeting edge space 82 when the hoistway doors are in the closed position.

Figure 8A:
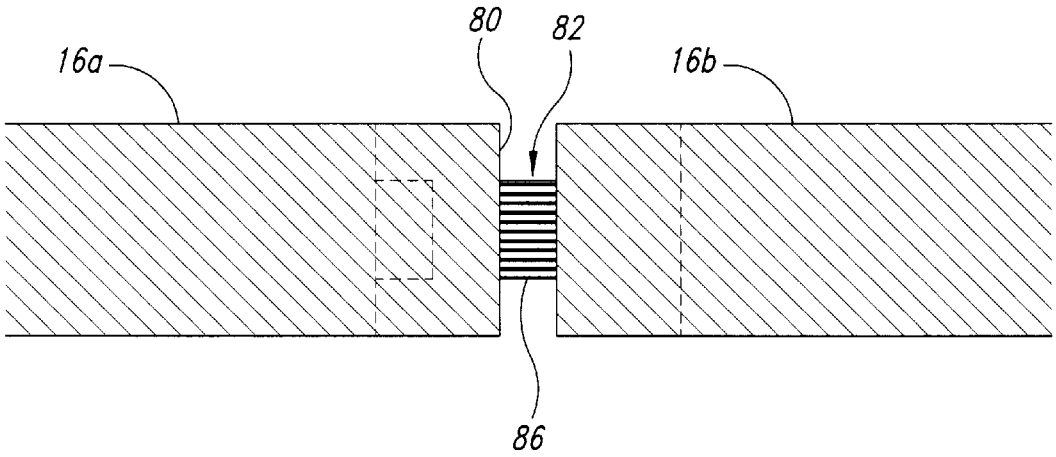
FIG. 8*a* is an enlarged cross-sectional view taken substantially along line 8*a,b*—8*a,b* of FIG. 2 showing a meeting edge seal structure of the opposing hoistway doors, the meeting edge seal structure being shown in phantom lines in an unsealed position prior to closing and shown in solid lines in a closed, sealed position.

As best seen in FIG. 8*a*, an elongated meeting edge seal 86 is securely attached to the meeting edge 80 of the left hoistway door 16*a* and extends along the length of the meeting edge. The meeting edge seal 86 extends away from the left hoistway door's meeting edge 80 toward the meeting edge of the right hoistway door 16*b*. When the hoistway doors 16*a* and 16*b* are in the closed position, shown in solid lines, the meeting edge seal 86 is pressed into sealable engagement with the meeting edge 80 of the right hoistway door 16*b*, thereby sealing the meeting edge space 82. In the preferred embodiment, the meeting edge seal 86 is a shaped resilient temperature resistive material that is slightly compressed when the hoistway doors 16*a* and 16*b* are moved to the closed position.

Figure 8B:
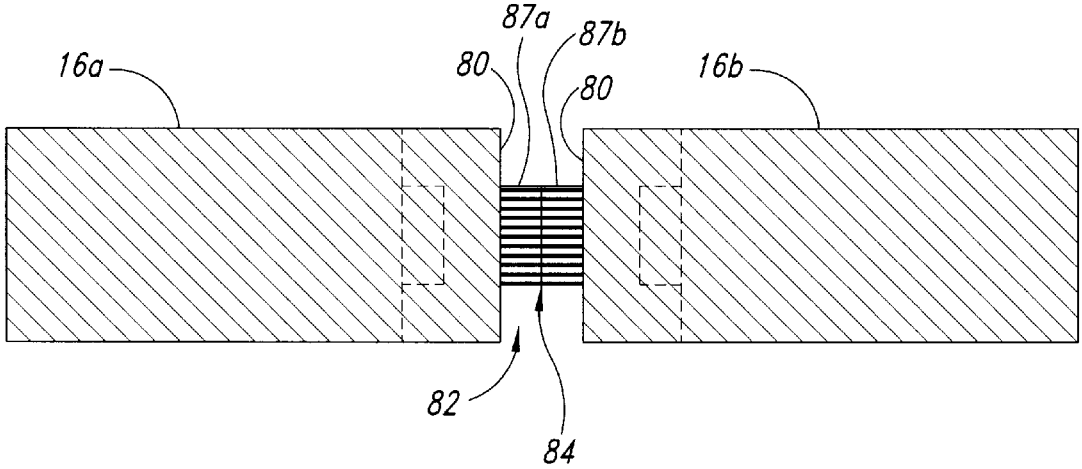
FIG. 8*b* is an enlarged cross-sectional view taken substantially along line 8*a,b*—8*a,b* of FIG. 2 showing in phantom lines an alternate embodiment of the meeting edge seal structure in an unsealed position prior to closing and shown in solid lines in a closed, sealed position.

In an alternate embodiment illustrated in FIG. 8*b*, the meeting edge seal structure 84 includes an elongated meeting edge seal 87*a* securely attached to the meeting edge 80 of the left hoistway door 16*a*, and a similar elongated meeting edge seal 87*b* securely attached to the length of the meeting edge 80 of the right hoistway door 16*b* opposite the left meeting edge seal 87*a*. The left and right meeting edge seals 87*a* and 87*b* extend away from their respective meeting edges 80 and toward each other such that when the hoistway doors 16*a* and 16*b* are in the closed position, shown in solid lines, the meeting edge seals press against and sealably engage each other. The sealably engaged meeting edge seals 87*a* and 87*b* extend across the meeting edge space 82 and form a seal therein. In the illustrated embodiment, each of the left and right meeting edge seals 87*a* and 87*b* are constructed of a shaped resilient temperature resistive material that is positioned substantially along the meeting edges 80 of the respective hoistway doors 16*a* and 16*b*. Accordingly, the meeting edge seals 87*a* and 87*b* press against each other and slightly compress in order to form an effective seal therebetween, for example, to block the flow of gas and smoke through the meeting edge space in the event of a fire.

Therefore, when the hoistway doors 16*a* and 16*b* illustrated in FIG. 2 are moved from the open and raised position to the closed and lowered position, the hoistway doors move laterally and downwardly just as the doors reach the closed position. When the hoistway doors 16*a* and 16*b* are in the closed position, seals are formed around the hoistway entrance 14 between the hoistway door assembly 16 and the wall structure 10 and between the meeting edges 80 of the hoistway doors 16*a* and 16*b*. Thus, all of the spaces around and between the hoistway doors 16*a* and 16*b* are effectively sealed off with the seals 23 when the doors are in the closed and lowered position, for example, to limit the flow of gas or smoke between the doors and the hoistway entrance in the event of a fire, thereby minimizing migration of smoke through a building.

Although the embodiments described herein are described in terms of the seals 23 around and between the hoistway doors blocking the flow of smoke and gas in the event of a fire, the seals also block the flow of air or other gas between the hoistway door and the wall structure during normal operation or maintenance of the hoistway.

Figure 9:
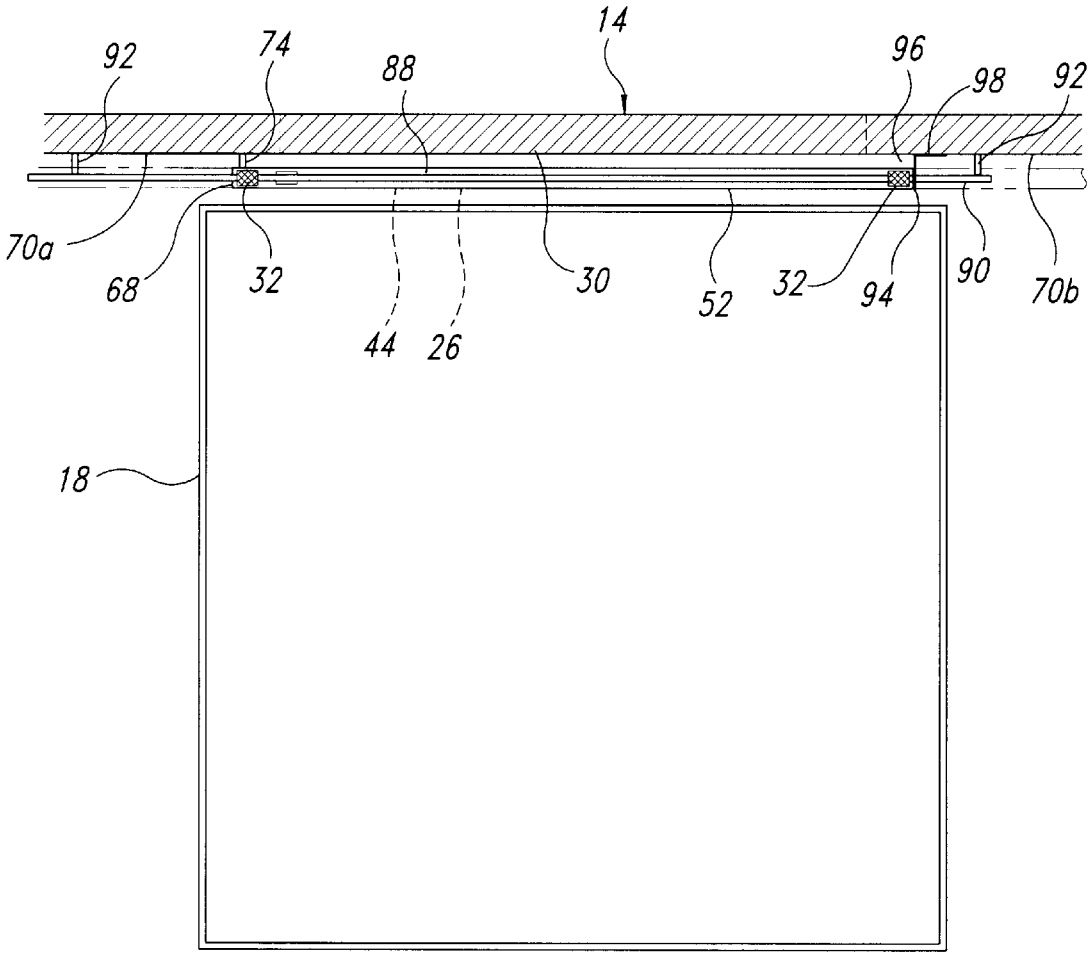
FIG. 9 is an enlarged plan view of a hoistway entrance of FIG. 1 substantially covered with a single hoistway door arrangement that is movably supported by a support member, the hoistway door being shown in phantom lines in a position prior to closing and shown in solid lines in a closed position.

In an alternate embodiment of the present invention, as illustrated in FIG. 9, a single hoistway door 88 is movably supported on an elongated support member 90 by a pair of door supports 32 in the manner discussed above. The single hoistway door 88 moves between an open position, shown in phantom, that permits access to the elevator cab 18, and a closed position, shown in solid lines, wherein the hoistway door substantially covers the hoistway entrance 14. The door support member 90 is rigidly secured to the headwall 30 with brackets 92 in a generally horizontal orientation above the hoistway entrance 14. The door support member 90 is configured to move the hoistway doors downwardly relative to the hoistway entrance 14 as described above and illustrated in FIG. 3. Seals are formed between the transverse edge portion 52 of the door and the headwall 30 and between the bottom edge 44 of the door and the sill 26, as discussed above. Similarly, seals are formed between the trailing edge portion 68 of the hoistway door and the left jambwall 70*a* similar to the tailing edge seal structure 74 discussed above.

The single hoistway door 88 includes a leading edge portion 94 that is positioned outwardly away from the right jambwall 70*b* to define a leading edge lateral space 96 between the hoistway door and the jambwall. A leading edge seal structure 98 is mounted to the right jambwall 70*b* and positioned such that the leading edge portion 94 of the hoistway door 88 moves into sealable engagement therewith when the hoistway door is in the closed position, thereby sealing the leading edge lateral space 96.

Figure 10A:
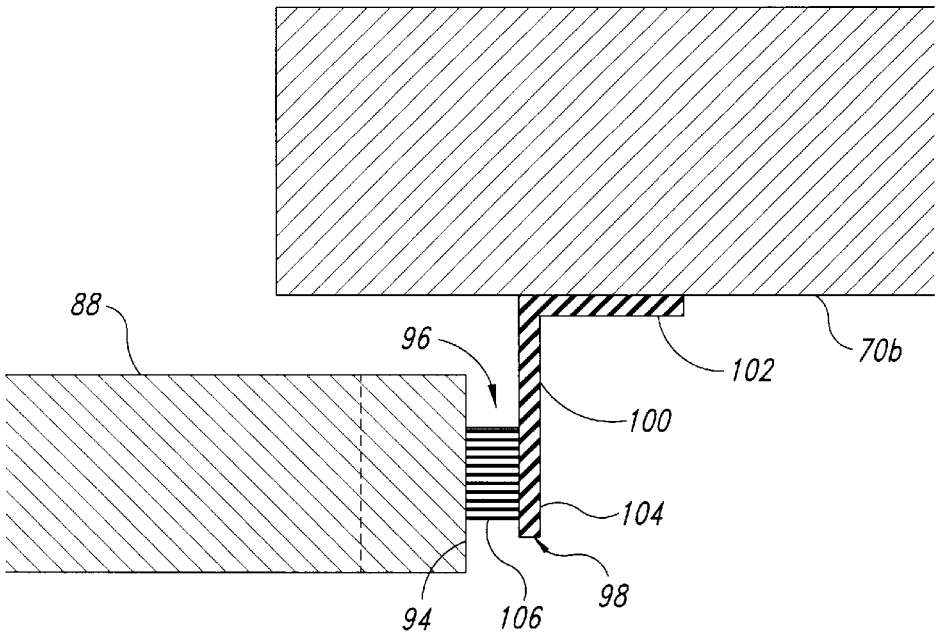
FIG. 10*a* is an enlarged cross-sectional view of the leading edge seal structure of the hoistway door of FIG. 9 shown in phantom lines in an unsealed position prior to closing and shown in solid lines in a closed, sealed position.

As best seen in FIG. 10*a*, the leading edge seal structure 98 has an elongated leading, edge lateral extension 100 that has an L-shaped cross-section with an attachment leg 102 of the extension securely fastened to the right jambwall 70*b*. An engagement leg 104 of the leading edge lateral extension 100 extends perpendicularly away from the right jambwall 70*b* and substantially parallel to the leading edge portion 94 of the single hoistway door 88. An elongated leading edge lateral seal 106 is securely attached to the engagement leg 104 along the length of the lateral extension 100. The leading edge lateral seal 106 extends toward the hoistway door 88 such that when the hoistway door is in the closed position, the leading edge portion 94 of the hoistway door sealably engages the leading edge lateral seal 106. Accordingly, the leading edge lateral seal 106 extends across the leading edge lateral space 96 and forms a seal therein between the lateral extension 100 and the single hoistway door 88.

In the preferred embodiment, the engagement leg 104 is a substantially rigid, blade-like member and the leading edge lateral seal 106 is a shaped, resilient temperature resistive material that is slightly compressed by the leading edge portion 94 of the hoistway door 88 when the hoistway door is in the closed position.

Figure 10B:
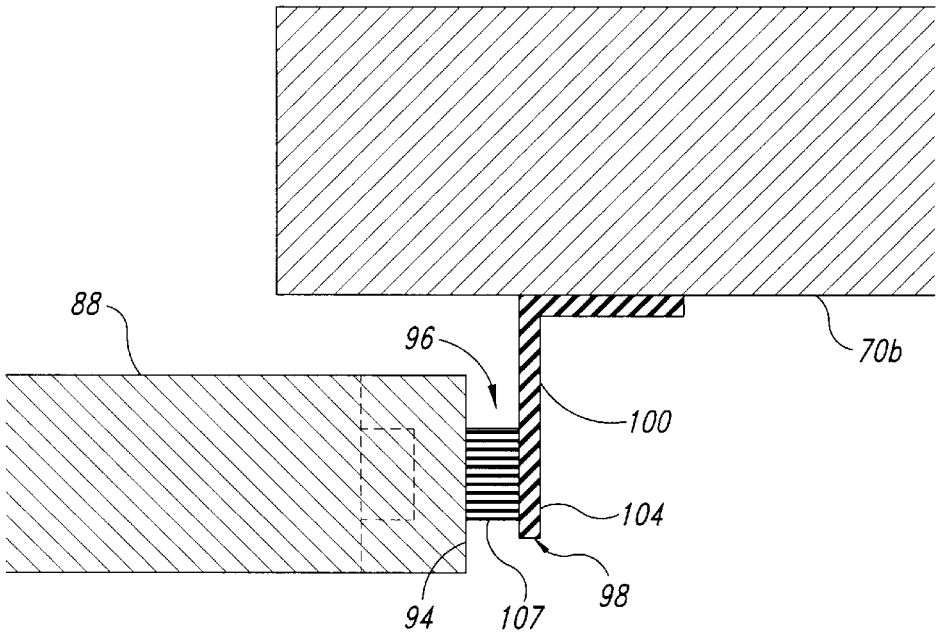
FIG. 10*b* is an enlarged cross-sectional view of an alternate embodiment of the leading edge seal structure of the hoistway door of FIG. 9 shown in phantom lines in an unsealed position prior to closing and shown in solid lines in a closed, sealed position.

In an alternate embodiment of the leading edge seal structure 98, illustrated in FIG. 10*b*, the leading edge lateral extension 100 is mounted to the right jambwall 70*b* as discussed above, and a leading edge lateral seal 107 is securely attached to the length of the leading edge portion 94 of the hoistway door 88. The leading edge lateral seal 107 extends away from the leading edge portion 94 toward the leading edge lateral extension 100. When the hoistway door 88 is in the closed position, the leading edge lateral seal 107 is pressed into sealable engagement with the engagement leg 104 of the leading edge lateral extension 100 and seals the leading edge lateral space 96.

Figure 11A:
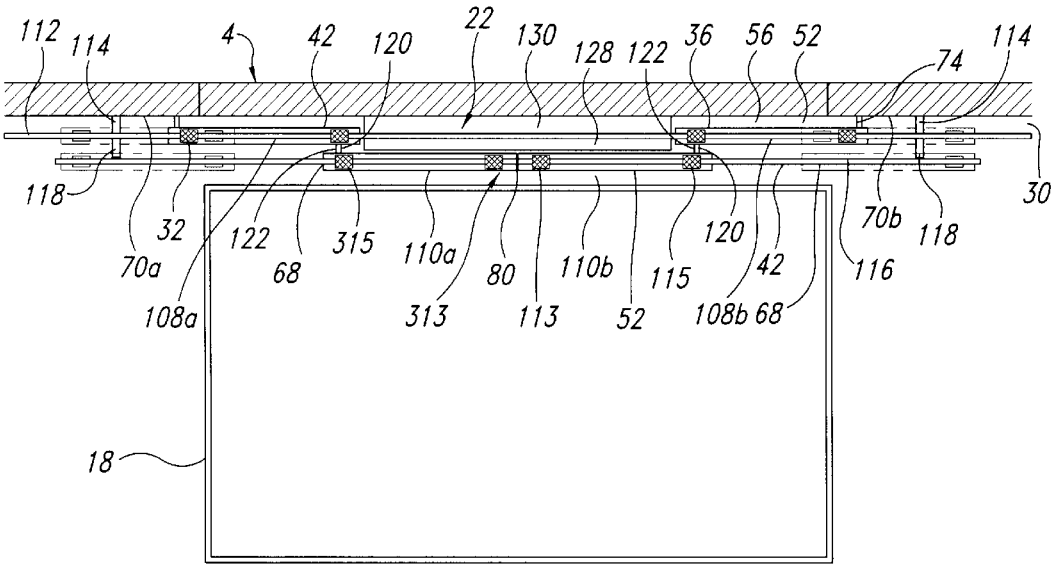
FIG. 11*a* is an enlarged plan view of the hoistway entrance of FIG. 1 substantially covered with a pair of opposing hoistway doors that are movably supported by a support member, the hoistway doors being shown in phantom lines in a position prior to closing and shown in solid lines in a closed position.

An alternate embodiment of the present invention is illustrated in FIG. 11*a* wherein the hoistway door seal structure 22 includes opposing left and right inner hoistway doors 108*a* and 108*b* and opposing left and right outer hoistway doors 110*a* and 110*b*. The inner and outer hoistway doors 108*a*, 108*b*, 110*a*, and 110*b* move together between an open position, shown in phantom lines that permits access to the elevator cab 18, and a closed position, shown in solid lines, wherein the inner and outer hoistway doors substantially cover the hoistway entrance 14.

The inner hoistway doors 108*a* and 108*b* are supported outwardly adjacent to the hoistway entrance 14 by an elongated inner door support member 112 that is rigidly secured to the headwall 30 with brackets 114 in a generally horizontal orientation above the hoistway entrance. The outer hoistway doors 110*a* and 110*b* are supported outwardly adjacent to the inner hoistway doors 108*a* and 108*b* by an elongated outer door support member 116 that is secured to the inner door support member 112 with brackets 118. The outer door support member 116 is secured in a generally horizontal orientation such that the inner door support member 112 is between the headwall 30 and the outer support member.

Each of the inner hoistway doors, 108*a* and 108*b* are movably supported on the inner door support member 112 by a pair of the door supports 32 discussed above. The inner door support member 112 has lowered portions 42 therein that are positioned to receive the support rollers 36 of the door supports 32 as the inner hoistway doors 108*a* and 108*b* are moved from the open and raised position and approach the closed position, thereby moving the inner hoistway doors laterally and downwardly relative to the hoistway entrance 14 to the closed and lowered position.

Each of the outer hoistway doors 110*a* and 110*b* are movably supported on the outer door support member 116 by a leading door support 313 and a trailing door support 315. The leading door support 313 is connected to the respective outer hoistway door 110*a* and 110*b* generally adjacent to the meeting edge 80, and the trailing door support 315 is connected to the respective outer hoistway door generally adjacent to the trailing edge portion 68. The leading door support 313 has a leading support roller 113 and the trailing door support 315 has a trailing support roller 115, each of which travels over the outer door support member 116 as the outer hoistway doors 110*a* and 110*b* move between the open and raised position and the closed and lowered position.

The outer door support member 116 also has lowered portions 42 therein that receive the leading and trailing support rollers 113 and 115 as the outer hoistway doors 110*a* and 110*b* approach the closed and lowered position. As can be seen in FIG. 11*a*, each of the outer hoistway doors 110*a* and 110*b* travel approximately half the length of the outer door support member 116 as it moves from the open position to the closed position. Accordingly, the leading support roller 113 travels over the lowered portions 42 for the trailing support roller 115 as the outer hoistway doors 110*a* and 110*b* move between the open and closed positions.

Figure 11B:
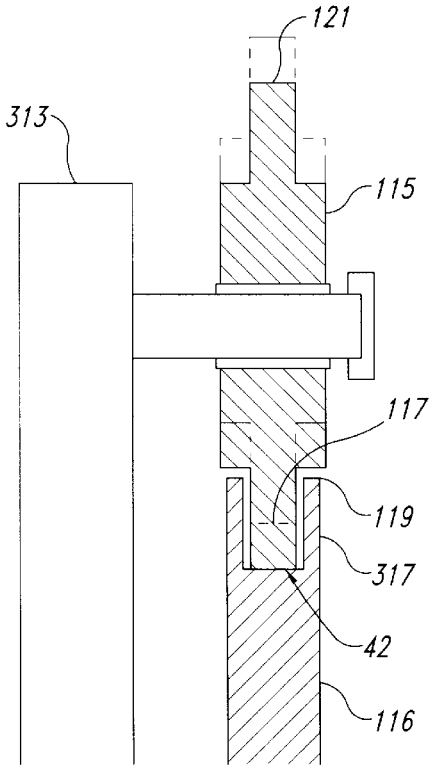
FIG. 11*b* is a enlarged cross-sectional view taken through the trailing support roller and outer support member of FIG. 11*a*.
Figure 11C:
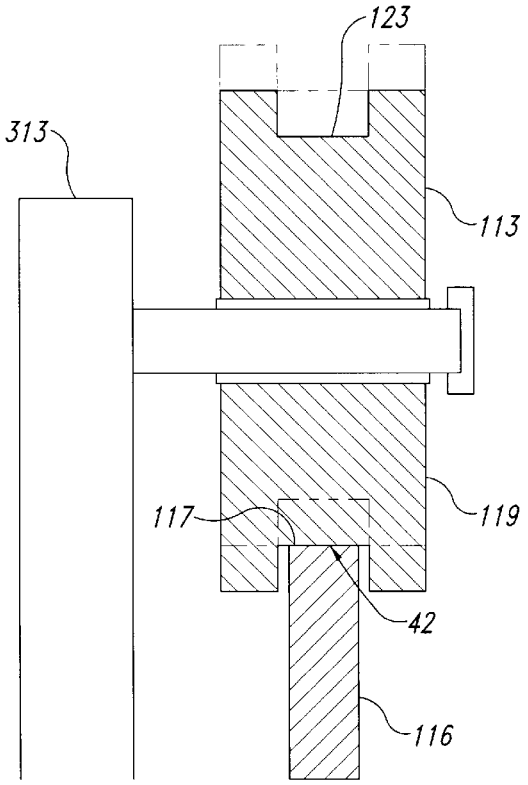
FIG. 11*c* is an enlarged cross-sectional view taken through the leading support roller and outer support member of FIG. 11*a*.

As best seen in FIGS. 11*b* and 11*c*, the outer door support member 116 and the leading support roller 113 are constructed such that the leading support roller will not move downwardly into the lowered portion 42 for the trailing support roller 115, while the trailing support roller is constructed to move downwardly into its lowered portion. The outer door support member 116 has a channel 117 within its upper portion along the length of the outer door support member. The sides of the channel 117 are defined by sidewalls 317 that terminate at their upper ends and provide an upper roller support surface 119. As best seen in FIG. 11*b*, the trailing support roller 115 has a narrowed, annular outer portion 121 that is movably positioned within the channel 117 in the outer door support member 116. The annular outer portion 121 travels in the channel 117 as the respective outer hoistway door 110*a* and 110*b* moves between the open and closed positions. The lower portion 42, shown in hidden lines, for the trailing support roller 115 extends downwardly from the channel 117 between the sidewalls 317 such that the trailing support roller's annular outer portion 121 follows the channel downwardly into the lowered portion as the respective outer hoistway door 110*a* and 110*b* approach the closed position.

As best seen in FIG. 11*c*, the leading support roller 113 has an annular channel 123 therein that receives the top portion of the outer door support member 116. The leading support roller 113 straddles the outer door support member 116 and travels along the upper roller support surface 119 above the channel 117 as the outer hoistway doors 110*a* and 110*b* move between the open and closed positions. Accordingly, the upper roller support surface 119 supports the leading support roller 113 above the trailing support roller's lowered portion 42 within the channel 117, so the leading support roller will not move downwardly into the trailing support roller's lowered portion. A lowered portion 42, shown in hidden lines, is positioned in the outer door support member 116 to receive the leading support roller 113 when the respective outer hoistway door 110*a* and 110*b* approaches the closed position. Therefore, the leading and trailing support rollers move into and out of their respective lowered portions 42 simultaneously and uniformly only when the outer hoistway doors are moving into or out of the closed position.

The inner hoistway doors 108*a* and 108*b* are coupled to the outer hoistway doors 110*a* and 110*b* in a conventional manner, such that lateral and vertical movement of the hoistway doors is synchronized to move between the open and closed positions. The conventional interlock mechanism maintains engagement between the elevator cab door and the hoistway door as the hoistway doors are moved to and from the closed and lowered position.

As best seen in FIG. 11*a*, seals are formed between the trailing edge 68 of the inner hoistway doors 108*a* and 108*b* and the respective jambwalls 70*a* and 70*b* similar to the trailing edge seal structures 74 discussed above. Likewise, seals are formed between the transverse edge portion 52 of the inner hoistway doors 108*a* and 108*b* and the headwall 30 similar to the transverse edge seal structure 56 discussed above. Likewise, seals are formed between the bottom edge 44 of the inner hoistway doors 108*a* and 108*b* and of the outer hoistway doors 110*a* and 110*b* and the sill 26 as discussed above and illustrated in FIGS. 6*a* and 6*b*. Likewise, seals are formed between the meeting edge portion 80 of the outer hoistway doors 110*a* and 110*b* as discussed above.

The left inner hoistway door 108*a* is positioned outwardly away from the left outer hoistway door 110*a* to define an interdoor lateral space 120 between the left inner hoistway door and the left outer hoistway door. The right inner hoistway door 108*b* is positioned outwardly away from the right outer hoistway door 110*b* to define an interdoor lateral space 120 between the right inner hoistway door and the right outer hoistway door. An interdoor seal structure 122 is attached to each pair of the inner and outer hoistway doors 108*a*/110*a* and 108*b*/110*b*, so as to seal the interdoor spaces 120 when the hoistway doors are in the closed position.

Figure 12A:
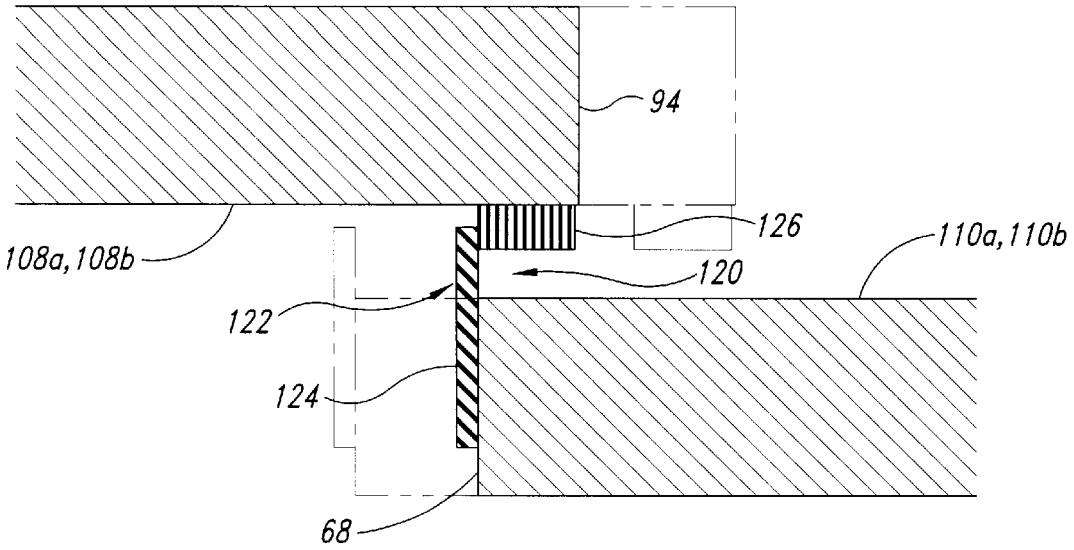
FIG. 12*a* is an enlarged sectional view of a lateral edge seal structure between the pair of opposing hoistway doors of FIG. 11*a* shown in phantom lines in an unsealed position prior to closing and shown in solid lines in a closed, sealed position.

As best seen in FIG. 12*a*, the interdoor seal structure 122 includes an elongated interdoor lateral extension 124 secured to the trailing edge portion 68 of each of the outer hoistway doors 110*a* and 110*b* such that the interdoor lateral extension extends along the height of the respective hoistway door. The interdoor lateral extension 124 extends inwardly toward the respective inner hoistway door 108*a* and 108*b* and into the interdoor lateral space 120. An elongated interdoor lateral seal 126 is connected to each of the inner hoistway doors 108*a* and 108*b* adjacent to the leading edge portion 94 such that the interdoor lateral seal extends into the interdoor lateral space 120 in an overlapping relationship with the associated interdoor lateral extension 124.

When the hoistway doors 108*a*, 108*b*, 110*a* and 110*b* are moved to and from the open position, shown in phantom lines, the interdoor lateral extension 124 does not the respective interdoor lateral seal 126, thereby minimizing frictional resistance to lateral movement of the hoistway doors. When the hoistway doors 108*a*, 108*b*, 110*a*, and 110*b* are moved to the closed position, as shown in solid lines in FIG. 12*a*, the interdoor lateral extension 124 presses against and sealably engages the interdoor lateral seal 126 to seal the interdoor lateral space 120 along the height of the hoistway doors, for example, to block the flow of gas or smoke through the interdoor lateral space 120 in the event of a fire or the like. In the preferred embodiment, the interdoor lateral extension 124 is a substantially rigid, blade-like member and the interdoor lateral seal 126 is shaped, resilient temperature resistive material that is slightly compressed by the interdoor lateral extension when the hoistway doors 108*a*, 108*b*, 110*a* and 110*b* are in the closed position.

Figure 12B:
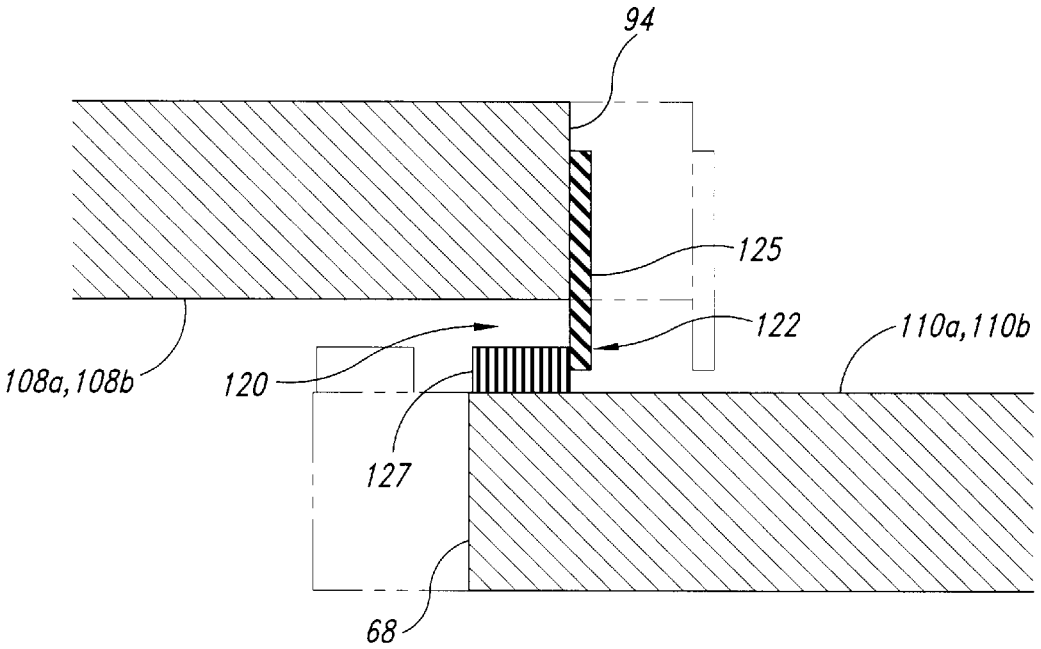
FIG. 12*b* is an enlarged sectional view of an alternate embodiment of a lateral edge seal structure between the pair of opposing hoistway doors of FIG. 11*a* as shown in phantom lines in an unsealed position prior to closing and shown in solid lines in a closed, sealed position.

In an alternate embodiment illustrated in FIG. 12*b*, the interdoor lateral seal structure 122 includes an elongated interdoor lateral extension 125 that is secured to the leading edge portion 94 of each of the left and right inner hoistway doors 108*a* and 108*b*, and that projects outwardly toward the respective outer hoistway doors 110*a* and 110*b*. An elongated interdoor lateral seal 127 is securely attached to each of the outer hoistway doors 110*a* and 110*b* adjacent to the trailing edge portion 68 and extends into the interdoor lateral space 120 toward the respective inner hoistway door 108*a* and 108*b*. The interdoor lateral seal 127 is positioned in an overlapping relationship with the associated interdoor lateral extension 125. When the hoistway doors 108*a*, 108*b*, 110*a* and 110*b* move to and from the open position shown in phantom lines, the interdoor lateral seal 127 is not in engagement with the interdoor lateral extension 125. When the hoistway doors 108*a*, 108*b*, 110*a*, and 110*b* are in the closed position shown in solid lines, the interdoor lateral seal 127 presses against the interdoor lateral extension 125 and provides a seal in the interdoor lateral space 120. 120.

As best seen in FIG. 11*a*, the transverse edge portion 52 of the outer hoistway doors 110*a* and 110*b* are positioned outwardly adjacent to the inner hoistway doors 108*a* and 108*b* and the headwall 30 to define a transverse head space 128 when the outer hoistway doors 110*a* and 110*b* are in the closed position. An elongated transverse head seal structure 130 is mounted to the headwall 30 between the inner hoistway doors 108*a* and 108*b* and extends outwardly from the headwall 30 toward the outer hoistway doors 110*a* and 110*b* to substantially fill the transverse head space 128.

Figure 13A:
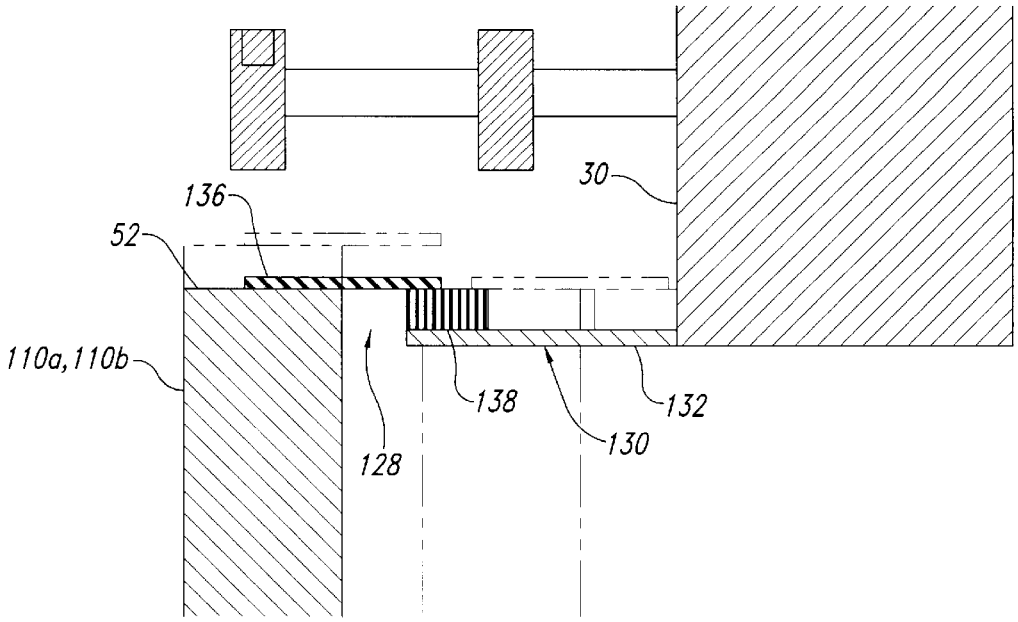
FIG. 13*a* is an enlarged cross-sectional view taken substantially along line 13*a,b*—13*a,b* of FIG. 11*a* with the door supports not shown for clarity, and with the transverse edge seal structure shown in phantom lines in a raised, unsealed position prior to closing and shown in solid lines in a lowered, sealed position.

As best seen in FIG. 13*a*, the elongated transverse head seal structure 130 comprises an elongated transverse extension 136 that is securely fastened to the length of the transverse edge portion 52 of each outer hoistway door 110*a* and 110*b* and that extends away from its respective outer hoistway door 110*a* and 110*b* into the transverse head space 128 toward the headwall 30. An elongated transverse head panel 132 is mounted to the headwall 30 between the inner hoistway doors 108*a* and 108*b*. The transverse head panel 132 extends outwardly from the headwall 30 into the transverse head space 128 toward the outer hoistway doors 110*a* and 110*b*. An elongated transverse head panel seal 138 is secured along the length of the transverse head panel 132 and extends upwardly away from the transverse head panel toward the transverse extension 136 in such a position wherein the transverse extension 136 is in an overlapping relationship with the transverse head panel seal.

The transverse extension 136 is out of engagement with the transverse head panel seal 138 when the respective outer hoistway doors 110*a* and 110*b* are in the open and raised position, shown in phantom lines, thereby avoiding frictional resistance between the transverse extension and the transverse head panel seal. When the outer hoistway doors 110*a* and 110*b* are moved to the closed and lowered position shown in solid lines, the transverse extension 136 moves downwardly into sealable engagement with the transverse head panel seal 138 and seals the transverse head space 128 adjacent to the outer hoistway doors. In the preferred embodiment, the transverse extension 136 is a substantially rigid, blade-like member and the transverse head panel seal 138 is a shaped, resilient temperature resistive material that is slightly compressed by the transverse extension 136 when the outer hoistway doors 110*a* and 110*b* are in the closed position.

Figure 13B:
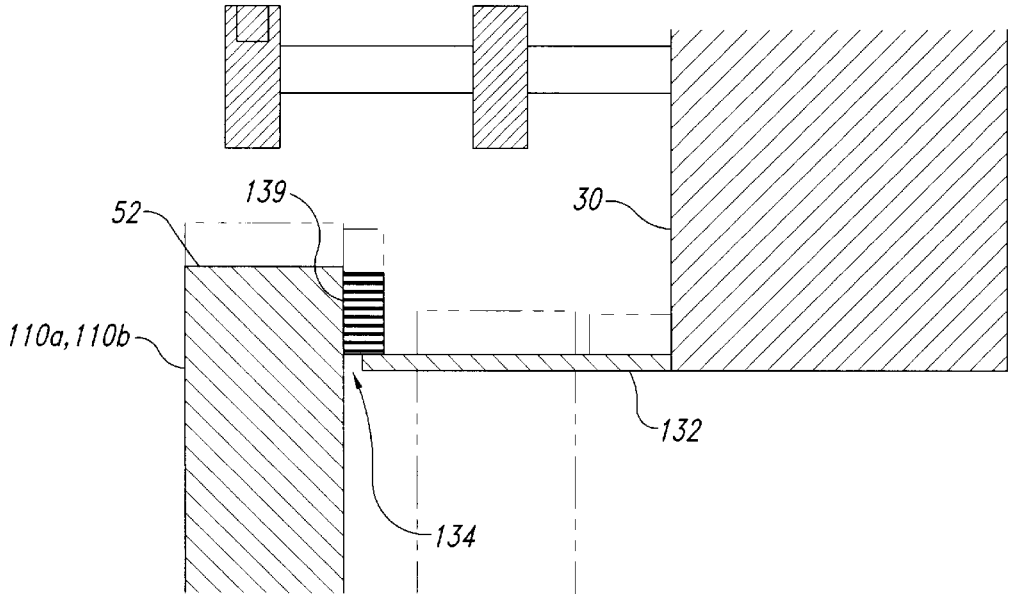
FIG. 13*b* is an enlarged cross-sectional view taken substantially alone line 13*a,b*—13*a,b* of FIG. 11*a* with the door supports not shown for clarity, and with an alternate embodiment of the transverse edge seal structure shown in phantom lines in a raised, unsealed position prior to closing and shown in solid lines in a lowered, sealed position.

In an alternate embodiment illustrated in FIG. 13*b*, the transverse head panel 132 is mounted to the headwall 30 as described above. An elongated transverse head panel seal 139 is mounted to each of the outer hoistway doors 110*a* and 110*b* along the length of the door near the transverse edge 52. The transverse head panel seal 139 extends inwardly into the transverse head space 128 and is positioned in an overlapping relationship with the transverse head panel 132 such that, when the outer hoistway doors 110*a* and 110*b* are in the closed position, shown in solid lines, the transverse head panel seal is pressed into sealable engagement with the transverse head panel, thereby providing a seal within the transverse head panel space 128.

Figure 14:
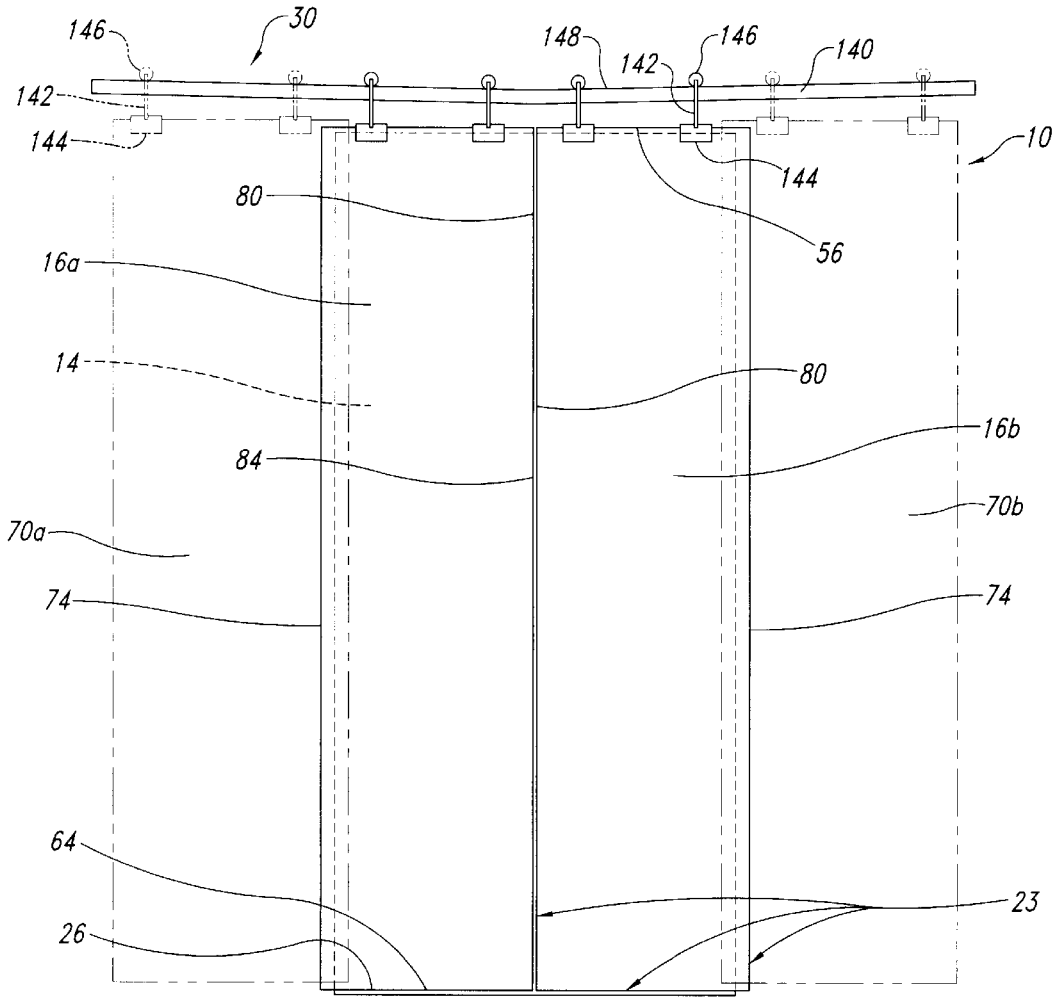
FIG. 14 is an enlarged side elevation view of an alternate embodiment of the present invention with opposing hoistway doors supported from a support member sloping vertically downward toward the center of the hoistway entrance, the hoistway doors being shown in phantom lines in a position prior to closing and shown in solid lines in a closed position.

In another embodiment of the present invention illustrated in FIG. 14, a sloped door support member 140 is securely mounted to the headwall 30 above the hoistway entrance 14. The sloped door support member 140 slopes downwardly from each of its outer ends toward the center of the hoistway entrance 14. The sloped door support member 140 is illustrated with the opposing hoistway doors 16*a* and 16*b* discussed above. Although the illustrated embodiment includes a pair of opposing doors 16*a* and 16*b*, the door assembly 16 can have other configurations, such as a single door configuration, or a configuration having a multiple pair of opposing doors.

Each of the hoistway doors 16*a* and 16*b* are movably supported on the sloped door support member 140 by a pair of door supports 142 that move laterally along the sloped door support member as the hoistway doors move between the open and closed positions. Each door support 142 includes a door support truck 144 secured to the top of the respective hoistway door 16*a* or 16*b* and a support roller 146 rotatably attached to the top of the door support truck. The support roller 146 is adapted to movably engage a roller support surface 148 on the top of the sloped door support member 140 to permit the lateral movement of the hoistway doors 16*a* and 16*b* between the open and closed positions.

When the hoistway doors 16*a* and 16*b* are in the open position, shown in phantom lines, the door supports are located at the raised ends of the sloped door support member 140, such that the doors are in a raised position above the sill 26. As the hoistway doors 16*a* and 16*b* move from the open and raised position to the closed position, the support rollers 146 move laterally and downwardly alone the upper roller support surface 148 of the sloped door support member 140, thereby causing the hoistway doors 16*a* and 16*b* to simultaneously move downwardly relative to the wall structure 10 to a lowered position such that the bottom edge of each hoistway door moves downwardly toward the sill 26.

The seal structures around the hoistway entrance and the hoistway doors, and the alternative embodiments of the seal structures are the same as the seal structures described above. The transverse seal structure 56 is mounted between the top portion of the hoistway doors and the headwall 30. The trailing edge seal structure 74 is mounted between the trailing edge portion of the respective hoistway doors and the left and right jambwalls 70*a* and 70*b*. The meeting edge seal structure 84 is mounted between the meeting edges 80 of the doors. The bottom door seal structure 64 is mounted between the bottom edge of the door and the sill 26. These seal structures form the seals 23 around and between the hoistway doors 16*a* and 16*b* when the hoistway doors 16*a* and 16*b* laterally and downwardly move from the open and raised position to the closed and lowered position. Accordingly, the sloped door support member 140 simultaneously directs the hoistway doors laterally and vertically, thereby forming seals that, for example, block the flow of smoke and gas between the hoistway doors 16*a* and 16*b* and the wall structure.

Figure 15:
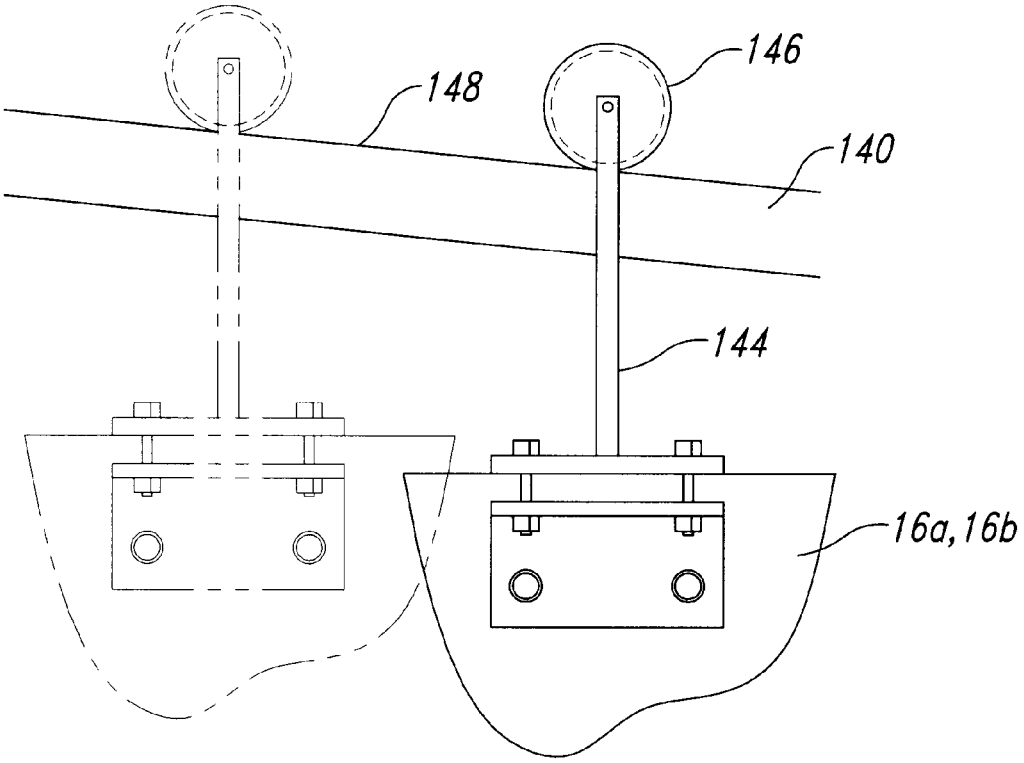
FIG. 15 is an enlarged fragmentary elevation view of a door support truck and a support roller of the hoistway door of FIG. 14 with the door support truck and support roller shown in phantom lines in a raised position with the hoistway door in a position prior to closing and shown in solid lines in a lowered position.

As best seen in FIG. 15, the sloped door support member 140 is oriented to provide a gradual transition for the support rollers 146 as the hoistway doors 16*a* and 16*b* move between the closed and lowered position shown in solid lines, and the open and raised position shown in phantom lines. Accordingly, as the left and right hoistway doors 16*a* and 16*b* are moved laterally from the closed position toward the open position, the support rollers 146 travel upwardly along the roller support surface 148, thereby lifting the hoistway doors from the lowered position to the raised position. As a result, the hoistway doors 16*a* and 16*b* avoid frictional resistance from the seal structures and can be moved to the open position with a minimal amount of force.

Figure 16:
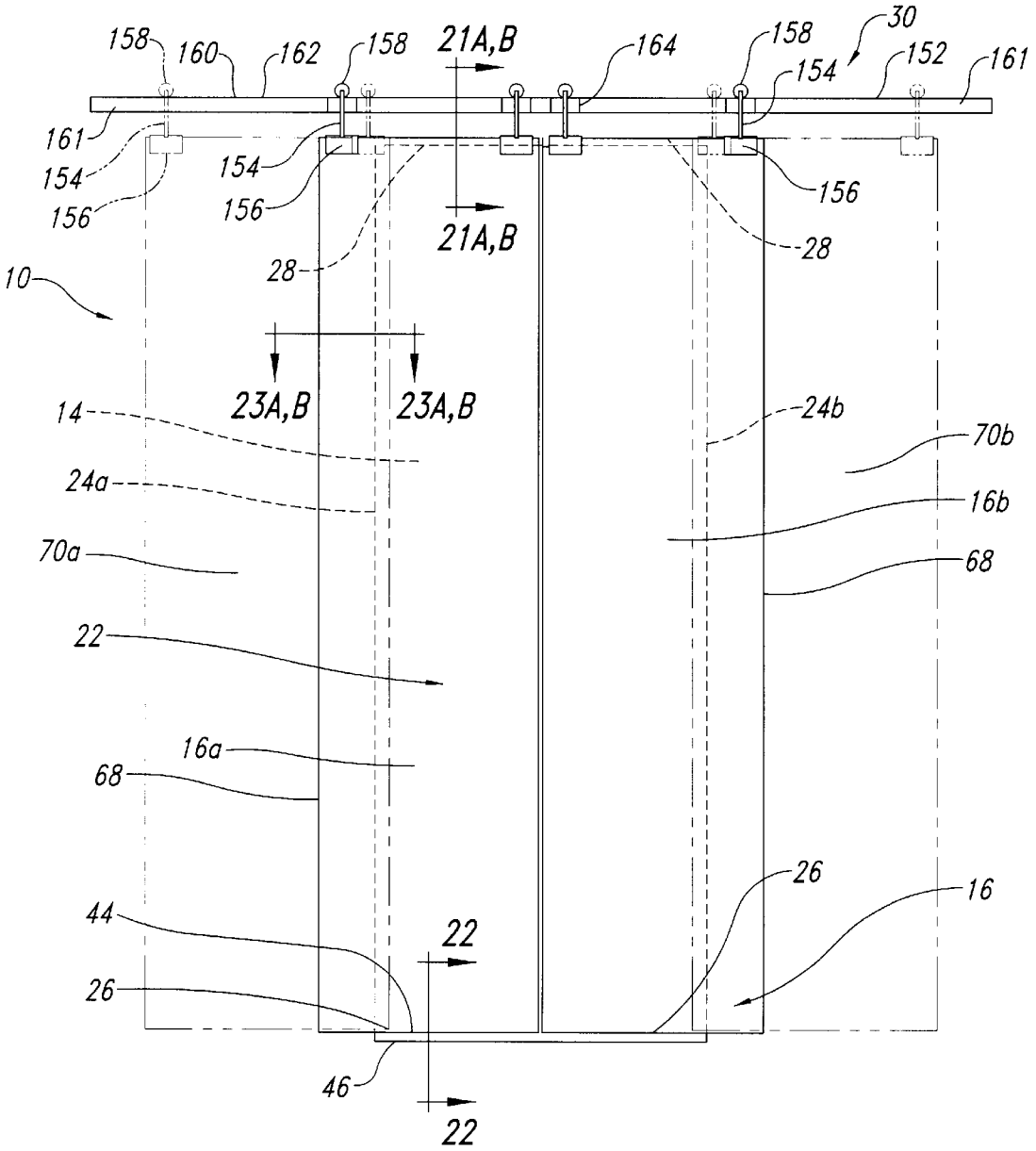
FIG. 16 is an enlarged side elevation view of an alternate embodiment of the present invention with opposing hoistway doors supported from a support member curing horizontally inward toward a headwall, the hoistway doors being shown in phantom lines in a position prior to closing and shown in solid lines in a closed position with the doors moved inwardly toward the hoistway entrance.

In another embodiment of the present invention illustrated in FIG. 16, the hoistway entrance 14 in the wall structure 10 is a rectangular opening defined by the left lateral jamb 24*a*, the right lateral jamb 24*b*, the sill 26, and the head 28. The hoistway door seal structure 22 is adjacent to the hoistway entrance 14. The hoistway door seal structure 22 includes the hoistway door assembly 16 that moves laterally relative to the hoistway entrance 14 between the open position, shown in phantom lines, permitting access to the elevator hoistway, and the closed position, shown in solid lines, wherein the hoistway door assembly 16 substantially covers the hoistway entrance 14. In the illustrated embodiment, the hoistway door assembly 16 includes the pair of opposing doors 16*a* and 16*b* that are laterally movable relative to the hoistway entrance 14. The pair of opposing doors 16*a* and 16*b* are coupled together in a conventional manner, such that the lateral movement of each of the hoistway doors is synchronized to move together between the open and closed positions. Although the illustrated embodiment includes the pair of opposing doors 16*a* and 16*b*, the door assembly can have other configurations, such as the single door configuration, or the configuration having a multiple pair of opposing doors.

The pair of hoistway doors 16*a* and 16*b* are movably supported outwardly adjacent to the hoistway entrance 14 by a segmented door support member 152 that is securely mounted to the headwall 30 above the head 28 in a generally horizontal orientation. Each of the hoistway doors 16*a* and 16*b* are movably attached to the segmented door support member 152 by a pair of door supports 154 that move laterally along the segmented door support member as the hoistway doors move between the open and closed positions. Each door support 154 includes a door support truck 156 that is pivotally secured to the top of the respective hoistway door 16*a* and 16*b*, and a support roller 158 is rotatably attached to the top of the door support truck 156. The support roller 158 movably engages a roller support surface 160 on the top of the segmented door support member 152 to permit the lateral movement of the hoistway doors 16*a* and 16*b* between an open and closed position.

The hoistway door seal structure 22 further includes the plurality of seals positioned between the hoistway doors 16*a* and 16*b* and the wall structure 10 around the hoistway entrance 14, and, as discussed in detail below, the seals are adapted to seal spaces between the hoistway doors and the wall structure when the doors are in the closed position, for example, to restrict the passage of gas and smoke through the spaces in the event of a fire. The formation of these seals is facilitated by the segmented door support member 152, which is constructed to guide the hoistway doors 16*a* and 16*b* laterally as the doors move from the open position shown in phantom lines toward the closed position shown in solid lines. As the hoistway doors 16*a* and 16*b* approach the closed position, the segmented door support member 152 also simultaneously guide the hoistway doors inwardly toward the wall structure, thereby forming, seals between and around the hoistway doors.

Figure 17:
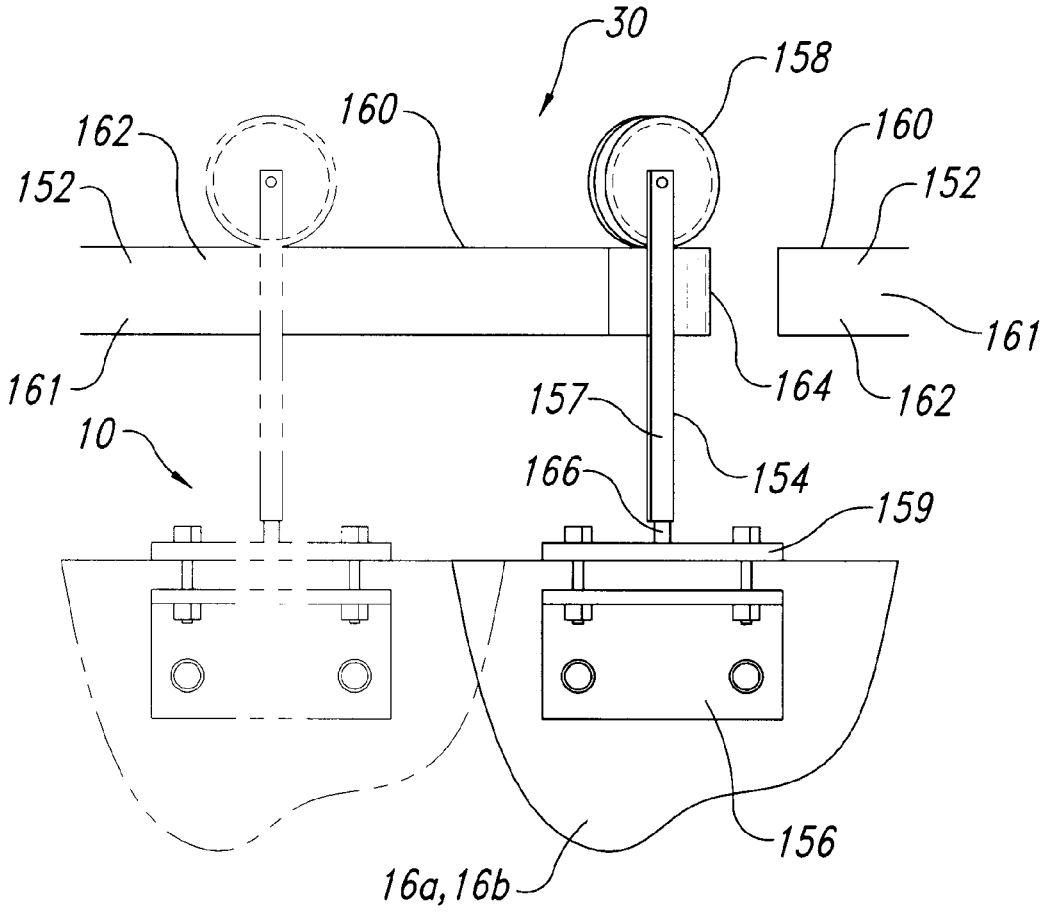
FIG. 17 is an enlarged fragmentary elevation view of a door support truck and a support roller of the hoistway door of FIG. 16 shown in phantom lines in a position prior to closing and shown in solid lines with the hoistway door in an inward and closed position.

As best seen in FIGS. 16 and 17, the segmented door support member 152 is a substantially horizontal rail sized to the opening distance traveled by the support rollers 158 as the hoistway doors move between the open and closed positions, with the uppermost edge of a rail forming the roller support surface 160. The segmented door support member 152 includes a plurality of segments 161 secured to the headwall 30, with each door support 154 traveling on a separate segment.

Figure 18:
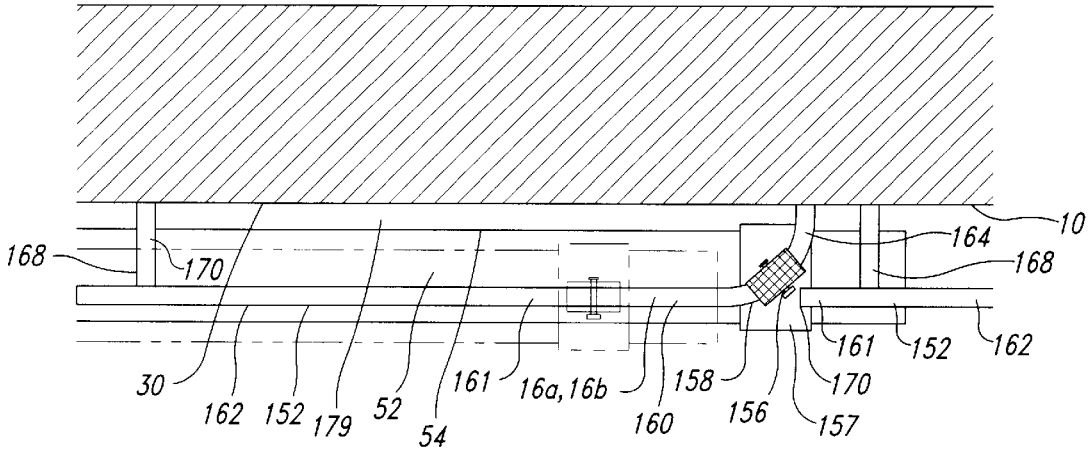
FIG. 18 is an enlarged partial plan view of the support member and the door support truck and support roller of the hoistway door of FIG. 16 shown in phantom lines in a position prior to closing and shown in solid lines with the hoistway door in an inward and closed position.

Each segment 161 has an elongated straight portion 162, and a curved end portion 164 secured to the end of each straight portion closest to the center of the hoistway entrance 14. The location of the innermost end of the curved end portion 164 corresponds to the location of the respective support roller 158 when the hoistway doors 16*a* and 16*b* are in the closed position. Each of the curved end portions 164 is positioned to receive the support roller 158 from the straight portions 162 as the hoistway doors 16*a* and 16*b* approach the closed position. As best seen in FIG. 18, the straight portion 162 of each segment 161 is positioned outwardly away from the headwall 30 such that the corresponding hoistway door 16*a* and 16*b* is supported outwardly away from the wall structure 10 as the hoistway door moves between the open and closed positions. The curved end portion 164 curves inwardly from the end of the straight portion 162 and terminates at the headwall 30.

Accordingly, each of the support rollers 158 travel along the roller support surface 160 of the respective segment 161 such that the hoistway doors 16*a* and 16*b* are in the outward position, shown in phantom lines in FIG. 18, as the support rollers travel over the support member's straight portion 162. As the hoistway doors 16*a* and 16*b* move laterally from the open and outer position and approach the closed position, the support rollers 158 move from the straight portions 162 to their respective curved end portions 164, thereby causing the hoistway doors 16*a* and 16*b* to simultaneously move laterally and inwardly, relative to the wall structure, to the closed position.

As best seen in FIG. 17, the door support truck 156 has an upper portion 157 that rotatably carries the support roller 158, and a lower portion 159 that is securely fastened to the respective hoistway door 16*a* and 16*b*. The upper and lower portions 157 and 159 are connected to each other by a pivotal member 166 such that the upper portion is pivotal relative to the lower portion and relative to the hoistway door. As seen in FIGS. 17 and 18, each of the support rollers 158 movably engages the roller support surface 160 and, as the hoistway doors 16*a* and 16*b* move laterally from the open and outward position toward the closed and inward position, the upper portion 157 of the door support truck 156 pivots as the support roller 158 follows the curved end portion 164, thereby causing the hoistway doors 16*a* and 16*b* to simultaneously move inwardly toward the hoistway entrance 14.

As best seen in FIG. 18, the terminating end 170 of the straight portion 162 of each segment 161 is attached to the headwall 30 with brackets 168. The curved end portion 164 opposite the terminating end 170 is secured directly to the headwall. The segments 161 of the segmented door support member 152 are constructed so the support rollers 158 simultaneously travel over the same area of their respective segment such that the hoistway doors 16*a* and 16*b* move in a uniform manner and remain substantially parallel to the hoistway entrance 14 as they move between the open and closed positions.

Figure 19:
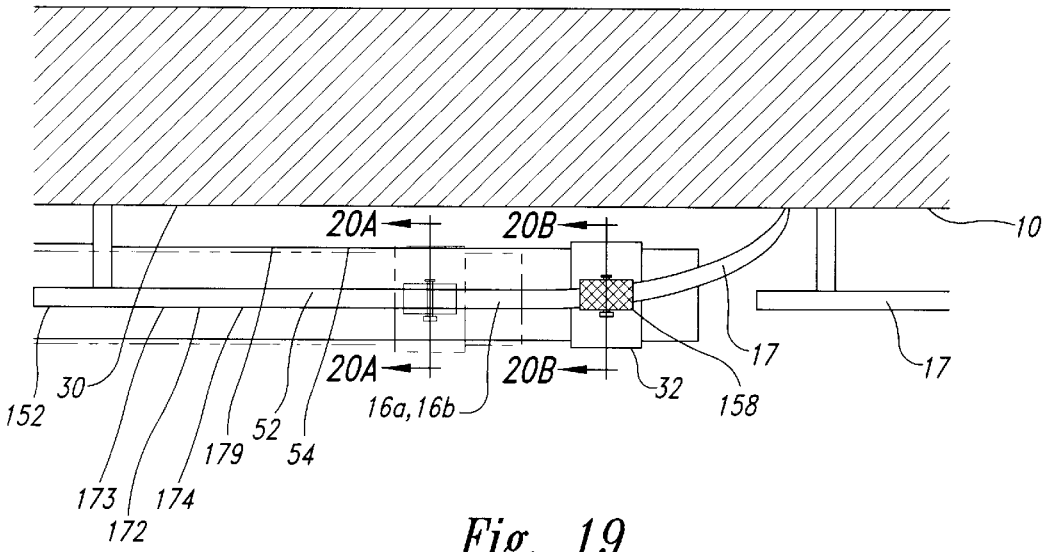
FIG. 19 is an enlarged partial plan view of an alternate embodiment of the support member and the door support truck of FIG. 16 shown in phantom lines in a position prior to closing and shown in solid lines with the hoistway door in an inward and closed position.

In an alternate embodiment of the segmented support member 152, illustrated in FIG. 19, the segmented support member 152 is a substantially horizontal rail with the uppermost edge of the rail forming a roller support surface 172. Each of the hoistway doors 16*a* and 16*b* are movably attached to the segmented door support member 152 by a pair of the non-pivotal door supports 32 described generally above and illustrated in FIG. 3. The segmented door support member 152 includes a plurality of segments 173, each having a straight portion 174 and a narrowed, curved portion 176 that is connected to the end of the straight portion 174. Each of the narrowed, curved portions 176 is positioned to receive the support roller 158 when the hoistway doors 16*a* and 16*b* approach the closed position. As the hoistway doors 16*a* and 16*b* are moved laterally from the open and outward position shown in phantom lines toward the closed and inward position, the support rollers 158 move from the straight portion 174 and follow the narrowed, curved portion 176 as the hoistway doors approach the closed position.

Figure 20A:
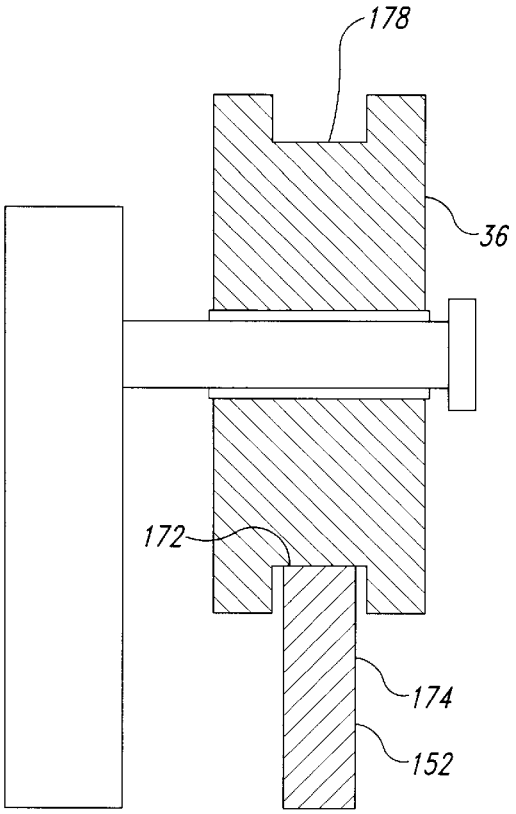
FIG. 20*a* is an enlarged cross-sectional view taken substantially along the line 20*a*—20*a* of FIG. 19 showing the support roller and the support member.
Figure 20B:
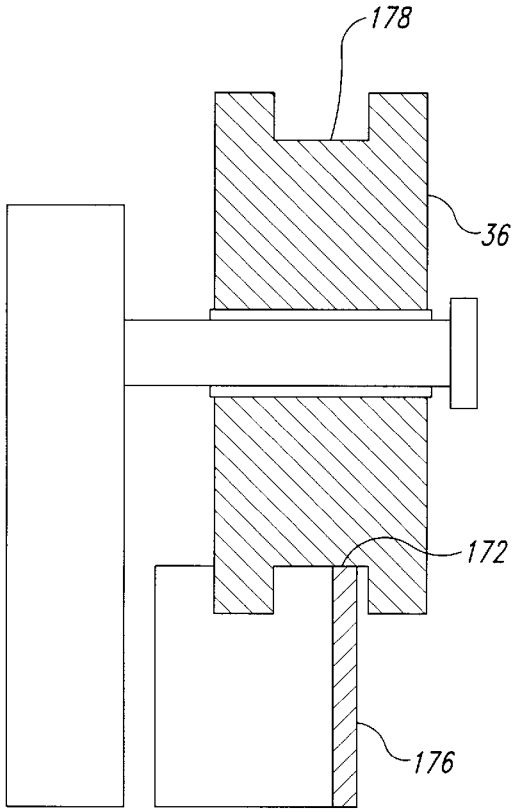
FIG. 20*b* is an enlarged cross-sectional view taken substantially along the line 20*b*—20*b* of FIG. 19 showing the support roller and a narrowed portion of the support member.

As best seen in FIG. 20*a*, the support roller 36 has an annular groove 178 therein that receives the top of the door support member 152, such that the support rollers straddles the door support member. The straight portion 174 of the segmented door support member 152 is sized slightly narrower than the width an annular groove 178 so as to minimize the frictional resistance between the support roller and the roller support surface 172. When the hoistway doors are in the closed position, the support rollers 36 are located at a position on the respective narrowed, curved portion 176, as best seen in FIG. 20*b*, where the narrowed, curved portion has a thickness that is approximately less than half the width of the annular groove 178. The narrowed, curved portion 176 is shaped and sized to direct the respective non-pivotal support roller 36 inwardly as the hoistway door approaches the closed position. The annular groove 178 is shaped to accommodate the curvature of the narrowed, curved portion 176 so the non-pivotal support roller 36 travels freely over the narrowed, curved portion without binding or experiencing excessive frictional resistance between the sides of the annular groove and the segmented door support member 152.

As best seen in FIGS. 18 and 19, each of the hoistway doors 16*a* and 16*b* have the transverse edge portion 52 along the top of the door that is outwardly adjacent to the headwall 30 so as to define the transverse space 54 between the transverse edge and the headwall 30. An elongated transverse seal structure 179 is positioned between the transverse edge portion 52 and the headwall 30 such that when the hoistway doors 16*a* and 16*b* are in the closed position as shown in solid lines, the elongated transverse seal structure 179 substantially fills the transverse space 54, for example, so as to block the passage of gas or smoke therethrough in the event of a fire or the like.

Figure 21A:
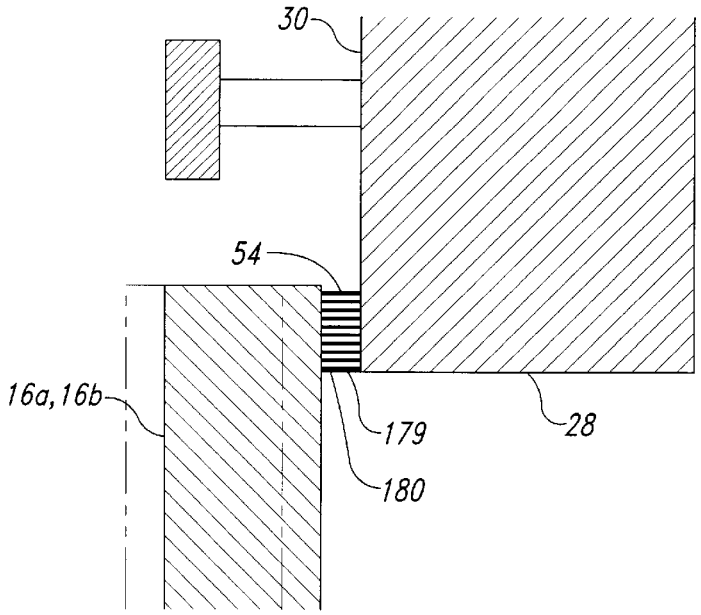
FIG. 21*a* is an enlarged cross-sectional view taken substantially along the line 21*a,b*—21*a,b* of FIG. 16 with the door supports not shown for clarity, and with a transverse edge seal structure of the outer hoistway door, shown in phantom lines in an outwardly, unsealed position prior to closing and shown in solid lines in an inwardly, sealed position.

As best seen in FIG. 21*a*, the elongated transverse seal structure 179 comprises an elongated transverse seal 180 securely fastened to the headwall 30 adjacent to the head 28. The transverse seal 180 extends outwardly toward the hoistway doors 16*a* and 16*b* and into the transverse space 54. The transverse seal 180 is out of engagement with the hoistway doors 16*a* and 16*b* when the doors are in the open and outward position shown in phantom lines, thereby avoiding frictional resistance between the transverse seal 180 and the hoistway door. When the hoistway doors 16*a* and 16*b* are moved from the open and outward position to the closed and inward position, the hoistway doors move into sealable engagement with the transverse seal 180 so as to seal the transverse space 54. In the preferred embodiment, the transverse seal 180 is a shaped, resilient temperature resistive material that is slightly compressed by the top of the hoistway doors 16*a* and 16*b* when it is moved to the closed and inward position.

Figure 21B:
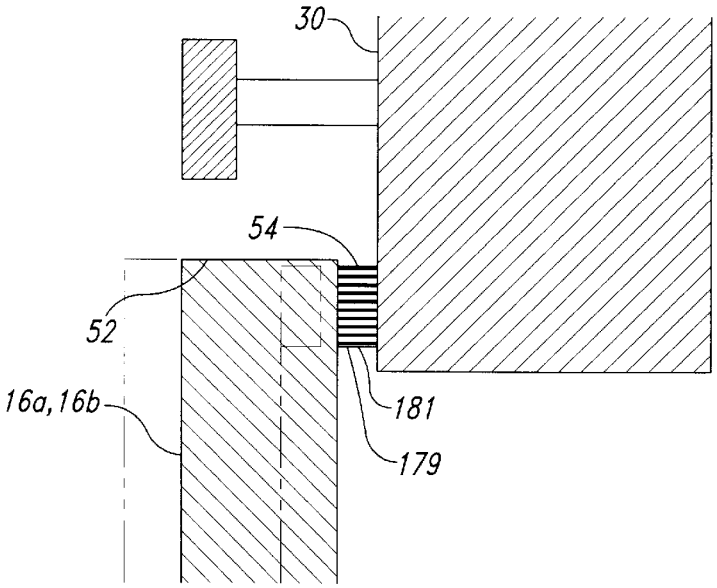
FIG. 21*b* is an enlarged cross-sectional view taken substantially along the line 21*a,b*—21*a,b* of FIG. 16 with the door supports not shown for clarity, and with an alternate embodiment of the transverse edge seal structure shown in phantom lines in an outwardly, unsealed position prior to closing and shown in solid lines in an inwardly, sealed position.

In an alternate embodiment illustrated in FIG. 21*b*, the elongated transverse seal structure 179 comprises elongated transverse seals 181 attached to the top portion of each of the hoistway doors 16*a* and 16*b* adjacent to the transverse edge portion 52. Each transverse seal 181 extends along the length of the respective hoistway door 16*a* and 16*b*, and the transverse seal extends inwardly into the transverse space 54 toward the headwall 30. When the hoistway doors 16*a* and 16*b* are in the closed and inward position shown in solid lines, the elongated transverse seal 181 presses against the headwall 30 to form a seal in the transverse space 54.

Figure 22:
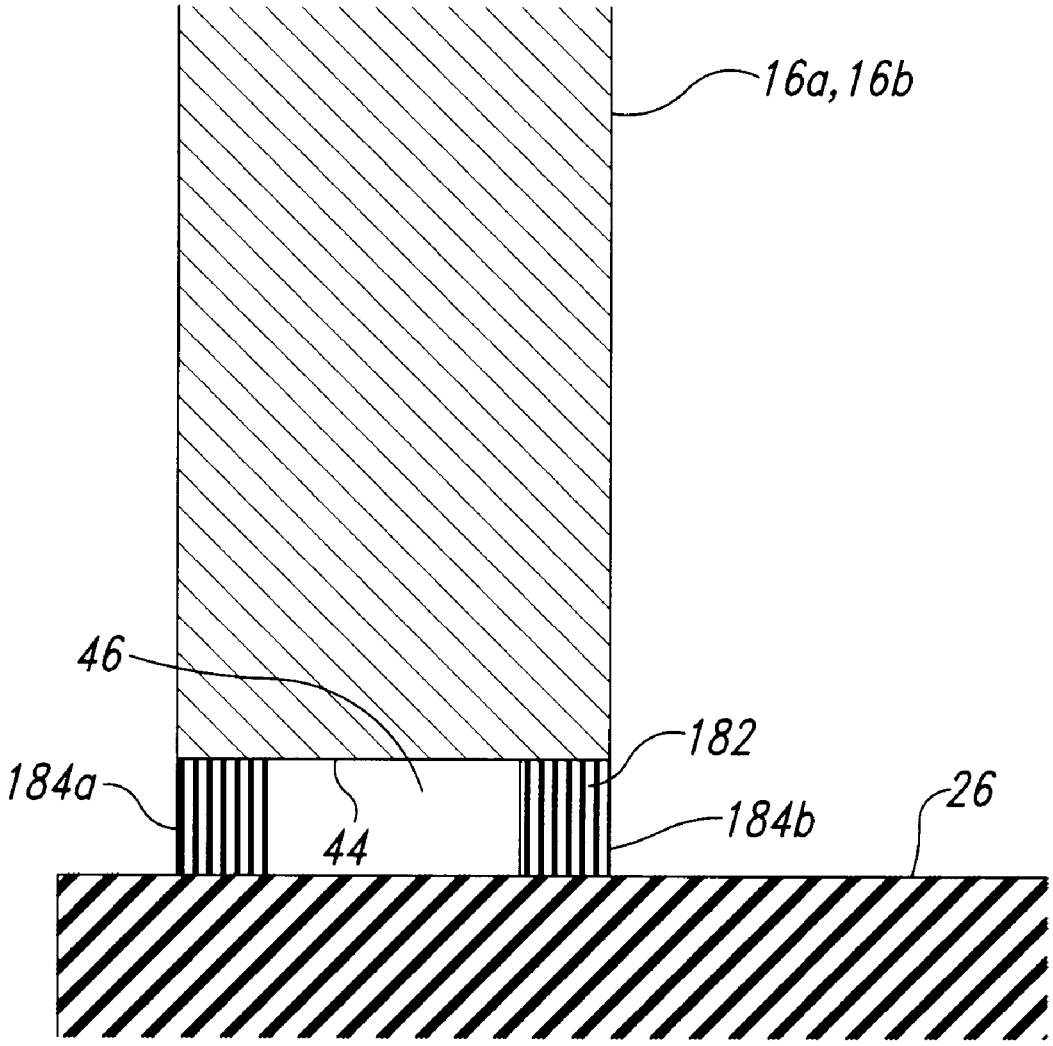
FIG. 22 is and enlarged cross-sectional view taken substantially along line 22—22 of FIG. 16 with a sill seal structure shown in a position above the sill.

Referring to FIG. 16, the bottom edge 44 of each hoistway door 16*a* and 16*b* is positioned above the sill 26 at a selected distance that defines a sill space 46 between the hoistway doors and the sill. As best seen in FIG. 22, a bottom door seal structure 182 is securely attached to the entire bottom edge 44 of each of the hoistway doors 16*a* and 16*b*. The bottom edge seal structure 182 includes elongated inner and outer bottom seals 184*a* and 184*b* spaced apart on the bottom edge 44 of each hoistway door 16*a* and 16*b*, such that the inner and outer bottom seals 184*a* and 184*b* extend the length of the respective hoistway door, and the bottom seals extend downwardly toward the sill 26. The bottom door seals 184*a* and 184*b* are sized such that they substantially fill the sill space 46 so as to, as an example, limit the flow of gas or smoke therethrough in the event of a fire. In the preferred embodiment, the bottom door seals 184*a* and 184*b* are a stainless steel brushes that lightly touches the sill as the hoistway doors 16*a* and 16*b* are moved to the closed position thereby minimizing frictional resistance during movement of the hoistway doors.

Figure 23A:
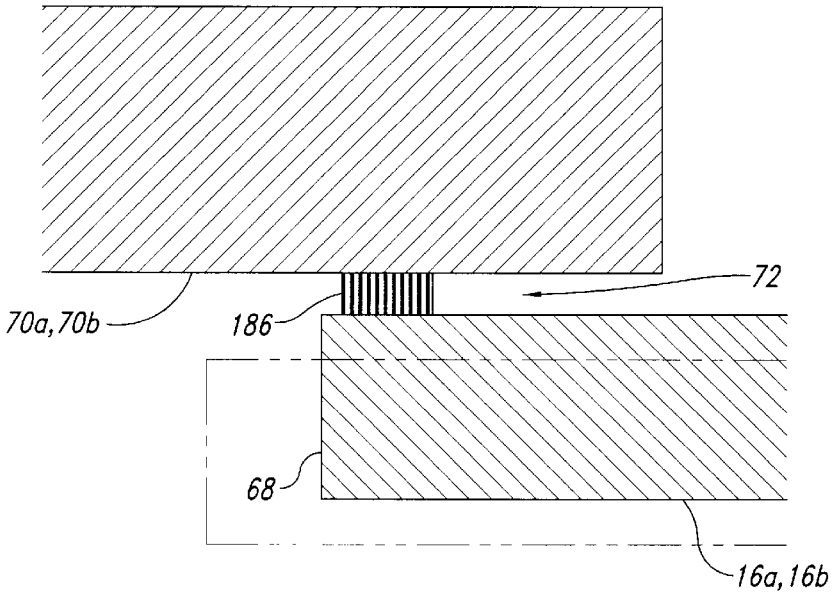
FIG. 23*a* is an enlarged cross-sectional view taken substantially along the line 23*a,b*—23*a,b* of FIG. 16 with the trailing edge seal structure shown in phantom lines in an outwardly, unsealed position prior to closing and shown in solid lines in an inwardly, sealed position.

As best seen in FIG. 16, each of the hoistway doors 16*a* and 16*b* has a trailing edge portion 68 that is positioned outwardly adjacent to the respective left and right jambwalls 70*a* and 70*b*. As best seen in FIG. 23*a*, each of the hoistway doors 16*a* and 16*b* is positioned such that the trailing edge lateral space 72 is located between the hoistway doors 16*a* and 16*b* adjacent to the trailing edge portion 68 and the respective left and right jambwall 70*a* and 70*b*. An elongated trailing edge seal 186 is connected to the left and right jambwalls 70*a* and 70*b* along their length. The trailing edge seal 186 projects outwardly from the respective 70*a* and 70*b* toward the respective hoistway door 16*a* and 16*b* such that the trailing edge seal 186 extends into the trailing edge space 72. The hoistway doors 16*a* and 16*b* are out of engagement with the respective trailing edge seal 186 when the hoistway doors are in the open and outward position, thereby avoiding frictional resistance therebetween as the doors are moving between the open and closed positions.

When the hoistway doors 16*a* and 16*b* are moved to the closed and inward position, as shown in solid lines in FIG. 23*a*, the hoistway doors 16*a* and 16*b* pressed against and sealably engages the trailing edge seal 186 to seal the trailing edge space 72 alone the height of the hoistway doors. In the preferred embodiment, the trailing edge seal 186 is a shaped, resilient temperature resistive material that is slightly compressed by the hoistway door when it is moved to the closed and inward position.

Figure 23B:
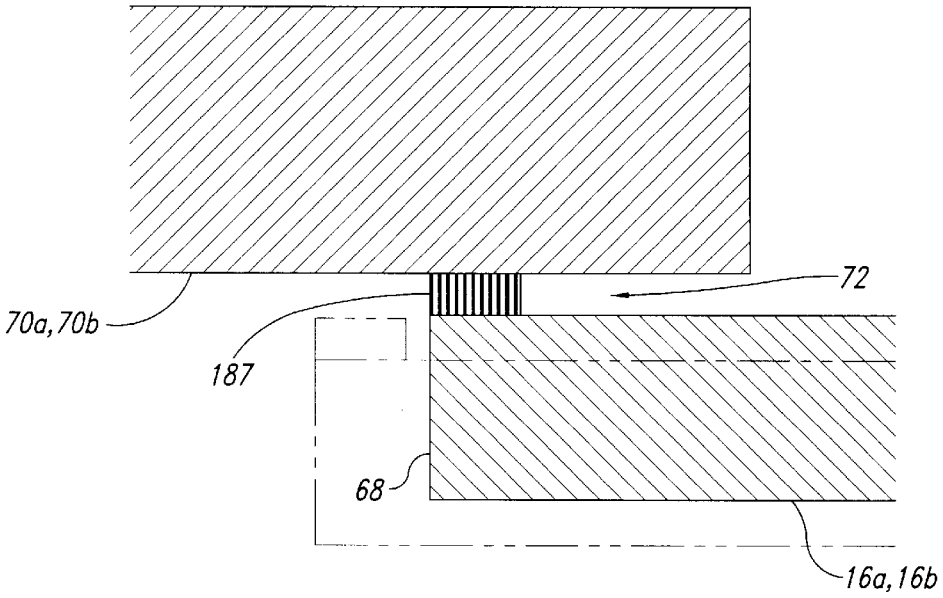
FIG. 23*b* is an enlarged cross-sectional view taken substantially along the line 23*a,b*—23*a,b* of FIG. 16 with an alternate embodiment of the trailing edge seal structure shown in phantom lines in an outwardly, unsealed position prior to closing and shown in solid lines in an inwardly, sealed position.

In an alternate embodiment illustrated in FIG. 23*b*, an elongated trailing edge seal 187 is attached to the entire length of the hoistway door 16*a* and 16*b* near the trailing edge portion 68 and extends into the trailing edge space 72 toward the jambwalls 70*a* and 70*b*. Accordingly, when the hoistway doors 16*a* and 16*b* are moved from the open and outward position shown in phantom lines toward the closed and inward position shown in solid lines, the trailing edge lateral seals 187 press against the respective right and left jambwalls 70*a* and 70*b* to form a seal in the trailing edge space 72.

The meeting edge seals and their alternate embodiments are as described above and shown in FIGS. 8*a*/*b*. The interdoor seals and the alternate embodiments for a pair or multiple pair of hoistway door configurations are as described above and shown in FIGS. 12*a*/*b*.

Figure 24A:
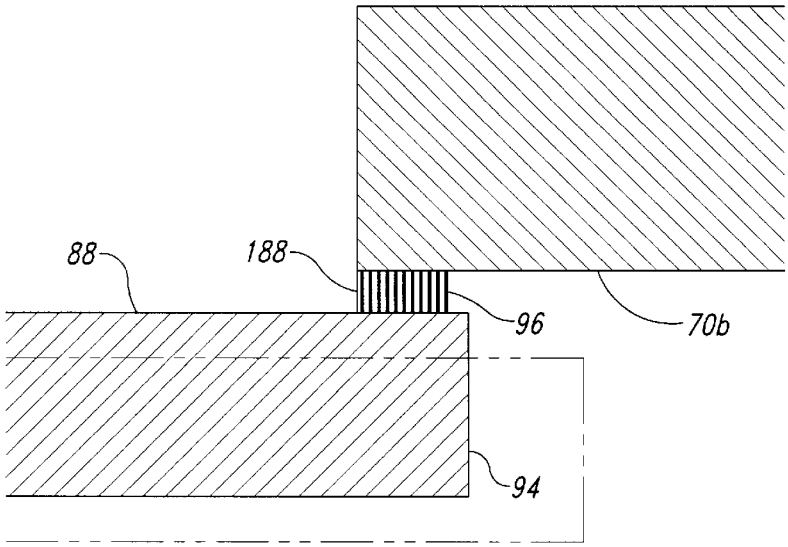
FIG. 24*a* is an enlarged cross-sectional view of the leading edge seal structure on a single hoistway door supported on a support member of FIG. 16, with the hoistway door shown in phantom lines in an outwardly, unsealed position and shown in solid lines in an inward, sealed position.

In an alternate embodiment (not shown) of the present invention having the segmented door support structure 152, the door seal structure 22 includes the single hoistway door 88 having the leading edge portion 94 that is positioned outwardly away from the right jambwall 70*b* to define a leading edge lateral space 96 between the hoistway door and the jambwall. As best seen in FIG. 24*a*, a leading edge lateral seal 188 is attached to the right jambwall 70*b* and projects outwardly away from the jambwall into the leading edge lateral space 96 toward the hoistway door 88. The leading edge lateral seal 188 is out of engagement with the jambwall 70*b* when the hoistway door 88 is in the open and outward position, thereby avoiding frictional resistance between the leading edge lateral seal 188 and the jambwall 70*b* as the door is moving between the open and closed positions. When the hoistway door 88 is moved to the closed and inward position, the hoistway door 88 moves inwardly into sealable engagement with the leading edge lateral seal 188 so as to seal the leading edge space 96. In the preferred embodiment, the leading edge lateral seal 188 is a shaped, resilient temperature resistive material that is slightly compressed by the hoistway door 88 near the leading edge portion 94 when the hoistway door is moved to the closed and inward position.

Figure 24B:
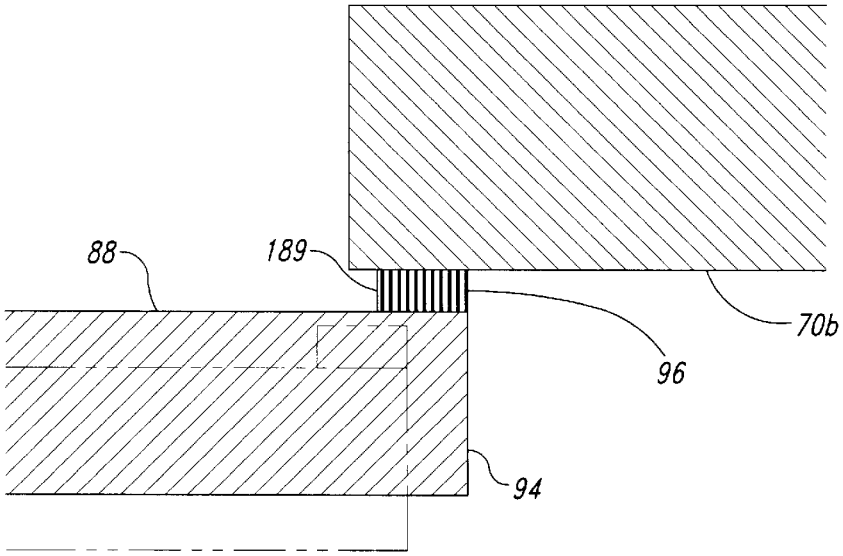
FIG. 24*b* is an enlarged cross-sectional view of an alternate embodiment of the leading edge seal structure of FIG. 24*a* with the hoistway door shown in phantom lines in an outwardly, unsealed position and shown in solid lines in an inward, sealed position.

In an alternate embodiment, illustrated in FIG. 24*b*, a leading edge lateral seal 189 is mounted to the hoistway door 88 near the leading edge portion 94 along the height of the door, and the leading edge lateral seal extends inwardly toward the right jambwall 70*b* and into the leading edge space 96. As the hoistway door 88 is moved from the open and outward position, shown in phantom lines, into the closed and inward position, shown in solid lines, the leading edge seal 189 is pressed into sealable engagement with the jambwall 70*a* to form a seal therein, for example, that limits smoke and gas flow through the leading edge space 96 in the event of a fire or the like.

In a single hoistway door configuration, seals are formed between the transverse edge of the door and the headwall as discussed above and illustrated in FIGS. 21*a* and 21*b*, between the bottom edge of the door and the sill as discussed above and illustrated in FIG. 22, and between the trailing edge of the door and the jambwall as discussed above and shown in FIGS. 23*a* and 23*b*.

Figure 25A:
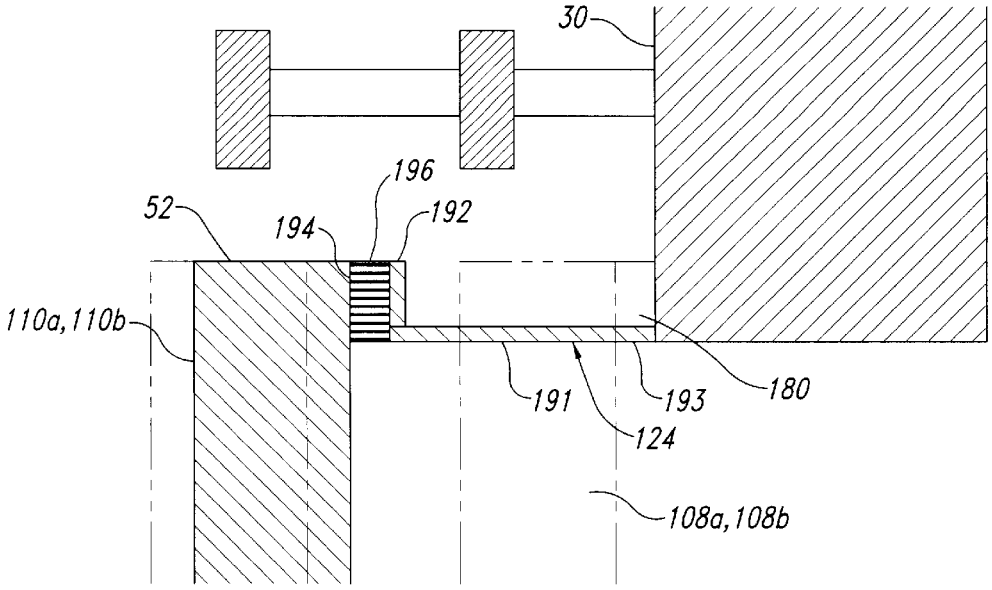
FIG. 25*a* is an enlarged cross-sectional view of a pair of adjacent support members of FIG. 16 supporting pairs of opposing hoistway doors similar to FIG. 11*a* with the door supports not shown for clarity, and with the transverse edge seal structure being shown in phantom lines in an outwardly, unsealed position prior to closing and shown in solid lines in an inwardly, sealed position.

In an alternative embodiment of the present invention, the hoistway door seal structure 22 includes a segmented door support member 152, as discussed above, and the door assembly includes opposing left and right inner hoistway doors 108*a* and 108*b* and opposing left and right outer hoistway doors 110*a* and 110*b*, similar to the hoistway door arrangement illustrated in FIG. 16. As best seen in FIG. 25*a*, the transverse edge portion 52 of the outer hoistway doors 110*a* and 110*b* is outwardly adjacent to the headwall 30, and the elongated transverse head panel seal structure 124 is attached to the headwall 30 between the headwall and the transverse edge portion 52 of the outer hoistway doors 110*a* and 110*b*. The transverse head panel seal structure includes a transverse head panel 191 having an L-shaped cross section with a first leg 193 securely attached to the headwall 30 and extending outwardly substantially perpendicular to the headwall. An upwardly projecting second leg 192 is connected to the outward end of the first leg 193 adjacent to the transverse edge portion 52 of the outer hoistway doors 110*a* and 110*b*. A transverse head panel space 194 is located between the upwardly projecting second leg 192 and the transverse edge portions of outer hoistway doors 110*a* and 110*b*.

An elongated transverse head panel seal 196 is secured along the length of the upwardly projecting second leg 192 of the transverse head panel 191 and extends toward the outer hoistway doors 110*a* and 110*b* into the transverse head panel space 194. The transverse head panel seals 196 are out of engagement with the outer hoistway doors 110*a* and 110*b* when the respective doors are moved to and from the open and outward position, thereby avoiding frictional resistance between the transverse head panel seal 196 and the outer hoistway doors 110*a* and 110*b*. When the outer hoistway doors 110*a* and 110*b* are moved to the closed and inward position, they move into sealable engagement with the transverse head panel seal 196 so as to seal the transverse head panel space 194. In the preferred embodiment, the transverse head panel seal 196 is a shaped, resilient temperature resistive material that is slightly compressed by the outer hoistway door 110*a* and 110*b* when the hoistway doors are moved to the closed and inward position.

Figure 25B:
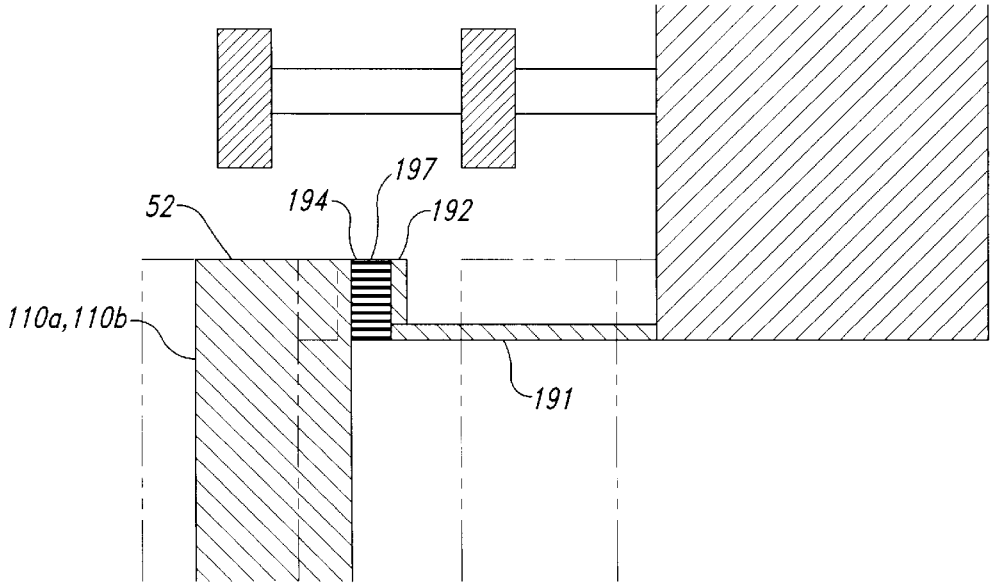
FIG. 25*b* is an enlarged cross-sectional view of an alternate embodiment of the transverse edge seal structure of FIG. 25*a*, with the door supports not shown for clarity, and with the hoistway door panel shown in phantom lines in an outwardly, unsealed position prior to closing and shown in solid lines in an inwardly, sealed position.

In an alternate embodiment illustrated in FIG. 25*b*, the transverse head panel seal 197 is mounted to the outer hoistway doors 110*a* and 110*b* near the transverse edge portion 52 along the length of the respective outer hoistway door, and the transverse head panel seal extends inwardly toward the upwardly projecting second leg 192 of the transverse head panel 191 such that when the outer hoistway doors 110*a* and 110*b* are in the closed and inward position, shown in solid lines, the transverse head panel seal 197 is pressed into sealable engagement with the upwardly projecting second leg 192 thereby forming a seal within the transverse head panel space 194.

In the alternate embodiments having the segmented door support member 152 and a door assembly having opposing inner and outer hoistway doors, 108*a*, 108*b*, 110*a*, and 110*b*, as illustrated in FIGS. 25*a* and 25*b*, seals are formed between the transverse edge portion 52 of the inner hoistway doors and the headwall 30 as described above and illustrated in FIGS. 21*a* and 21*b*. Thus, the transverse seal 180 is securely connected to the headwall 30, or alternatively to the top portion of each inner hoistway door 108*a* and 108*b*, and the transverse seal is slightly compressed when the inner hoistway doors are in the closed and inward position. A sill seal is formed between the bottom edge of the inner and outer hoistway doors 108*a*, 108*b*, 110*a*, and 110*b*, and the sill 26 as discussed above and illustrated in FIG. 22. A trailing edge seal structure 186 is attached to the trailing edge portion of the inner hoistway doors 108*a* and 108*b*, or alternatively to the respective left and right jambwall 70*a* and 70*b* in a manner substantially identical as is described above and illustrated in FIGS. 23*a* and 23*b* for the door assembly with two opposing door panels.

In the alternate embodiments having the segmented door support member 52 and a door assembly with inner and outer hoistway doors 108*a*, 108*b*, 110*a*, and 110*b*, the hoistway doors move in unison from the outward position to the inward position as the hoistway doors close. Accordingly, the interdoor lateral space 120 between the leading edge portions of the inner hoistway doors 108*a* and 108*b* and the trailing edge portions of the outer hoistway doors 110*a* and 110*b* remain substantially the same size as the hoistway doors move between the open and outward position and the closed and inward position. Accordingly, the interdoor lateral space 120 is sealed by an interdoor seal structure 122 in the same manner as discussed above and illustrated in FIGS. 12*a* and 12*b*.

When the inner and outer hoistway doors 108*a*, 108*b*, 110*a*, and 110*b* move from the open and outward position, shown in solid lines in FIG. 16, to the closed position, shown in phantom lines, the inner and outer hoistway doors move laterally and inwardly as the doors approach and reach the closed and inward position. When the inner and outer hoistway doors 108*a*, 108*b*, 110*a*, and 110*b* are in the closed and inward position, seals are formed around and between the inner and outer hoistway doors 108*a*, 108*b*, 110*a*, and 110*b* and are effectively sealed off, for example, to limit the flow of gas or smoke therethrough in the event of a fire, thereby minimizing migration of smoke through a building during a fire or the like.

Figure 26:
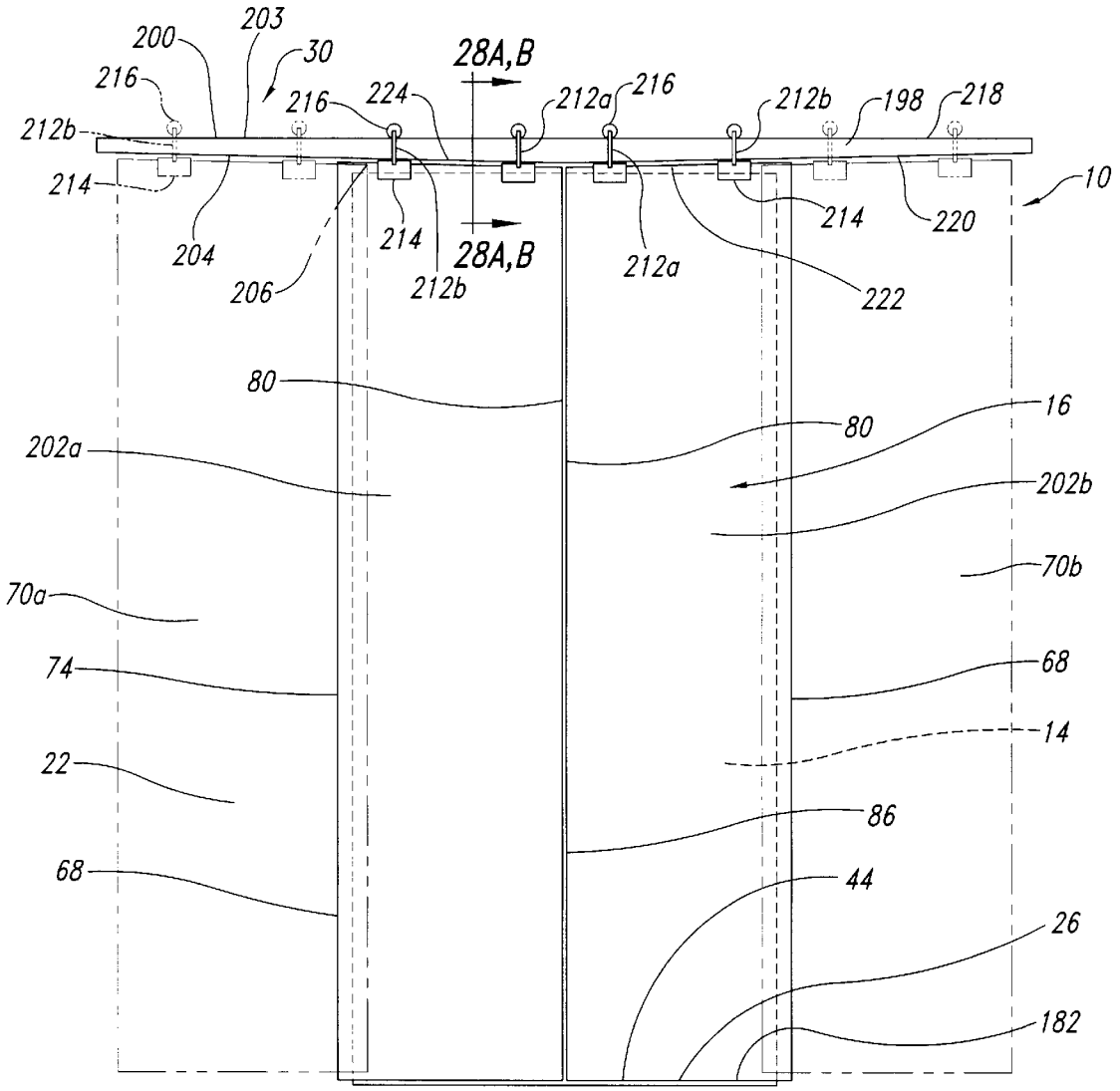
FIG. 26 is an enlarged side elevation view of an alternate embodiment of the present invention with an opposing hoistway door arrangement shown supported from a support member with a bottom edge sloping vertically downward toward the center of the hoistway entrance, the hoistway doors being shown in phantom lines in a position prior to closing and shown in solid lines in a closed position.

In yet another embodiment of the present invention illustrated in FIG. 26, a door assembly 16 has a pair of opposing hoistway doors 202*a*and 202*b* that are supported outwardly adjacent to the hoistway entrance 14 by an elongated door support member 198. The door support member 198 is rigidly secured to the headwall 30 by brackets 200 in a generally horizontal orientation above the hoistway entrance 14. Although the illustrated embodiment includes a pair of opposing doors 202*a* and 202*b*, the door assembly 16 can have other door configurations, such as a single door, or a multiple pair of opposing doors, as discussed above.

Figure 27:
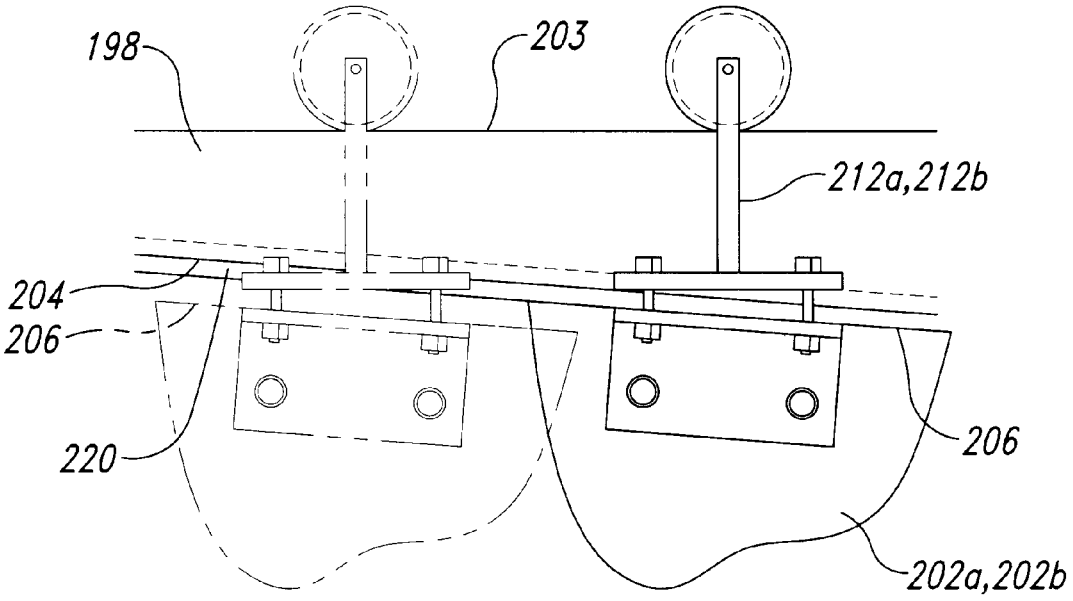
FIG. 27 is an enlarged fragmentary elevation view of a door support truck and a support roller of the hoistway door of FIG. 26 shown in phantom lines in a position prior to closing and shown in solid lines with the hoistway door in a closed position.

As best seen in FIGS. 26 and 27, the elongated door support member 198 is a rail with a horizontal top edge 203 and a sloped bottom edge 204 that slopes downwardly from each of its outer ends toward the centerline of the hoistway entrance 14. The sloped bottom edge 204 is directly above the hoistway doors 202*a* and 202*b*. Each of the hoistway doors 202*a* and 202*b* have a sloped transverse edge 206 that slopes downwardly from the hoistway door's trailing edge portion to its leading edge portion. The slope of the sloped transverse edge 206 substantially correspondences to the slope of the door support member's sloped bottom edge 204.

As best seen in FIG. 26, each of the hoistway doors 202*a* and 202*b* are movably supported on the door support member 198 by a leading door support 212*a* and a trailing door support 212*b* that move laterally along the horizontal top edge 203 as the hoistway doors move laterally between the open and closed positions. Each of the leading and trailing door supports 212*a* and 212*b* includes a door support truck 214 secured to the top of the respective hoistway door 202*a* and 202*b*, and a support roller 216 rotatably attached to the top of the door support truck. The support roller 216 rolls along the door support member's horizontal top edge 203 upon movement of the hoistway doors.

The door support trucks 214 of the leading and trailing door supports 212*a* and 212*b* are sized such that the sloped transverse edge 206 of the respective hoistway door 202*a* and 202*b* is immediately adjacent to the door support member's sloped bottom edge 204 when the hoistway doors are in the closed position. Accordingly, the door support truck 214 of the leading door support 212*a* is longer than the door support truck 214 of the trailing door support 212*b* to accommodate the deeper section of the door support member near its middle portion. When the hoistway doors 202*a* and 202*b* are moved toward the open position, the distance between the hoistway door's sloped transverse edge 206 and the door support member's sloped bottom edge 204 increases because of the slope of the sloped bottom edge.

Figure 28A:
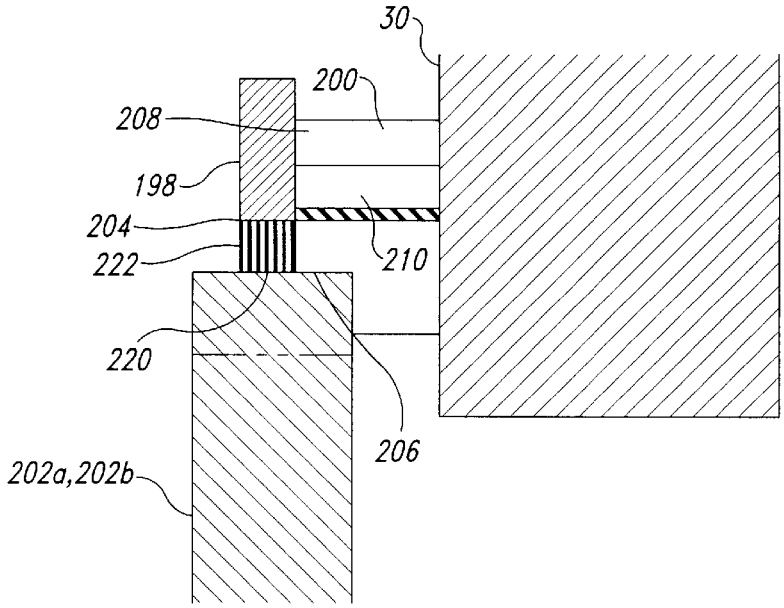
FIG. 28*a* is an enlarged cross-sectional view taken substantially along the line 28*a,b*—28*a,b* of FIG. 26 with the door supports not shown for clarity, and with a transverse edge seal structure shown in phantom lines in a position prior to closing and shown in solid lines with the hoistway door in a closed position.
Figure 28B:
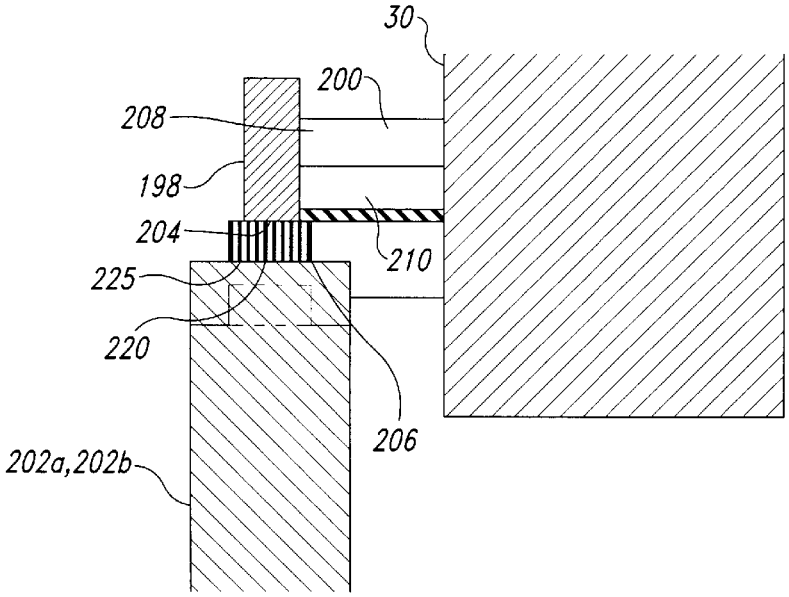
FIG. 28*b* is an enlarged cross-sectional view taken substantially along the line 28*a,b*—28*a,b* of FIG. 26 with the door supports not shown for clarity and with an alternate embodiment of a transverse edge seal structure shown in phantom lines in a position prior to closing and shown in solid lines with the hoistway door in a closed position.

As best seen in FIGS. 28*a* and 28*b*, the door support member 198 is outwardly supported away from the headwall 30 by the brackets 200 to define a transverse door support space 208 between the door support member and the headwall 30. A sloped transverse seal 210 is connected to the headwall 30 and extends outwardly to the door support member 198 adjacent to the sloped bottom edge 204 of the door support member 198. The transverse seal 210 is a blade-like structure having a slope that substantially corresponds to the slope of the sloped bottom edge 203, and the sloped transverse seal fills the transverse door support space 208 to block, for example, the flow of smoke and gas between the door support member 198 and the headwall 30.

As best seen in FIGS. 26 and 27, when the hoistway doors 202*a* and 202*b* are in the closed position, shown in solid lines, the sloped transverse edge 206 of each hoistway door positioned below the door support member's sloped bottom edge 204 defines a sloped transverse space 220 therebetween. As best seen in FIG. 28*a*, an elongated transverse seal 222 is attached to the door support member's sloped bottom edge 204, and the transverse seal extends downwardly toward the sloped transverse edge 206 of hoistway doors 202*a* and 202*b* into the transverse space 220.

When the hoistway doors 202*a* and 202*b* are in the closed position, shown in solid lines, the sloped transverse edge 206 of each hoistway door 202*a* and 202*b* sealably engages the transverse seal 222 on the door support member 198, such that the transverse seal 222 fills the transverse space 220, for example, to block the flow of smoke and gas between the doors 202*a* and 202*b* and the headwall 30. When the hoistway doors 202*a* and 202*b* are moved to and from the open position, shown in phantom lines, the transverse seal 222 is out of engagement with the sloped transverse edge 206 of the hoistway doors, thereby avoiding, frictional resistance between the sloped transverse edges and the transverse seal as the hoistway doors move between the open and closed positions. In the preferred embodiment, the transverse seal 222 is a shaped, resilient temperature resistive material that is slightly compressed by the sloped transverse edges 206 when the hoistway doors 202*a* and 202*b* are moved to the closed position.

In an alternate embodiment of the present invention having the door support member 198 with a sloped bottom edge 204, as best seen in FIG. 28*b*, the sloped transverse seal 210 extends between the door support member and the headwall 30, as discussed above. An elongated sloped transverse seal 225 is securely mounted to the sloped transverse edge 206 of each of the hoistway doors 202*a* and 202*b*. The sloped transverse seal 225 extends upwardly away from the sloped transverse edge 206 into the transverse space 220 toward the sloped bottom edge 204 of the door support member 198. When the hoistway doors 202*a* and 202*b* are in the closed position, shown in solid lines, the sloped transverse seal 225 is in sealable engagement with the door support member's sloped bottom edge 204 so as to seal the sloped transverse space 220 and block gas or smoke from flowing therethrough in the event of a fire. When the hoistway doors 202*a* and 202*b* are moved toward the open position, shown in phantom lines, the sloped transverse seal 225 moves out of engagement with the door support member 198, so as to avoid frictional resistance therebetween as the hoistway doors move between the open and closed positions.

In the embodiments having the door support member 198 with a sloped bottom edge 204, additional seals are provided around and between the hoistway doors 202*a* and 202*b*, for example, to block gas or smoke from flowing between the hoistway doors and the wall structure 10 around the hoistway entrance. As best seen in FIG. 26, a trailing edge seal structure 74 as is described above and illustrated in FIGS. 7*a* and 7*b* is positioned between the trailing edge 68 of the respective hoistway door and the respective jambwall 70*a* and 70*b*. A meeting edge seal 86 as described above and illustrated in FIGS. 8*a* and 8*b* is positioned between the meeting edges 80 of the hoistway doors. A bottom door seal structure 182 as is described above and illustrated in FIG. 22 is positioned between the bottom edge 44 of each hoistway door and the sill 26. In the embodiment (not shown) wherein a single hoistway door is movably supported on the door support member having a sloped bottom edge, a leading edge seal structure as is described above and illustrated in FIGS. 10*a* and 10*b* is positioned between the leading edge of the hoistway door and the respective jambwall.

Figure 29A:
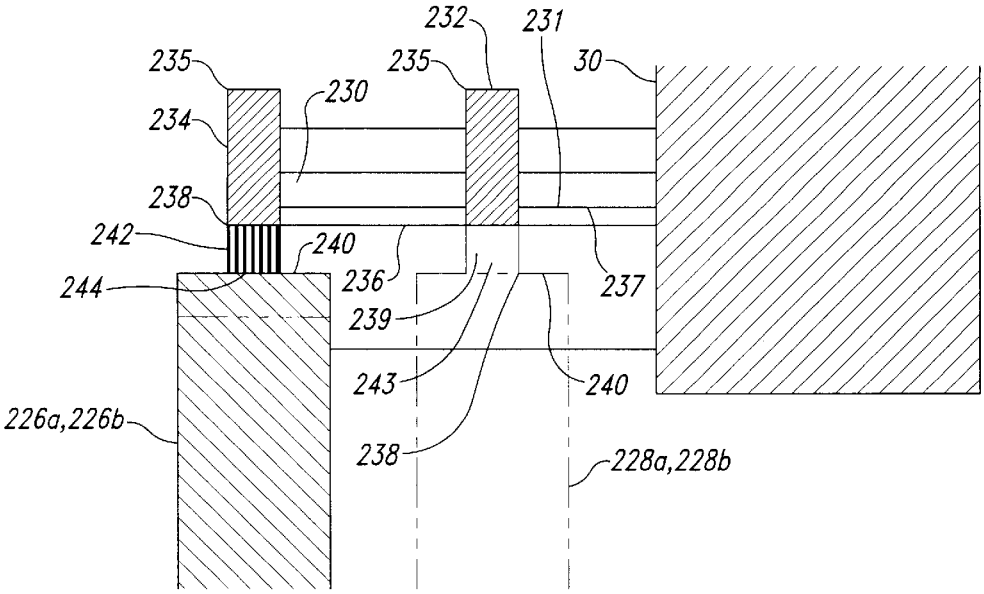
FIG. 29*a* is an enlarged cross-sectional view showing a transverse edge seal structure in phantom lines in a position prior to closing and shown in solid lines with the hoistway door in a closed position.
Figure 29B:
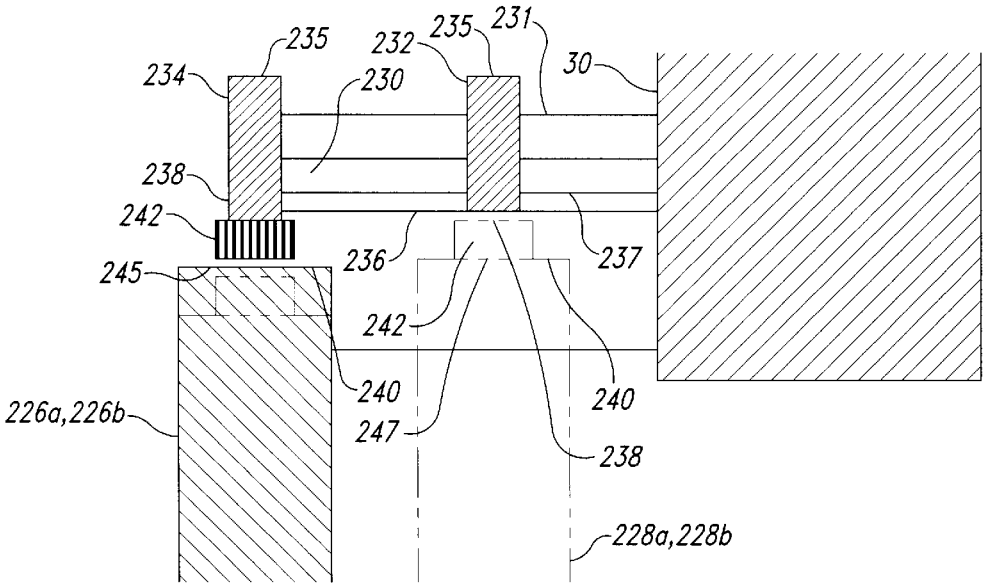
FIG. 29*b* is an enlarged cross-sectional view of an alternate embodiment of a transverse edge seal structure of FIG. 29*a* with the door supports not shown for clarity and with the transverse edge seal structure shown in phantom lines in a position prior to closing and shown in solid lines with the hoistway door in a closed position.

In an alternate embodiment having opposing outer and inner hoistway doors 226*a*, 226*b*, 228*a*, and 228*b*, as best seen in FIGS. 29*a* and 29*b*, the outer hoistway doors are movably supported on an elongated outer door support member 234 and the inner hoistway doors are movably supported on an elongated inner door support member 232. Each of the inner and outer door support members 232 and 234 have a horizontal top edge 235 and a sloped bottom edge 238 that slopes downwardly toward the center of the hoistway entrance. Each of the outer and inner hoistway doors 226*a*, 226*b*, 228*a*, and 228*b* have a sloped transverse edge 240 that slopes downwardly toward the center of the hoistway entrance, and the slope of each transverse edge corresponds to the downward slope of the sloped bottom edge 238 of the respective inner and outer door support members 232 and 234. The sloped transverse edges 240 of the outer hoistway doors 226*a* and 226*b* are positioned outwardly adjacent to the inner hoistway doors 228*a* and 228*b* and the headwall 30 to define a sloped transverse head panel space 230 between the inner door support member 232 and the outer door support member 234. An outer sloped transverse seal structure 236 is mounted between the inner door support member 232 and the outer door support member 234 adjacent to the sloped bottom edge 238 to substantially fill the sloped outer transverse head panel space 230. An inner sloped transverse seal structure 237 is mounted between the inner door support member 232 and the headwall 30 adjacent to the sloped bottom edge 238 to substantially fill the sloped inner transverse head panel space 231.

As best seen in FIG. 29*a*, an elongated outer transverse seal 244 is secured to the length of the sloped bottom edge 238 of the outer door support member 234. The outer transverse seal 244 extends downwardly away from the sloped bottom edge 238 toward the sloped transverse edge 240 of the outer hoistway doors 226*a* and 226*b* into an outer transverse space 242 that is between the respective outer hoistway door and the outer door support member 234. The outer transverse seals 244 are out of engagement with the transverse edge 240 of the respective outer hoistway doors 226*a* and 226*b* when the hoistway doors are in the open position, shown in phantom lines. This arrangement avoids resistance between the outer transverse seals 244 and the sloped transverse edge 240 as the outer hoistway doors 228*a* and 228*b* are moved between the open and closed positions.

When the outer hoistway doors 226*a* and 226*b* are moved to the closed position the sloped transverse edges 240 move laterally into sealable engagement with the outer transverse seal 244, so as to seal the outer transverse space 242. The outer transverse seal 244 is preferably a shaped, resilient temperature resistive material that is slightly compressed by the sloped transverse edge 240 of the respective outer hoistway door 226*a* and 226*b* when the outer hoistway doors are in the closed position.

An elongated inner transverse seal 243 is secured to the length of the sloped bottom edge 238 of the inner door support member 232. The inner transverse seal 243 extends downwardly away from the sloped bottom edge 238 toward the sloped transverse edge 240 of the inner hoistway doors 228*a* and 228*b* into an inner transverse space 239 between the respective inner hoistway door and the inner door support member 232. The inner transverse seals 243 are out of engagement with the sloped transverse edge 240 of the respective inner hoistway doors 228*a* and 228*b* when the hoistway doors are in the open position, shown in phantom lines.

When the inner hoistway doors 228*a* and 228*b* are moved to the closed position, shown in solid lines, the sloped transverse edges 240 move laterally into sealable engagement with the inner transverse seal 243, so as to seal the inner transverse space 239. The inner transverse seal 243 is preferably a shaped, resilient temperature resistive material that is slightly compressed by the sloped transverse edge 240 of the respective inner hoistway doors 228*a* and 228*b* when the inner hoistway doors are in the closed position.

In an alternate embodiment illustrated in FIG. 29*b*, an outer transverse seal 245 is mounted to the outer hoistway door 226*a* and 226*b* along the sloped transverse edge 240 and an inner transverse seal 247 is mounted to the inner hoistway doors 228*a* and 228*b* along the sloped transverse edge 240. Each of the inner and outer transverse seals 245 and 247 extend upwardly toward the respective inner and outer door support members 232 and 234. The inner and outer transverse seals 247 and 245 extend away from the respective sloped transverse edge 240 such that when the hoistway doors are in the closed position, shown in solid lines, the inner and outer transverse seals are pressed into sealable engagement with the respective sloped bottom edges 238 so as to form a seal within the respective inner and outer transverse edge spaces 242.

Figure 30:
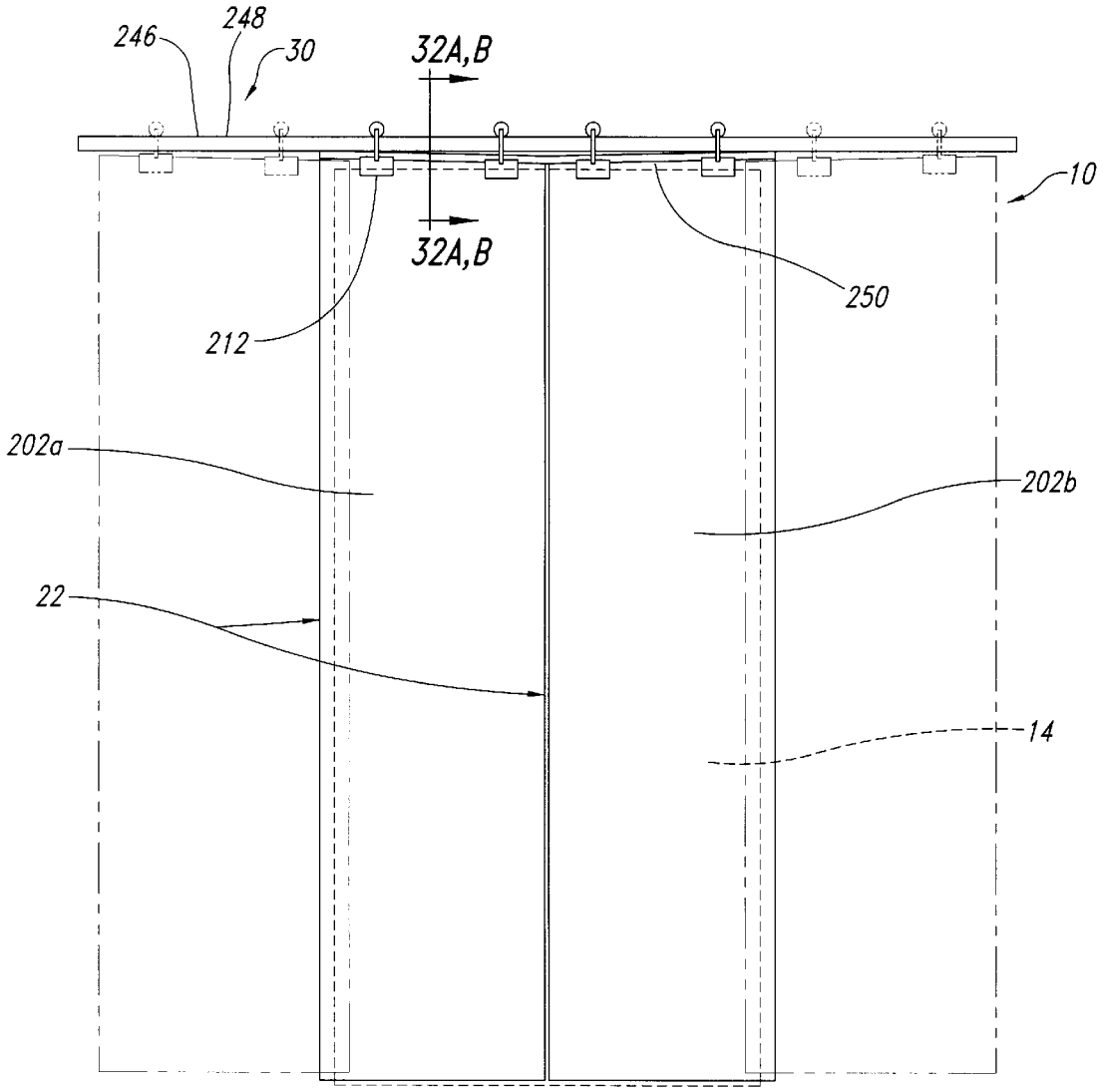
FIG. 30 is an enlarged side elevation of an alternate embodiment of the present invention with opposing hoistway doors shown supported from a support member having a bottom edge sloping vertically downwardly, the hoistway doors being shown in phantom lines in a position prior to closing and shown in solid lines in a closed position.

In another alternate embodiment of the present invention, as illustrated in FIG. 30, an elongated door support member 246 is securely mounted to the headwall 30 above the hoistway entrance 14. The elongated door support member 246 is illustrated with the opposing hoistway doors 202*a* and 202*b* discussed above. Although the illustrated embodiment includes a pair of opposing doors, the door assembly can have other configuration, such as a single door configuration, or a configuration having a multiple pair of opposing doors, as discussed above. Each of the hoistway doors 202*a* and 202*b* are movably attached to the elongated door support member 246 by a pair of door supports 212 as discussed above and shown in FIG. 26.

The hoistway door seal structure 22 further includes a plurality of seals positioned between the hoistway doors 202*a* and 202*b* and the wall structure 10 around the hoistway entrance 14, to seal spaces between the hoistway doors and the wall structure when the doors are in the closed position, for example, to restrict the passage of gas and smoke through the spaces in the event of a fire. The formation of these seals is facilitated by the elongated door support member 246, which is constructed to move the hoistway doors 202*a* and 202*b* laterally from the open position, and as the hoistway doors approach the closed position, the door support member is adapted to move the hoistway doors into sealable engagement with the seals.

Figure 31:
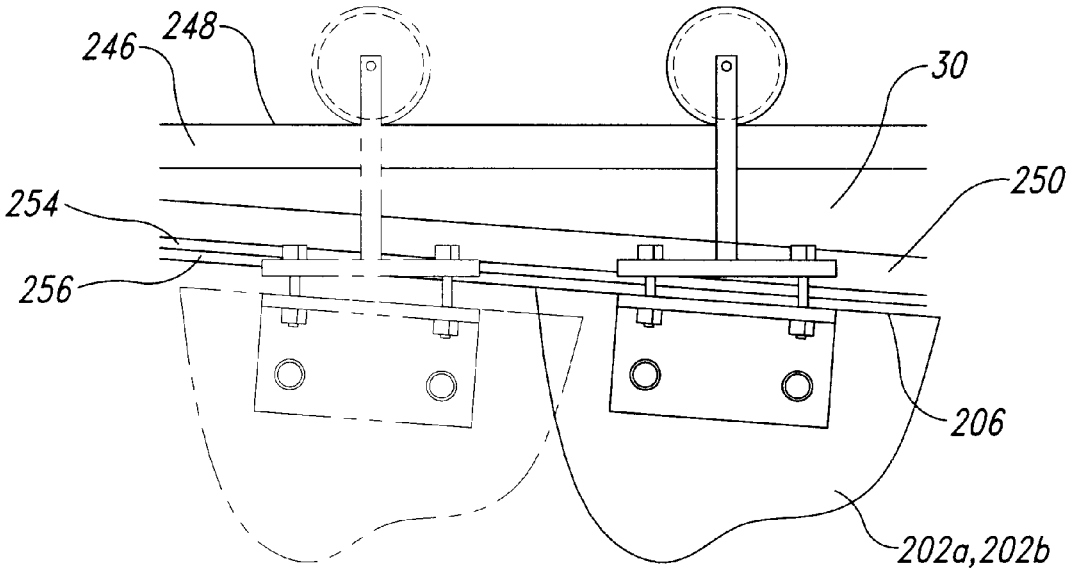
FIG. 31 is an enlarged fragmentary elevation view of a door support truck and a support roller of the hoistway door of FIG. 30 with the door support truck and the support roller shown in phantom lines in a position prior to closing and shown in solid lines with the hoistway door in a closed position.
Figure 32A:
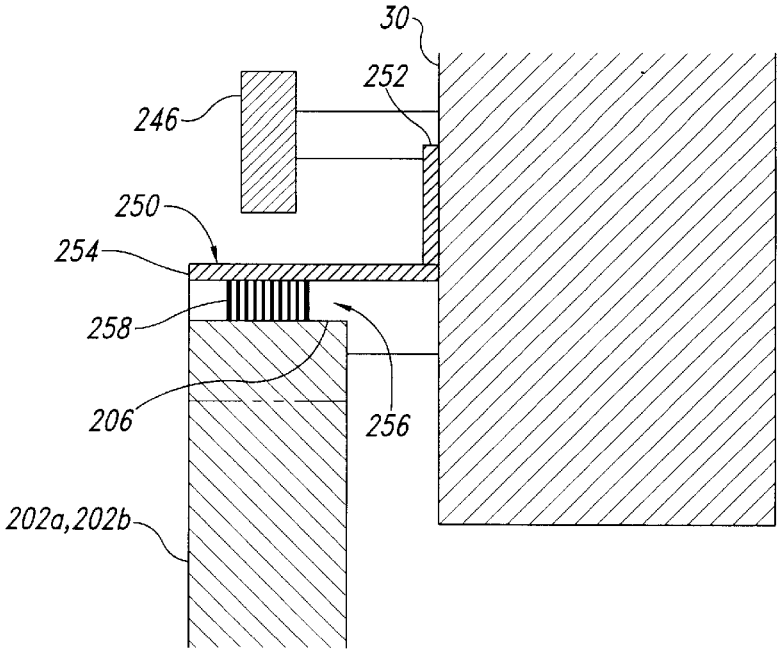
FIG. 32*a* is an enlarged cross-sectional view taken substantially along the line 32*a,b*—32*a,b* of FIG. 30 with the door supports not shown for clarity, and with a transverse edge seal structure shown in phantom lines in a position prior to closing and shown in solid lines with the hoistway door in a closed position.
Figure 32B:
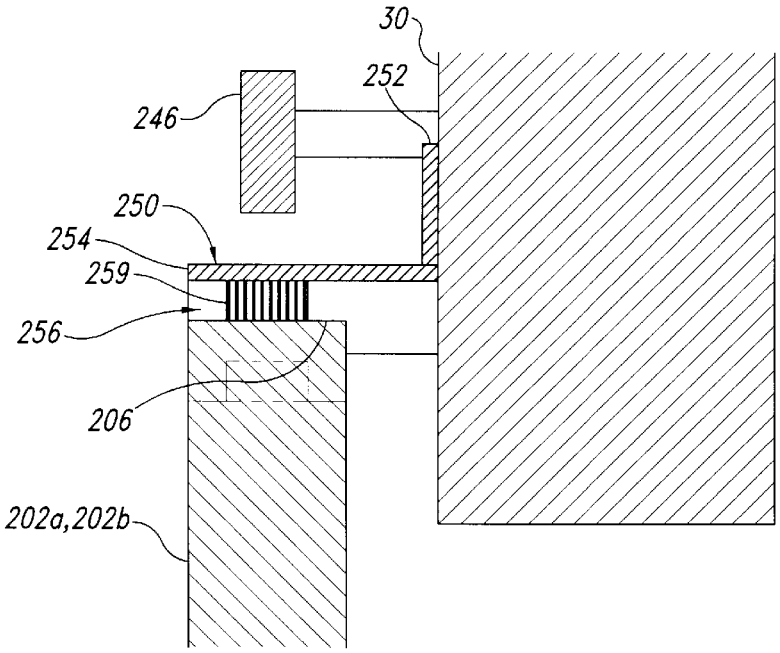
FIG. 32*b* is an enlarged cross-sectional view taken substantially along the line 32*a,b*—32*a,b* of FIG. 30 with the door supports not shown for clarity, and with an alternate embodiment of a transverse edge seal structure shown in phantom lines in a position prior to closing and shown in solid lines with the hoistway door in a closed position.

As best seen in FIGS. 30 and 31, the elongated door support member 246 is a substantially horizontal rail with the uppermost edge of the rail forming a horizontal roller support surface 248. A sloped transverse seal structure 250 is mounted to the headwall 30 below the elongated door support member 246 and slopes downwardly from its outer ends toward the centerline of the hoistway entrance 14 and as best seen in FIGS. 32*a* and 32*b*, has an L-shaped cross-section, wherein an attachment leg 252 of the structure is securely fastened to the headwall 30 in a conventional manner. An engagement leg 254 extends perpendicularly away from the headwall 30. A sloped transverse edge 206 of the hoistway doors 202*a* and 202*b* substantially corresponds to the slope of the sloped transverse seal structure 250.

As best seen in FIG. 31, when the hoistway doors 202*a* and 202*b* are moved to the closed position, shown in solid lines, the sloped transverse edge 206 of the hoistway doors 220*a* and 202*b* are positioned below the engagement leg 254 of the sloped transverse seal structure 250 to define a sloped transverse space 256.

As best seen in FIG. 32*a*, an elongated transverse seal 258 is secured to the length of the engagement leg 254 of the sloped transverse seal structure 250. The elongated transverse seal 258 extends downwardly away from the engagement leg 254 toward the sloped transverse edge 206 of the hoistway doors 202*a* and 202*b*. The elongated transverse seals 258 are out of engagement with the sloped transverse edge 206 when the respective doors 202*a* and 202*b* are in the open position shown in phantom lines, thereby avoiding frictional resistance between the elongated transverse seal and the sloped transverse edge as the door moves between the open and closed positions. When the hoistway doors 202*a* and 202*b* are moved to the closed position shown in solid lines, the sloped transverse edge 206 is moved into sealable engagement with the elongated transverse seal 258 as to seal the sloped transverse space 256. In the preferred embodiment, the elongated transverse seal 258 is a shaped, resilient temperature resistant material that is slightly compressed by the sloped transverse edge 206 when the hoistway doors 202*a* and 202*b* are moved to the closed position.

As best seen in FIG. 32*b*, an alternate embodiment of the elongated transverse seal 259 is securely mounted to the length of the sloped transverse edge 206 of the hoistway doors 202*a* and 202*b*. The elongated transverse seal 259 extends upwardly away from the sloped transverse edge 206 toward the engagement leg 254 of the sloped transverse seal structure 250. Accordingly, when the hoistway doors 202*a* and 202*b* are moved to the closed position, shown in solid lines, the elongated transverse seal 259 moves into sealable engagement with the engagement leg 254 to seal the sloped transverse space 256.

The seal structures along the bottom edge of the hoistway doors are as described above and illustrated in FIG. 22. The seal structures along the trailing edges of the hoistway doors are as described above and illustrated in FIGS. 7*a* and 7*b*. The seal structures along the meeting edge of an opposing door configuration are as described above and illustrated in FIGS. 8*a* and 8*b*. In a configuration with a single hoistway door, the seal structures along the leading edge of the single hoistway door is as described above and illustrated in FIGS. 10*a* and 10*b*. In a configuration having pairs of opposing inner and outer hoistway doors, the seal structures along the trailing edge of the outer hoistway door and the leading edge of the inner hoistway door are as described above for a pair or multiple pairs of hoistway doors and illustrated in FIGS. 12*a* and 12*b*.

Figure 33A:
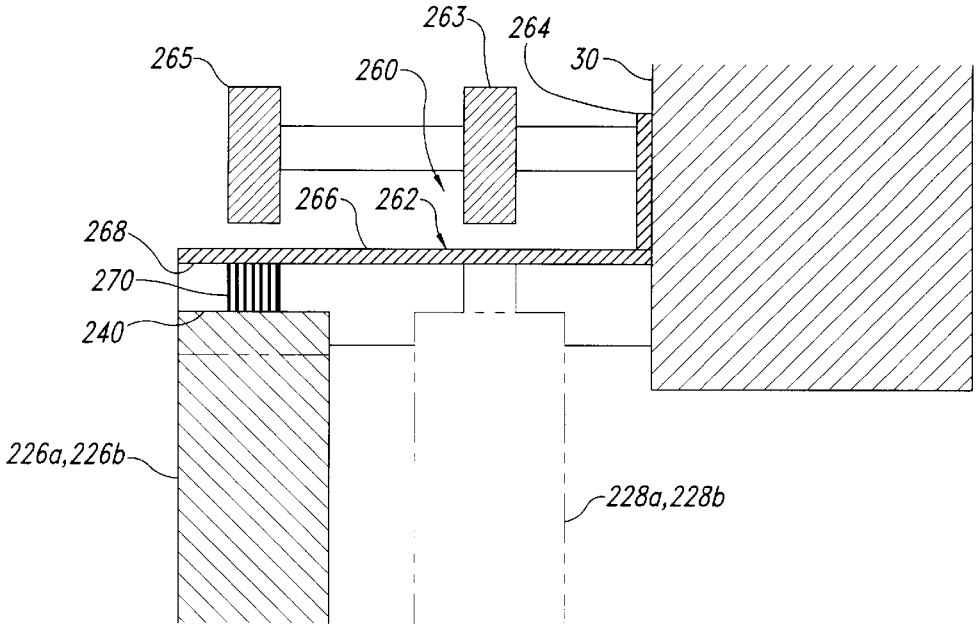
FIG. 33*a* is an enlarged cross-sectional view of a pair of adjacent supports similar to FIG. 29*a* and in accordance with the alternate embodiment of FIG. 30, with the door supports not shown for clarity, and with a transverse edge seal structure shown in phantom lines in a position prior to closing and shown in solid lines with the hoistway door in a closed position.
Figure 33B:
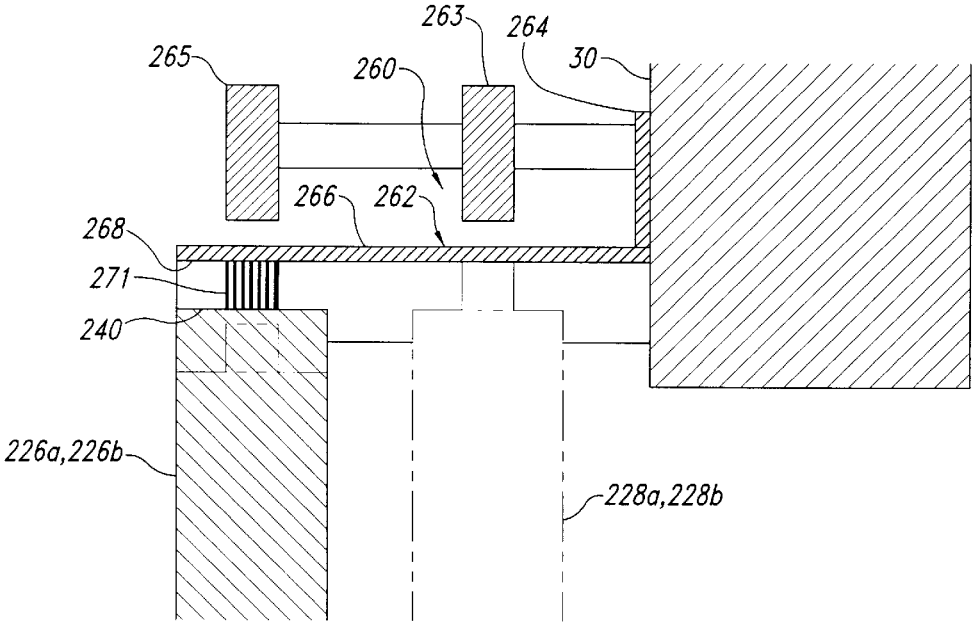
FIG. 33*b* is an enlarged cross-sectional view of an alternate embodiment of a transverse edge seal structure of FIG. 33*a*, with the door supports not shown for clarity, and with the transverse edge seal structure shown in phantom lines in a position prior to closing and shown in solid lines with the hoistway door in a closed position.

In an alternate embodiment, illustrated in FIGS. 33*a* and 33*b*, the sloped transverse edge 240 of the outer hoistway doors 226*a* and 226*b* are positioned outwardly adjacent to the inner hoistway doors 228*a* and 228*b*, and to the headwall 30 to define a sloped transverse head panel space 260. A sloped transverse seal structure 262 is mounted to the headwall 30 above the hoistway entrance and below inner and outer elongated door support members 263 and 265 that are also mounted to the headwall. The sloped transverse seal structure 262 slopes downwardly from its outer ends toward the centerline of the hoistway entrance and has an L-shaped cross section, wherein an attachment leg 264 of the structure is securely fastened to the headwall 30 in a conventional manner. An engagement leg 266 extends perpendicularly away from the headwall 30. The sloped transverse edge 240 of the outer hoistway doors 226*a* and 226*b* substantially corresponds to the slope of the sloped transverse seal structure 262. When the outer hoistway doors 226*a* and 226*b* are moved to the closed position, shown in solid lines, the transverse edge 240 of the outer hoistway doors 226*a* and 226*b* are outwardly positioned from the engagement leg 266 to define a sloped transverse space 268. The outer ends of the sloped transverse seal structure 262 terminate at a positioned above the left and right jambwalls 70*a* and 70*b* (shown in FIG. 30), such that the sloped transverse seal structure does not interfere with lateral movement of the inner hoistway doors 228*a* and 228*b* as they move toward the closed position.

As best seen in FIG. 33*a*, an elongated sloped transverse seal 270 is secured to the length of the engagement leg 266 of the sloped transverse seal structure 262. The elongated sloped transverse seal 270 projects downwardly away from the engagement leg 266 toward the sloped transverse edge 240 of the outer hoistway doors 226*a* and 226*b* into the sloped transverse space 268. The elongated sloped transverse seals 270 are out of engagement with the sloped transverse edge 240 when the respective outer hoistway doors 226*a* and 226*b* are in the open position shown in phantom lines. When the outer hoistway doors 226*a* and 226*b* are moved to the closed positions shown in solid lines, the sloped transverse edge 240 moves laterally into sealable engagement with the elongated sloped transverse seal 270 so as to seal the sloped transverse space 268. In the preferred embodiment, the elongated sloped transverse seal 270 is a shaped, resilient temperature resistive material that is slightly compressed by the sloped transverse edge 240 when the outer hoistway doors 226*a* and 226*b* are moved to the closed position.

In an alternate embodiment illustrated in FIG. 33*b*, an elongated sloped transverse seal 271 is mounted to the outer hoistway door 226*a* and 226*b* along the entire sloped transverse edge 240 oriented toward the engagement leg 266 into the sloped transverse space 268. The elongated sloped transverse seal 271 extends away from the sloped transverse edge 240 such that when the hoistway doors are in the closed position, shown in solid lines, the elongated sloped transverse seal 271 is pressed into sealable engagement with the engagement leg 266 so as to form a seal within the sloped transverse edge space 268 and block any gas or smoke from flowing therethrough in the event of a fire or the like.

Accordingly, when the outer hoistway doors 226*a* and 226*b* are moved from the open position to the closed position, the hoistway doors move laterally to form seals around the entire hoistway entrance between the hoistway door assembly and the wall structure and between the meeting edges, bottom edges and interdoor edges of the hoistway doors. Thus, all of the spaces around and between the hoistway doors are effectively sealed off when the doors are in the closed position so as to limit the flow of gas or smoke in the event of a fire, thereby minimizing migration of smoke through a building during a fire or the like.

Although the embodiments described herein are described in terms of the seals around the hoistway door blocking the flow of smoke and gas in the event of a fire, the seals are also effective in blocking the flow of air or the like between the hoistway door and the wall structure during operation or maintenance of the hoistway.

From the foregoing, it will be appreciated that, although specific embodiments of the invention have been described herein for purposes of illustration, various modifications may be made without deviating from the spirit and scope of the invention. Accordingly, the invention is not limited except as by the appended claims.

I claim:

1. A hoistway door seal structure for limiting the flow of air through a hoistway opening when the door is closed, comprising:

a wall structure having an opening therein defining a hoistway entrance;

a hoistway door for covering at least a portion of the hoistway entrance;

a seal structure supported between the hoistway door and the wall structure;

an elongated door support member positioned in a generally horizontal orientation, connected to the wall structure;

a door support connected to the hoistway door and movably connected to the elongated support member to support the door while permitting movement of the door in a lateral direction between an open position permitting access to the hoistway and a closed position wherein the door substantially covers the hoistway entrance with a space between the hoistway door and the wall structure; and wherein the elongated support member has a top guide portion and a bottom guide portion adapted to guide the hoistway door in a second direction toward the seal structure, the second direction being different than the lateral direction when the hoistway door is moved to the closed position to cause the hoistway door to sealably engage the seal structure to seal the space between the door and the wall structure when the door is closed to limit smoke flow, the bottom guide portion being a downwardly sloped portion that is engaged by the door support and that directs the hoistway door downwardly when the hoistway door moves from the open position toward the closed position.

2. A hoistway door seal structure for limiting the flow of air through a hoistway opening when the door is closed, comprising:

a wall structure having an opening therein defining a hoistway entrance having a headwall, a pair of lateral jambwalls, and a sill;

a moveable, hoistway door that removably covers at least a portion of the hoistway entrance, the hoistway door having a leading edge and a trailing edge;

a door support rail positioned in a generally horizontal orientation and connected to the wall structure, the door support rail having a roller support surface;

a plurality of spaced, door support trucks connected to the hoistway door, each truck having a support roller engaging the roller support surface of the support rail and supporting the hoistway door while permitting lateral movement of the hoistway door between an open position permitting access to the hoistway and a closed position wherein the door substantially covers the hoistway entrance with the door spaced from the sill to define a sill space, spaced from the headwall to define a transverse space and spaced from the jambwalls to define trailing edge and leading edge lateral spaces;

a leading edge sealing structure supported between the hoistway door and the wall structure, the leading edge sealing structure sealing the leading edge lateral space when the hoistway door is in the closed position and restricting the passage of smoke in the event of a fire;

a trailing edge sealing structure supported between the hoistway door and the wall structure, the trailing edge sealing structure sealing the trailing edge lateral space when the hoistway door is in the closed position and restricting the passage of smoke in the event of a fire;

a transverse sealing structure supported between the hoistway door and the wall structure, the transverse sealing structure sealing the transverse space when the hoistway door is closed; and a sill sealing structure connected to the bottom of the door, the sill sealing structure sealing the sill space when the hoistway door is closed;

wherein the support rail has a top guide portion engaged by each support roller, and a bottom guide portion guiding the hoistway door in a second direction different than the lateral direction when the hoistway door is moved to the closed position and causing the sill sealing structure to engage the sill to seal the sill space and causing the transverse sealing structure to seal the transverse space when the door is in the closed position, the bottom guide portion being downwardly sloped portions engaged by the door support trucks, the downwardly sloped portions guiding the hoistway door downwardly when the hoistway door moves from the open position toward the closed position.

3. A hoistway door seal structure for limiting the flow of air through a hoistway opening when the doors are closed to restrict the passage of smoke in the event of a fire, comprising:

a wall structure having an opening therein defining a hoistway entrance having a headwall;

a pair of opposing hoistway doors that movably cover the hoistway entrance;

an elongated door support member positioned in a generally horizontal orientation and connected to the wall structure;

spaced, door supports connected to each door, each support movably connected to the elongated support member, the door supports supporting an associated door while permitting lateral movement of the door between an open position permitting access to the hoistway and a closed position wherein the doors substantially cover the hoistway entrance with the doors each spaced from the headwall to define transverse spaces;

transverse seal structures supported between each door and the wall; and wherein the door support member has a top guide portion engaged by the door supports, and a bottom guide portion guiding the hoistway door in a second direction toward the transverse seal structures, the second direction being different than the lateral direction when the hoistway door is moved to the closed position, the movement of the doors in the second direction sealing the transverse space with the transverse sealing structures when the doors are in the closed position, the bottom guide portion being downwardly sloped portions engaged by the door support trucks, the downwardly sloped portions directing the hoistway door vertically downward when the hoistway door moves from the open position toward the closed position.

4. The hoistway door seal structure of claim 3 wherein the hoistway entrance has a pair of lateral jambs, and the doors substantially cover the hoistway entrance with the doors each spaced from the jambwall to define lateral spaces, and further comprising lateral sealing structures supported between each door and the wall, the lateral sealing structures sealing the lateral spaces when the doors moved to the closed position, the guide portions of the door support member moving the doors into sealable engagement with the transverse sealing structures to seal the transverse spaces when the doors are moved to the closed position.

5. The hoistway door seal structure of claim 3 wherein the hoistway entrance has a sill, and the doors substantially cover the hoistway entrance with the doors each spaced from the sill to define sill spaces and spaced from each other to define a meeting edge space, and further comprising an elongated seal connected to the meeting edge of one of the doors sized to contact the meeting edge of the other door when the doors are in a closed position to seal the meeting edge space, and an elongated seal is connected to the bottom of each door, the guide portions of the door support member directing the doors so the elongated seal sealably engages the sill and seals the sill spaces when the doors are in the closed position.

6. A hoistway door seal structure for limiting the flow of air through a hoistway opening when the doors are closed to restrict the passage of smoke in the event of a fire, comprising:

a wall structure having an opening therein defining a hoistway entrance having a headwall, a pair of lateral jambs and a sill;

a pair of opposing hoistway doors for movably covering the hoistway entrance;

a door support rail positioned in a generally horizontal orientation and connected to the wall structure, the door support rail having a roller support surface;

a plurality of spaced, door support trucks connected to each door, each truck having a support roller engaging the roller support surface of the support rail to support the associated door while permitting lateral movement of the door between an open position permitting access to the hoistway and a closed position wherein the doors substantially cover the hoistway entrance with the doors each spaced from the sill to define sill spaces, spaced from the headwall to define transverse spaces, spaced from the jambs to define lateral spaces and spaced from each other to define a meeting edge space;

an elongated lateral extension extending from the lateral portion of each door toward the wall;

lateral seals, each extending from the wall toward the associated door in an overlapping relationship to the lateral door extensions to contact the lateral door extensions to seal the associated lateral spaces when the doors are in the closed position;

an elongated seal connected to the meeting edge of one of the doors sized to contact the meeting edge of the other door when the doors are in the closed position to seal the meeting edge space;

elongated transverse extensions projecting from the top portion of each door toward the wall;

elongated transverse seals projecting from the wall in an overlapping relationship with respect to the associated transverse door extension; and an elongated seal connected to the bottom of each door; and wherein the support rail has a top guide portion engaged by each support roller, and a bottom guide portion guiding the hoistway doors in a second direction different than the lateral direction when the hoistway doors are moved to the closed position to cause the bottom door seals to engage the sill to seal the sill spaces and to cause the transverse seals to engage the transverse door extensions to seal the transverse spaces when the doors are closed.

7. The hoistway door seal structure of claim 6 wherein the guide portions are downwardly sloped portions and the second direction is vertically downward toward the sill, the downwardly sloped portions directing the doors downwardly toward the sill when the doors are moved toward the closed position to cause the bottom door seals to engage the sill to seal the sill spaces.

8. A hoistway door seal structure for limiting the flow of air through a hoistway opening when the doors are closed to restrict the passage of smoke in the event of a fire, comprising:

a wall structure having an opening therein defining a hoistway entrance having a headwall, a pair of lateral jambs and a sill;

a pair of opposing hoistway doors movably adjacent to the hoistway entrance;

a door support rail positioned in a generally horizontal orientation and connected to the wall structure, the door support rail having a roller support surface;

a plurality of spaced, door support trucks connected to each door, each truck having a support roller engaging the surface of the support rail to support the associated door while permitting lateral movement of the door between an open position permitting access to the hoistway and a closed position wherein the doors substantially cover the hoistway entrance with the doors each spaced from the sill to define sill spaces, spaced from the headwall to define transverse spaces, spaced from the jambs to define lateral spaces and spaced from each other to define a meeting edge space;

elongated lateral extensions on either side of the hoistway entrance, each projecting toward an associated one of the doors;

lateral seals projecting from each of the doors toward the wall in an overlapping relationship with the lateral wall extensions to contact the lateral wall extensions to seal the associated lateral spaces when the doors are in the closed position;

an elongated seal connected to the meeting edge of one of the doors sized to contact the meeting edge of the other door when the doors are in the closed position to seal the meeting edge space;

elongated transverse extensions projecting from the top portion of each door toward the wall;

elongated transverse seals projecting from the wall in an overlapping relationship with respect to the associated transverse door extension;

an elongated bottom door seal connected to the bottom of each door; and wherein the roller support surface of the support rail has guide portion engaged by each support roller and a bottom guide portion guiding the hoistway doors in a second direction different than the lateral direction when the hoistway doors are moved toward the closed position to cause the bottom door seals to engage the sill to seal the sill spaces and to cause the transverse seals to engage the transverse door extensions to seal the transverse spaces.

9. The hoistway door seal structure of claim 8 wherein the guide portions are downwardly sloped portions and the second direction is vertically downward toward the sill, the downwardly sloped portions direct the doors downwardly toward the sill when the doors are moved to the closed position.

10. A hoistway door seal structure for limiting the flow of air through a hoistway opening when the doors are closed to restrict the passage of smoke in the event of a fire, comprising:

a wall structure having an opening therein defining a hoistway entrance having a head, a pair of lateral jambs and a sill;

a pair of opposing hoistway doors movably adjacent to the hoistway entrance;

a door support rail positioned in a generally horizontal orientation and connected to the wall structure, the door support rail having a roller support surface;

a plurality of spaced, door support trucks connected to each door, each truck having a support roller engaging the surface of the support rail to support the associated door while permitting lateral movement of the door between an open position permitting access to the hoistway and a closed position wherein the doors substantially cover the hoistway entrance with the doors each spaced from the sill to define sill spaces, spaced from the headwall to define transverse spaces, spaced from the jambwall to define lateral spaces and spaced from each other to define a meeting edge space;

an elongated lateral extension projecting from the lateral portion of each door towards the wall;

lateral seals, each projecting from the wall toward the associated door in an overlapping relationship to the lateral door extensions to contact the lateral door extensions to seal the associated lateral spaces when the doors are in the closed position;

an elongated seal connected to the meeting edge of one of the doors sized to contact the meeting edge of the other door when the doors are in the closed position to seal the meeting edge space;

an elongated transverse extension projecting from the wall above the hoistway entrance towards the doors;

elongated transverse seals projecting from each of the doors in an overlapping relationship with respect to the associated transverse wall extension; and an elongated seal connected to the bottom of each door; and wherein the support rail has a top guide portion engaged by each support roller, and a bottom guide portion guiding the hoistway doors in a second direction different than the lateral direction when the hoistway doors are moved toward the closed position to cause the bottom door seals to engage the sill to seal the sill spaces and to cause the transverse seals to engage the transverse wall extensions to seal the transverse spaces.

11. The hoistway door seal structure of claim 10 wherein the guide portions are downwardly sloped portions and the second direction is vertically downward toward the sill, the downwardly sloped portions directing the doors downwardly toward the sill when the doors are moved to the closed position.

12. A hoistway door seal structure for limiting the flow of air through a hoistway opening when the doors are closed to restrict the passage of smoke in the event of a fire, comprising:

a wall structure having an opening therein defining a hoistway entrance having a head, a pair of lateral jambs and a sill;

a pair of opposing hoistway doors adjacent to the hoistway entrance, a door support rail positioned in a generally horizontal orientation and connected to the wall structure, the door support rail having a roller support surface;

a plurality of spaced, door support trucks connected to each door, each truck having a support roller engaging the surface of the support rail to support the associated door while permitting lateral movement of the door between an open position permitting access to the hoistway and a closed position wherein the doors substantially cover the hoistway entrance with the doors each spaced from the sill to define sill spaces, spaced from the headwall to define transverse spaces, spaced from the jambwall to define lateral spaces and spaced from each other to define a meeting edge space;

elongated lateral wall extensions on either side of the hoistway entrance, each of the elongated lateral wall extensions projecting towards the associated door;

lateral seals projecting from each of the doors toward the wall in an overlapping relationship with the lateral wall extensions to contact the lateral wall extensions to seal the associated lateral spaces when the doors are closed;

an elongated seal connected to the meeting edge of one of the doors, the elongated seal contacting the meeting edge of the other door when the doors are in the closed position and sealing the meeting edge space;

an elongated transverse extension extending from the wall above the hoistway entrance towards the doors;

elongated transverse seals extending from each of the doors in an overlapping relationship with respect to the associated transverse wall extension; and an elongated seal connected to the bottom of each door; and, wherein the support rail has guide portion engaged by each support roller, and a bottom guide portion guiding the hoistway doors in a second direction different than the lateral direction when the hoistway doors are moved to the closed position to cause the bottom door seals to engage the sill to seal the sill spaces and to cause the transverse seals to engage the transverse wall extensions to seal the transverse spaces when the doors are closed.

13. A hoistway door seal structure for limiting the flow of air through a hoistway opening when the door is closed to restrict the passage of smoke in the event of a fire, comprising:

a wall structure having an opening therein defining a hoistway entrance;

a hoistway door for covering the hoistway entrance, the hoistway door having a sloped top edge portion that sloped downwardly at an angle;

an elongated door support member positioned in a generally horizontal orientation and connected to the wall structure, the elongated support member having a generally horizontal support surface and sloped bottom surface opposite the horizontal support surface, the sloped bottom surface sloping downwardly at approximately the angle of the door's sloped top edge portion;

a seal structure supported between the sloped bottom surface of the elongated door support and the sloped top edge portion of the hoistway door;

a door support connected to the hoistway door and movably connected to the support surface of the elongated support member to support the door while permitting movement of the door in a lateral direction between an open position permitting access to the hoistway and a closed position wherein the door substantially covers the hoistway entrance with a space between the hoistway door and the wall structure, the door support retaining the sloped top edge portion at approximately the same distance from the support surface when the hoist way door moves between the open and closed positions; and wherein the sloped top edge of the hoistway door is immediately adjacent to the sloped bottom surface of the elongated support member and the sloped top edge sealably engages the seal structure when the hoistway door is moved to the closed position to seal the space between the door and the wall structure when the door is in the closed position, and the sloped top edge of the hoistway door is positioned below and away from the sloped bottom surface of the elongated support member with an unsealed space therebetween when the hoistway door is moved toward the open position to allow uninhibited movement of the hoistway door between the open and closed positions.

14. The hoistway door seal of claim 13 wherein said hoistway door includes first and second opposing door panels, said first door panel having a first sloped top edge portion the slopes downwardly at a first angle toward said second opposing door panel, said second door panel having a second sloped top edge portion that slopes downwardly at a second angle toward said first opposing door panel, and said sloped bottom surface of said door support having a opposing first and second sloped sections, said first sloped section being positioned above said first door panel and sloping downwardly toward said second door panel and said second sloped section being positioned above said second door panel and sloping downwardly toward said first door panel, said first sloped section of said door support engaging said first sloped edge portion of said first door panel and said second sloped section of said door support engaging said second sloped edge portion of said second door panel when said door is closed.

15. The hoistway door seal of claim 13 wherein said hoistway entrance has a headwall, a pair of lateral jambwalls, and a sill, said hoistway door has a leading edge and a trailing edge, and said seal structure includes a leading edge sealing structure supported between the hoistway door and the wall structure for sealing the leading edge lateral space when the hoistway door is in the closed position, a trailing edge sealing structure supported between the hoistway door and the wall structure for sealing the trailing edge lateral space when the hoistway door is in the closed position, a transverse sealing structure supported between the hoistway door and the wall structure for sealing the transverse space when the hoistway door is in the closed position, a sill sealing structure connected to the bottom of the door for sealing the sill space when the hoistway door is in the closed position, wherein said sloped bottom edge of the elongated support member engages the hoistway door and causes the sill structure to engage the sill to seal the sill space and causes the transverse sealing structure to seal the transverse space when the door is in the closed position.

16. A hoistway door seal structure for limiting the flow of air into or out of a hoistway, comprising:

a wall structure having an opening therein defining a hoistway entrance;

a hoistway door sized to cover at least a portion of the hoistway entrance when in a fully closed position and to allow access to the hoistway through the hoistway entrance when in an open position;

an elongated door support member positioned in a generally horizontal orientation and connected to the wall structure;

a door support device connected to the hoistway door and movably supported by the elongated door support member to support the hoistway door for substantially planar movement of the hoistway door in a lateral direction between the fully open position and the fully closed position, when in the fully closed position a space is provided between the hoistway door and the wall structure; and a seal structure positioned in the space between the hoistway door and the wall structure when the hoistway door is in the fully closed position, the elongated door support member adapted to guide the hoistway door to move along a path of movement in a selected direction relative to the seal structure between a partially closed position and the fully closed position as the hoistway door is moved into and out of the fully closed position, the seal structure having a door-mounted portion with a seal engaging surface positioned at a selected oblique angle relative to the door support, a wall-mounted portion having an angled seal mating surface positioned substantially parallel to the seal engaging surface, and a seal attached to one of the seal mating surface and the seal engaging surface and sealably engaging the other of the seal mating surface and the seal engaging surface to seal the space between the hoistway door and the wall structure when the hoistway door is moved into the fully closed position to limit smoke flow through the hoistway entrance, the seal being spaced apart from the other of the seal mating surface and the seal engaging surface and out of engagement therewith when the hoistway door is moved into the partially closed position.

17. The hoistway door seal structure of claim 16 wherein the seal is mounted to the seal engaging surface of the door-mounted portion.

18. The hoistway door seal structure of claim 16 wherein the hoistway door includes a pair of opposing hoistway door portions.

19. The hoistway door seal structure of claim 16 wherein the seal structure is a transverse seal structure attached to a top portion of the hoistway door and to a portion of the wall structure above the hoistway entrance.

* * * * *